US012600546B2

(12) United States Patent
Limousin et al.

(10) Patent No.: US 12,600,546 B2
(45) Date of Patent: Apr. 14, 2026

(54) PACKAGING

(71) Applicant: WestRock Packaging Systems, LLC, Atlanta, GA (US)

(72) Inventors: Frederic Limousin, Le Poinçonnet (FR); Julien Merzeau, Châteauroux (FR); Jean-Christophe Bonnain, Châteauroux (FR); Matthew E. Zacherle, Moseley, VA (US); Gérald Portrait, Mers sur Indre (FR); Dominique Perrin, Saint Maur (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 34 days.

(21) Appl. No.: 18/572,648

(22) PCT Filed: Jun. 21, 2022

(86) PCT No.: PCT/US2022/034305

§ 371 (c)(1),
(2) Date: Dec. 20, 2023

(87) PCT Pub. No.: WO2022/271672

PCT Pub. Date: Dec. 29, 2022

(65) Prior Publication Data

US 2024/0336381 A1 Oct. 10, 2024

Related U.S. Application Data

(60) Provisional application No. 63/287,476, filed on Dec. 8, 2021, provisional application No. 63/250,821, filed (Continued)

(51) Int. Cl.
*B65D 71/42* (2006.01)
*B65B 17/02* (2006.01)

(Continued)

(52) U.S. Cl.
CPC ..... *B65D 71/42* (2013.01); *B65B 17/025* (2013.01); *B65B 35/30* (2013.01); *B65B 43/10* (2013.01);

(Continued)

(58) Field of Classification Search
USPC ..... 53/398
See application file for complete search history.

(56) References Cited

U.S. PATENT DOCUMENTS 4,571,923 A 2/1986 Le Bras
2009/0127147 A1* 5/2009 Sutherland ..... B65D 71/42 206/429

(Continued)

FOREIGN PATENT DOCUMENTS

EP 2067713 A1 6/2009

OTHER PUBLICATIONS

PCTUS2234305 International Search Report dated Nov. 21, 2022, 5 pages.

*Primary Examiner* — Chinyere J Rushing-Tucker
(74) *Attorney, Agent, or Firm* — Brian J. Goldberg; Rohini K. Garg; Tsugihiko Suzuki

(57) ABSTRACT

Aspects of the disclosure relate to a packaging system, an apparatus (400; 500; 600; 700) for forming a package, an article carrier (90; 190; 390; 490) for packaging one or more articles, a blank (10; 110; 310; 410A-B) for forming the carrier, and to a method of packaging one or more articles. The carrier (90; 190; 390; 490) comprises a main panel (12; 112; 312; 412) having one or more article retention structures (RT1, RT2) for receiving and securing the main panel (12; 112; 312; 412) to a respective article (B). The carrier (90; 190; 390; 490) comprises at least one panel having a peripheral edge, a portion of which provides at least one registration edge shaped to inhibit movement in two (Continued)

orthogonal directions when engaged by a reference device (440; 540; 640; 740) of a packaging apparatus (400; 500; 600; 700).

20 Claims, 24 Drawing Sheets

Related U.S. Application Data on Sep. 30, 2021, provisional application No. 63/213,420, filed on Jun. 22, 2021.

(51) Int. Cl.

| | |
|---|---|
| ***B65B 35/30*** | (2006.01) |
| ***B65B 43/10*** | (2006.01) |
| ***B65B 61/06*** | (2006.01) |
| ***B65D 71/46*** | (2006.01) |

(52) U.S. Cl.
CPC ..... *B65B 61/06* (2013.01); *B65D 71/46* (2013.01); *B65D 2571/00154* (2013.01); *B65D 2571/0066* (2013.01)

(56) References Cited

U.S. PATENT DOCUMENTS

| | | | | |
|---|---|---|---|---|
| 2009/0266872 | A1* | 10/2009 | Fogle | B65B 11/004 53/396 |
| 2010/0264043 | A1* | 10/2010 | De Paula | B65D 71/42 229/117.14 |
| 2011/0030311 | A1* | 2/2011 | Martini | B65B 43/185 53/154 |
| 2019/0233145 | A1* | 8/2019 | Kooc | B65B 17/025 |
| 2019/0300255 | A1 | 10/2019 | Ikeda | |
| 2021/0331819 | A1* | 10/2021 | Ford | B65B 17/025 |
| 2023/0101990 | A1* | 3/2023 | Ford | B65B 41/10 493/88 |
| 2023/0382619 | A1* | 11/2023 | Ford | B65D 71/42 |

* cited by examiner

PACKAGING

CROSS-REFERENCE TO RELATED APPLICATIONS

The present application is a 35 U.S.C. §§ 371 national stage application of PCT/US2022/34305 filed on 21 Jun. 2022, which claims the benefit of priority to U.S. Provisional Patent Application Ser. No. 63/250,821 filed on 30 Sep. 2021; U.S. Provisional Patent Application Ser. No. 63/213,420 filed on 22 Jun. 2021 and, U.S. Provisional Patent Application Ser. No. 63/287,476 filed on 8 Dec. 2021 the contents of each of which are incorporated herein by reference in their entirety.

TECHNICAL FIELD

The present invention relates to packaging systems, to packaging machines and apparatus therefor, to article carriers and blanks for forming the same, and to methods of packaging articles. More specifically, but not exclusively, the invention relates to a carrier of the top-gripping type having one or more apertures for receiving and retaining an article therein and to methods and apparatus for forming the same.

BACKGROUND

In the field of packaging, it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said panel and are arranged about the aperture. The tabs are displaced out of the plane of said panel when an article is received in the aperture, wherein said tabs engage the article generally about a flange or lip of the article.

It is desirable to automate formation of the packages from the article carriers by employing a packaging machine capable of operating at high production capacities. In particular it is desirable to package articles as they are in continuous motion, in a downstream direction, through a packaging apparatus.

The present invention seeks to provide an improvement in the field of packaging, of cartons, typically formed from paperboard or the like, and apparatus for assembly of said cartons.

SUMMARY

A first aspect of the invention provides an article engaging carrier for packaging at least one article. The carrier comprises a main panel having at least one article retention structure for engaging an article. The carrier comprises at least one panel having a peripheral edge, a portion of which provides at least one registration edge shaped to inhibit movement in two orthogonal directions when engaged by a reference device of a packaging apparatus.

Optionally, the article carrier comprises a side panel hingedly connected to the main panel by a hinged connection.

Optionally, the at least one registration edge is provided by a peripheral edge portion of the side panel.

Optionally, the at least one registration edge comprises a leading registration edge and a trailing registration edge.

Optionally, the article carrier comprises a cover panel hingedly connected to the side panel by a hinged connection.

Optionally, the at least one registration edge is provided by a peripheral edge portion of the cover panel.

Optionally, the at least one registration edge comprises a leading registration edge and a trailing registration edge.

Optionally, the article carrier comprises a pair of opposing side panels each hingedly connected to the main panel by a hinged connection and comprising at least one registration edge.

Optionally, the at least one registration edge comprises a leading registration edge and a trailing registration edge.

Optionally, the article carrier comprises a pair of opposing side panels each hingedly connected to the main panel by a hinged connection, a cover panel hingedly connected to each of the pair of opposing side panels and comprising at least one registration edge.

Optionally, the at least one registration edge comprises a leading registration edge and a trailing registration edge.

Optionally, the article carrier comprises a pair of opposing end panels each hingedly connected to the main panel by a hinged connection.

Optionally, the panel having a peripheral edge portion providing at least one registration edge is hingedly connected to the main panel by a hinged connection.

Optionally, the panel having a peripheral edge portion providing at least one registration edge is hingedly connected to the main panel by at least one hinge panel.

Optionally, the at least one panel comprises a pair of panels each having a registration edge, a linear notional line passing through the registration edge in each of pair of panels passes through an opening in the main panel defined by the at least one article retention structure.

Optionally, the main panel comprises at least one stabilisation device providing an opening in the main panel and configured to inhibit movement in two orthogonal directions.

A second aspect of the invention provides an apparatus for packaging one or more articles in an article carrier. The apparatus comprises an article engagement tool for engaging an article and conveying the article in a downstream direction. The article engagement tool comprises a reference device for aligning at least one blank with one or more articles.

Optionally, the apparatus comprises an overhead conveyor for conveying the at least one blank onto the one or more articles.

Optionally, the reference device comprises an abutment pin extending upwardly from the article engagement tool beyond the upper extremity of the one or more articles.

Optionally, the article engagement tool comprises a removable head to which the reference device is mounted.

Optionally, the head comprises part of a tool-less attachment system.

Optionally, the tool-less attachment system comprises a bayonet fitting.

Optionally, the apparatus comprises a plurality of article engagement tools each for engaging a respective article, metering and grouping the articles and conveying said articles in a downstream direction as at least one metered group.

Optionally, each of the plurality of article engagement tools is driven independently about an endless track having a working reach and a return reach.

Optionally, the plurality of article engagement tools comprises at least one leading article engagement tool and at least one trailing article engagement tool.

Optionally, the at least one leading article engagement tool is configured to engage a respective leading registration edge of the at least one blank.

Optionally, the at least one trailing article engagement tool is configured to engage a respective trailing registration edge of the at least one blank.

Optionally, the abutment pin is shaped to provide at least two points of contact with a registration edge of the at least one blank to inhibit movement of the at least one blank parallel with the direction of flow of the at least one blank through the apparatus and laterally with respect to the direction of flow of the at least one blank through the apparatus.

Optionally, the apparatus comprises an applicator for pressing the at least one blank onto the at least one group of articles, the applicator comprises a plurality of article receiving orifices each for receiving a respective article of the at least one group of articles formed by the apparatus.

Optionally, the applicator comprises at least one stabilisation peg receivable in an opening of a stabilisation device provided in a main panel of the at least one blank, the at least one stabilisation peg being configured to constrain movement of the at least one blank with respect to the applicator.

Optionally, at least one stabilisation peg prevents or inhibits movement of the at least one blank with respect to the at least one group of articles in a direction parallel with the direction of flow of the at least one blank through the apparatus and in a lateral direction perpendicular with respect to the direction of flow of the at least one blank through the apparatus.

Optionally, the applicator is mounted to an overhead conveyor, in the form of a wheel, such that the applicator applies the at least one blank to the group of articles as it is conveyed downstream by the plurality of article engagement tools.

Optionally, the applicator comprises one or more folding brakes for folding at least one panel hinged to the main panel at least partially about the at least one group of articles, said panel comprising at least one registration edge configured to engage the reference device.

Optionally, the apparatus comprises one or more static folding guides for folding one or more panels of the at least one blank whilst the applicator is in engagement with the at least one blank.

A third aspect of the invention provides a method of packaging a plurality of articles, the method comprising:

conveying a stream of articles in a downstream direction through a packaging apparatus;

engaging each article with an article engagement tool;

grouping at least one group of articles, and simultaneously applying at least one blank to upper ends of the articles;

engaging at least one leading registration edge of the at least one blank with a reference pin mounted to a leading article engagement tool;

metering the at least one group of articles; and engaging a reference pin mounted to a trailing article engagement tool with at least one trailing registration edge of the at least one blank.

Optionally, the method further comprises;

applying the at least one blank to the at least one group of articles to engage each article in a respective article retention device provided in a main panel of the at least one blank.

Optionally, applying the at least one blank to the at least one group of articles comprises;

inserting a stabilising peg in an opening of a stabilisation device provided in a main panel of the at least one blank prior to pressing the main panel onto the at least one group of articles.

Optionally, applying the at least one blank to the at least one group of articles may further comprise:

folding, at least partially, one or more panels coupled to the main panel and comprising at least one of the leading and trailing registration edges.

Optionally, the one or more panels is folded prior to engaging the main panel with the at least one group of articles.

Optionally, the one or more panels is folded simultaneously with engaging the main panel with the at least one group of articles.

Optionally, the one or more panels is folded after engaging the main panel with the at least one group of articles.

A fourth aspect of the invention provides a blank for forming an article carrier. The blank comprises a main panel having at least one article retention structure for engaging an article. The blank comprises at least one panel having a peripheral edge. A portion of the peripheral edge provides at least one registration edge shaped to inhibit movement in two orthogonal directions when engaged by a reference device of a packaging apparatus.

A fifth aspect of the invention provides an applicator device for separating a plurality of connected blanks into discrete blanks and pressing each a blank onto two or more groups of articles, the applicator comprises a plurality of article receiving orifices each for receiving a respective article and a disconnecting device for breaking frangible connections between adjacently disposed blanks.

Optionally, the applicator comprises at least one stabilisation peg receivable in an opening of a stabilisation device provided in a main panel of each blank, the at least one stabilisation peg being configured to constrain movement of said blank with respect to the applicator.

Optionally, the at least one stabilisation peg is detachably mounted to a plate in which the article receiving orifices are provided.

Optionally, the at least one stabilisation peg is keyed to a given receiving location on the plate.

Optionally, the at least one stabilisation peg is keyed to a given receiving orientation with respect to the plate.

Optionally, the applicator comprises a plate and at least one guide depending therefrom for retaining the groups of articles in a predefined arrangement.

Optionally, the disconnecting device comprises one or more blades mounted to a plate in which the article receiving orifices are provided.

Optionally, the one or more blades is detachably mounted to the plate.

Optionally, the one or more blades comprises at least one detent for engaging a catch in a slot provided in the plate.

Optionally, the plate comprises one or more release openings for enabling release of the detent from the catch.

Optionally, the plate comprises plurality of blade receiving locations and a plurality of blades that can be reconfigured a desired arrangement to accommodate a given configuration of connected blanks.

A sixth aspect of the invention provides a disconnecting apparatus for separating a plurality of connected article carriers engaged with groups of articles, the disconnecting apparatus comprises a plate having a plurality of article receiving orifices each for receiving a respective article and a plurality of blade receiving locations each capable of detachably mounting a disconnecting blade for breaking frangible connections between adjacently disposed carriers, and a plurality of blades is detachably mounted to the plate, the plurality of blades being reconfigurable to a desired arrangement to accommodate a given configuration of connected carriers.

Optionally, the plurality of blades is mountable to the plate in first arrangement to separate a first configuration of connected carriers and is mountable to the plate in second, different, arrangement to separate a second, different, configuration of connected carriers.

A seventh aspect of the invention provides a plurality of connected blanks for forming a plurality of article carriers. Each blank is frangibly connected to at least one adjacent blank by a frangible connection comprising at least one pair of connecting nick. Each blank comprises an engaging panel having at least one article retention device for receiving and suspending an article therefrom. A first article retention device in a first blank and a second article retention device in a second blank define a notional line passing through the centre of each of the first and second article retention devices. The notional line is perpendicular to a frangible connection between the first and second blank. A pair of connecting nicks are disposed on opposing sides of the notional line. The notional line defines a region of closest proximity between the first and second article retention devices.

An eighth aspect of the invention provides an apparatus for packaging one or more articles in an article carrier. The apparatus comprises an article engagement tool for engaging an article and conveying the article in a downstream direction. The article engagement tool comprises a reference device for aligning a plurality of connected blanks with two or more groups of articles.

Optionally, the apparatus comprises an applicator for separating the plurality of connected blanks into discrete blanks and pressing each a blank onto the two or more groups of articles, the applicator comprises a plurality of article receiving orifices each for receiving a respective article and a disconnecting device for breaking frangible connections between adjacently disposed blanks.

Optionally, the applicator comprises at least one stabilisation peg receivable in an opening of a stabilisation device provided in a main panel of each blank, the at least one stabilisation peg being configured to constrain movement of said blanks with respect to the applicator.

Optionally, the at least one stabilisation peg prevents or inhibits movement of the blanks with respect to the group of articles in a direction parallel with the direction of flow of the blanks through the apparatus and in a lateral direction perpendicular with respect to the direction of flow of the blanks through the apparatus.

Optionally, the applicator is mounted to an overhead conveyor, in the form of a wheel, such that the applicator applies the blanks to the groups of articles as it is conveyed downstream by the plurality of article engagement tools.

Optionally, the apparatus comprises an overhead conveyor for conveying the plurality of connected blanks onto the one or more articles.

Optionally, the reference device comprises an abutment pin extending upwardly from the article engagement tool beyond the upper extremity of the one or more articles.

Optionally, the article engagement tool comprises a removable head to which the reference device is mounted.

Optionally, the apparatus comprises a plurality of article engagement tools each for engaging a respective article, metering and grouping the articles and conveying said articles in a downstream direction as metered groups.

Optionally, the plurality of article engagement tools comprises at least one leading article engagement tool and at least one trailing article engagement tool.

Optionally, the at least one leading article engagement tool is configured to engage a respective leading registration edge of the plurality of connected blanks.

Optionally, the at least one trailing article engagement tool is configured to engage a respective trailing registration edge of the plurality of connected blanks.

A ninth aspect of the invention provides a method of packaging a plurality of articles, the method comprising:

forming at least two groups of articles, applying a plurality of connected blanks to upper ends of the articles;

engaging reference pins with the plurality of connected blanks and aligning the plurality of connected blanks to the articles;

lowering an applicator with respect to the articles and the plurality of connected blanks so as to insert a stabilisation pin in an opening in each of the blanks;

further lowering the applicator to cleave through frangible connections between adjacently disposed blanks;

bringing a plate of the applicator into contact with each of the discrete blanks;

lowering the applicator further to press the discrete blanks over upper ends of the articles and displacing engaging tabs upwardly out of the plane of the blanks until the tabs engage a flange about the upper ends of the articles.

A tenth aspect of the invention provides a method of packaging a plurality of articles, the method comprising:

conveying a stream of articles in a downstream direction through a packaging apparatus;

engaging each article with an article engagement tool;

grouping a plurality of groups of articles, and simultaneously applying a plurality of connected blanks to upper ends of the articles;

engaging at least one leading registration edge of the blank with a reference pin mounted to a leading article engagement tool;

metering the groups of articles; and engaging a reference pin mounted to a trailing article engagement tool with at least one trailing registration edge of the plurality of connected blanks.

Optionally, the method further comprises;

separating the plurality of connected blanks into discrete blanks and applying said discrete blanks to the groups of articles to engage each article in a respective article retention device provided in a main panel of the blanks.

Optionally, applying the blanks to the groups of articles comprises;

inserting a stabilising peg in an opening of a stabilisation device provided in a main panel of each blank prior to separating the plurality of connected blanks into discrete blanks.

An eleventh aspect of the invention provides a plurality of connected blanks for forming a plurality of article carriers. Each blank is frangibly connected to at least one adjacent blank by a frangible connection. Each blank of the plurality of connected blanks comprises a main panel having at least one article retention structure for engaging an article. The plurality of connected blanks comprises at least one panel having a peripheral edge. A portion of the peripheral edge provides at least one registration edge shaped to inhibit movement in two orthogonal directions when engaged by a reference device of a packaging apparatus.

A twelfth aspect of the invention provides a separator apparatus for separating a plurality of connected article carriers into discrete article carriers. The separator comprises a disconnecting device for breaking frangible connections between adjacently disposed article carriers.

Optionally, the separator comprises at least one stabilisation peg receivable in an opening of a stabilisation device provided in a main panel of each article carrier, the at least one stabilisation peg being configured to constrain movement of said article carrier with respect to the separator.

Optionally, the separator comprises at least one guide for aligning the plurality of connected article carriers therewith.

Optionally, the separator comprises a pair of opposed guides for aligning the plurality of connected article carriers therewith, the plurality of connected article carriers being receivable between the pair of opposed guides.

Optionally, the separator is mounted to an overhead conveyor and is transferred continuously downstream through a working reach of a packaging machine in synchronicity with the article carriers.

Further features and advantages of the present invention will be apparent from the specific embodiments illustrated in the drawings and discussed below.

Within the scope of this application, it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the packaging system, apparatus, methods package, blanks, and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packaging system, apparatus, methods, packages, blanks, and carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
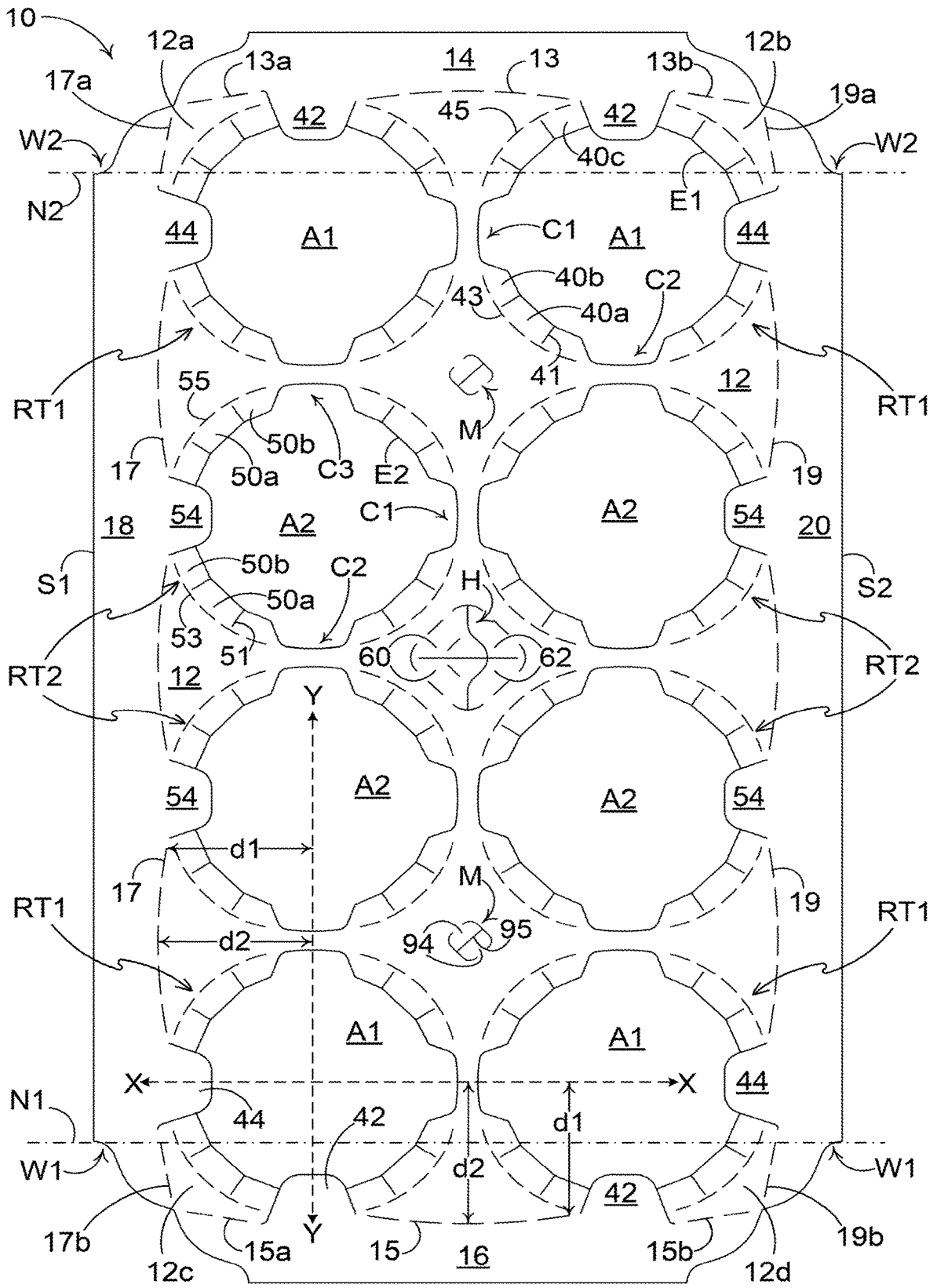
FIG. 1 is a plan view from above of a blank for forming a carrier according to embodiments of the present disclosure.
Figure 2:
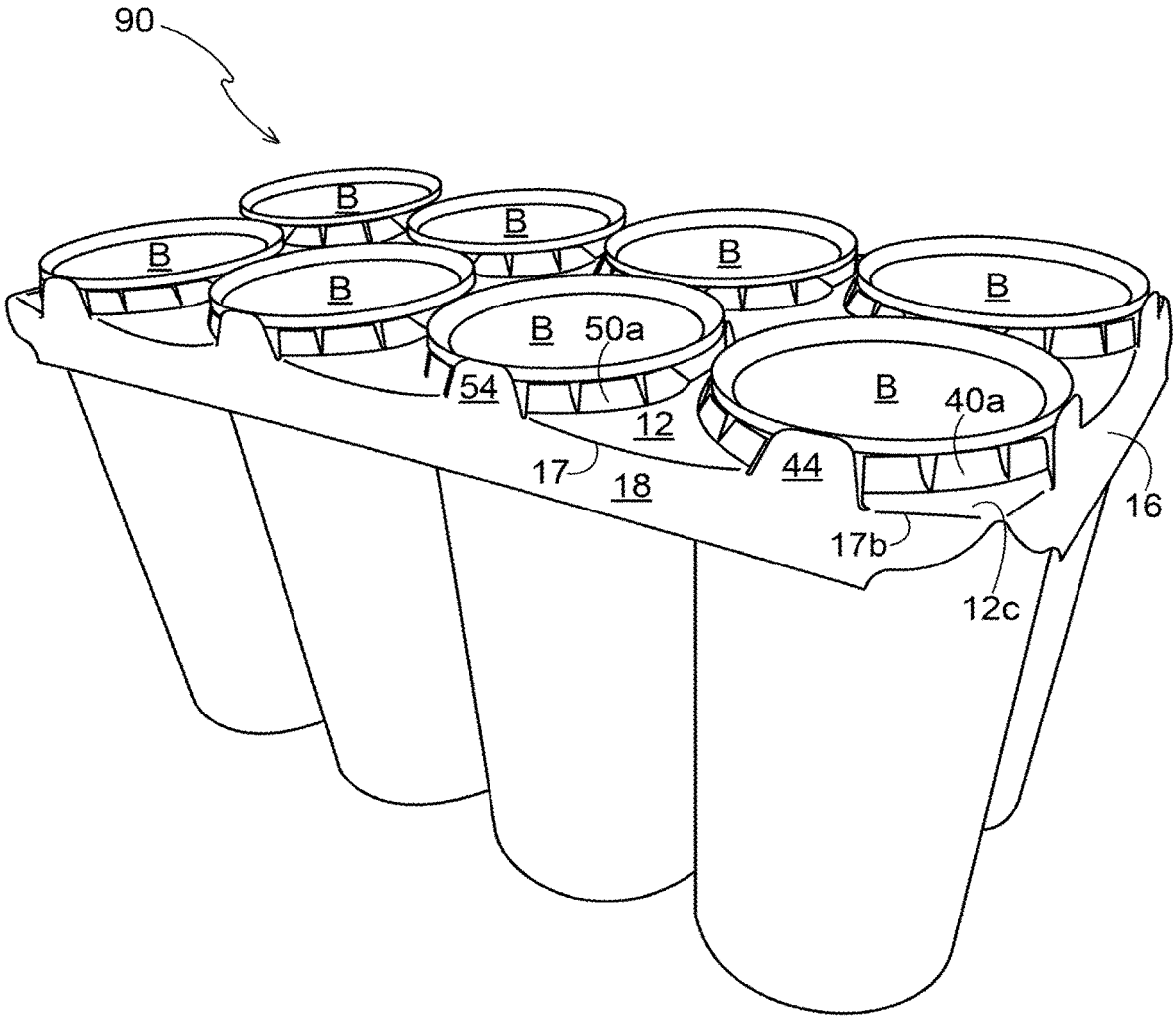
FIG. 2 is a perspective view from above of a carrier formed from the blank of FIG. 1.

Referring to FIG. 1, there is shown a plan view of a blank 10 which is capable of forming a carton or carrier 90, as shown in FIG. 2, for containing and carrying a group of primary products such as, but not limited to, bottles or cans, hereinafter referred to as articles B, as shown in FIG. 2. The articles B may be generally cylindrical; the articles B may comprise a circular cross-sectional shape, at least about a region of engagement with the carrier 90. The blank 10 forms a secondary package for packaging at least one primary product container or package. Alternative blanks 110; 310; 410A-B are shown in FIGS. 3 to 6 and FIGS. 13 to 17 for forming an alternative cartons or carriers 190; 390; 490.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10; 110; 310; 410A-B are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the embodiments illustrated in FIGS. 1 to 12, the blanks 10; 110; 310 are configured to form a carton or carrier 90; 190; 390; for packaging an exemplary arrangement of exemplary articles B. In the illustrated embodiments, the arrangement is a 2×4 matrix or array-two rows of four articles B are provided—and the articles B are beverage cans. Alternatively, the blanks 10; 110; 310 can be configured to form a carrier for packaging other types, number and size of articles and/or for packaging articles in a different arrangement or configuration.

The embodiments illustrated in FIGS. 1 to 6 the blanks 10; 110; 310 are configured to accommodate beverage cans of the sleek or slim design that may be 330 ml cans. The articles B are substantially of the same diameter over their entire height. An exemplary article B has a maximum diameter or lateral dimension (the diameter may be about 2.25 inches or about 58 mm). The article B comprises an upper portion or top closure which has a diameter or lateral dimension (the diameter may be about 2.125 inches or 54.8 mm).

The neck may provide an outwardly projecting flange, that is to say it may comprise an undercut for engaging with the carrier. A top closure may be attached to the side wall of the article B to form a seam or "chime" which provides the flange. In some embodiments the variation in diameter between the top closure and the main body of the article B is less than 7 mm, may be less than 5 mm and optionally is less than 4 mm.

As used herein the terms "sleek" or "slim" refer to articles B which have little or no variation in their lateral dimension between the top closure which engages with the carrier 90; 190; 390 and the main body of the article B. The articles B are substantially parallel sided or of substantially uniform diameter.

Referring to FIG. 1 there is shown a blank 10 comprising a plurality of panels 12, 14, 16, 18, 20, including a main panel 12 for forming a top wall or an engaging panel of a carrier 90 (see FIG. 2).

The blank 10 includes a first end panel 14 hingedly connected to a first end of the main panel 12 by a hinged connection in the form of a fold line 13. The blank 10 includes a second end panel 16 hingedly connected to a second side of the main panel 12 by a hinged connection in the form of a fold line 15.

The blank 10 includes a first side panel 18 hingedly connected to a first side of the main panel 12 by a hinged connection in the form of a fold line 17. The blank 10 includes a second side panel 20 hingedly connected to a second side of the main panel 12 by a hinged connection in the form of a fold line 19.

The main panel 12 includes at least one article retention structure RT1, RT2. In the illustrated embodiment, the main panel 12 comprises a plurality of article retention structures RT1, RT2 specifically eight article retention structures RT1, RT2 arranged in 4×2 matrix or array. The main panel 12 comprises two columns of article retention structures RT1, RT2, each column comprises four article retention structures RT1, RT2. The main panel 12 comprises four rows of article retention structures RT1, RT2, each row comprises two article retention structures RT1, RT2. Each of the article retention structures RT1, RT2 may comprise an aperture A1, A2.

The blank 10 comprises four first article retention structures RT1. The first article retention structures RT1 are located adjacent to ends of the main panel 12. The blank 10 comprises four second article retention structures RT2. The second article retention structures RT2 are located between a first pair of first article retention structures RT1 disposed proximate a first end of the main panel 12 and a second pair of first article retention structures RT1 disposed proximate a second end of the main panel 12. The second article retention structures RT2 are also referred to herein as intermediate article retention structures RT2. The first article retention structures RT1 are also referred to herein as end article retention structures RT1.

Each of the first article retention structures RT1 is substantially similar in construction and will therefore be described in detail with reference to a first one of the first article retention structures RT1 located adjacent to a first end of the blank 10 as shown in FIG. 1.

The first article retention structure RT1 comprises an article receiving opening defined in part by an aperture A1.

The first article retention structure RT1 comprises a plurality of engaging teeth 40*a*, 40*b*, 40*c* disposed about the aperture A1.

The plurality of teeth 40*a*, 40*b*, 40*c* are hinged to the main panel 12 by a fold line. The fold line may be defined by a plurality of cut lines 43, 45. The plurality of cut lines 43, 45 may define or approximate a squircle or rounded square.

The first article retention structure RT1 may comprise a plurality of first or full teeth 40*a* disposed about the aperture A1. Each of the plurality of first teeth 40*a* comprises an engaging edge E1 opposing a hinged edge. The engaging edges E1 are defined by a linear portion of a cut line defining the aperture A1. Each engaging edge E1 defines a part of a polygon. The illustrated embodiment comprises four first teeth 40*a*. Each tooth 46 comprises a pair of side edges, the side edges are defined by cut lines 41 extending radially outward from respective vertices of the polygon. That is to say from a respective vertex between a pair of adjacent linear portions of the cut line defining the aperture A1. The cut lines 41 are divergently arranged with respect to each other and define an angle therebetween, the angle may be about 22.5°.

The first article retention structure RT1 may comprise a plurality of first circumferential cut lines 43. Each of the plurality of first circumferential cut lines 43 is aligned with one of the radial cut lines 41 such that said one of the radial cut lines 41 or a notional extension thereof bisects a respective one of the plurality of first circumferential cut lines 43.

Each of the plurality of first circumferential cut lines 43 is spaced apart from said one of the radial cut lines 41 bisecting it so as to define a connecting nick or bridge portion between a pair of adjacently disposed teeth 40*a*, 40*b*, 40*c*. Each of the plurality of first circumferential cut lines 43 may be linear in shape.

The first article retention structure RT1 may comprise a plurality of second circumferential cut lines 45. Each of the plurality of second circumferential cut lines 45 is disposed between a pair of the plurality of first circumferential cut lines 43 and is spaced apart therefrom so as to define a pair of connecting nick or bridge portions between each tooth 40*a*, 40*b*, 40*c* and the main panel 12. The pair of connecting nick or bridge portions provide a hinged or foldable connection between each tooth 40*a*, 40*b*, 40*c* and the main panel 12.

Each of the plurality of second circumferential cut lines 45 may be linear in shape. In alternative embodiments, each of the plurality of first circumferential cut lines 43 may be arcuate or curved. In alternative embodiments, each of the plurality of second circumferential cut lines 45 may be arcuate or curved.

In the illustrated embodiment, the radius of curvature of each of the plurality of second circumferential cut lines 45 is equal to the radius of curvature of each of the plurality of first circumferential cut lines 43 however in other embodiments it may be different.

Optionally, the plurality of teeth 40*a*, 40*b*, 40*c* is interrupted by a first recess or cutaway C1. The first recess C1 lies upon a first notional line. First notional line extends radially through the centre of the aperture A1 and passes through the centre of the first recess C1. The first notional line extends transversely of the blank 10. The first notional line may extend along the grain of the blank 10. The first notional line may be oriented parallel with respect to the grain direction.

Optionally, the plurality of teeth 40*a*, 40*b*, 40*c* is interrupted by a second recess or cutaway C2. The second recess C2 lies upon a second notional line. Second notional line extends radially from the centre of the aperture A1 and passes through the centre of the second recess C2. The second notional line extends longitudinally of the blank 10. The second notional line may extend across the grain of the blank 10. The second notional line may be oriented perpendicularly with respect to the grain direction.

The first recess C1 is dimensioned so as to occupy a first arc defined by a first minor sector. The first minor sector is defined in part by a first sector notional line extending radially from the centre of the aperture A1 and passing through a side edge of a first partial tooth 40*b* disposed adjacent a first side of the first recess C1 and in part by a second sector notional line extending radially from the centre of the aperture A1 and passing through a side edge of a second partial tooth 40*b* disposed adjacent a second, opposing, side of the first recess C1.

The second recess C2 is dimensioned so as to occupy a second arc defined by a second minor sector. The second minor sector is defined in part by a third sector notional line extending radially from the centre of the aperture A1 and passing through a side edge of a third partial tooth 40*b* disposed adjacent a first side of the second recess C2 and in part by a fourth sector notional line extending radially from the centre of the aperture A1 and passing through a side edge of a fourth partial tooth 40*b* disposed adjacent a second, opposing, side of the second recess C2.

The first and third sector notional lines define a first toothed sector or arc therebetween. The second and fourth sector notional lines define a second toothed sector or arc therebetween.

The first article retention structure RT1 may comprise at least one tab 42, 44. The illustrated embodiment comprises a pair of tabs 42, 44. The tabs 42, 44 are located orthogonally to each other about the perimeter of the opening. The tabs 42, 44 may engage an article received in first article retention structure RT1, the tabs 42, 44 do not support or bear the load (or part thereof) of the article B.

The tabs 42, 44 facilitate folding of the side and end panels 14, 16, 18, 20 and/or retention of the side and end panels 14, 16, 18, 20 in a folded condition.

Each of the first article retention structures RT1 may comprise at least one first tab 42 integral with one of the first and second end panels 14, 16. The first tab 42 is disposed opposite the second recess C2. A centre of first tab 42 lies upon the second notional line.

Each of the first article retention structures RT1 may comprise at least one second tab 44 integral with one of the first and second side panels 18, 20. The second tab 44 is disposed opposite the first recess C1. A centre of second tab 44 lies upon the first notional line.

The first and second tabs 42, 44 are defined, at least in part, by a cut line. The cut line is substantially 'U' shaped. The cut line is asymmetric. The cut line comprises a base portion defining a portion of the aperture A1 and a pair of leg portions extending therefrom. A first one of the leg portions is longer than a second one of the leg portions. The first leg portion may terminate in a 'J' or 'C' shaped cut. The first leg portion is disposed in closer proximity to a corner of the main panel 12 than the second leg portion.

The first article retention structures RT1 may comprise second partial teeth 40*c* disposed upon opposing sides of each of the first and second tabs 42, 44. The second partial teeth 40*c* are separated from one of the first or second tabs 42, 44 by one of the first or second leg portions of the 'U' shaped cut line.

The first and second tabs 42, 44 are longer or taller in height than the engaging teeth 40*a*, 40*b*, 40*c*. The first and second tabs 42, 44 can be considered to extend into the aperture A1 so as to reduce the width or radius of the aperture A1.

The plurality of first and second circumferential cut lines 43, 45 define an opening having non-circular shape. The opening may be a squircle or truncated circle.

The full teeth 40*a* may have a radial height dimension which is constant over an arc or sector which they define. The hinged connection of each full tooth 40*a* may define a portion of a circle or may define a portion of a squircle.

The partial teeth 40*b*, 40*c* may have a radial height dimension that varies across their width. The height of the partial teeth 40*b*, 40*c*, the distance between the hinged connection to the main panel 12 and the opposing free edge defined by the aperture A1 may reduce as towards a recess C1, C2 or tabs 42, 44.

The first article retention structures RT1 may comprise discrete groups of teeth 40*a*, 40*b*, 40*c*, defined between a pair of recess C1, C2, between a pair of tabs 42, 44 or between one of the recesses C1, C2 and one of the tabs 42, 44. Each group of teeth 40*a*, 40*b*, 40*c* may comprise one full tooth 40*a* and a pair of partial teeth 40*b*, 40*c*. A partial tooth 40*b*, 40*c* may be disposed on opposite sides of the full tooth 40*a* and separated therefrom by a radial cut line 41. The first article retention structures RT1 may comprise at least one, two or more discrete groups of at least two, three, or more teeth 40*a*, 40*b*, 40*c*.

Each group of teeth 40*a*, 40*b*, 40*c* is hinged to the main panel 12 by a hinged connection the hinged connection is non-circular in shape, and may be defined by a portion of a squircle, truncated circle, flattened circle or rounded square. The shape may be or approximate a superellipse or hyperellipse.

Each of the second article retention structures RT2 is substantially similar in construction and will therefore be described in detail with reference to a first one of the second article retention structures RT2 located adjacent to the first one of the first article retention structures RT1 as shown in FIG. 1.

The second article retention structure RT2 comprises an article receiving opening defined in part by a second aperture A2.

The second article retention structure RT2 comprises a plurality of teeth 50*a*, 50*b*, 50*c* disposed about the second aperture A2.

The plurality of teeth 50*a*, 50*b*, 50*c* are hinged to the main panel 12 by a fold line. The fold line may be defined by a plurality of cut lines 53, 55. The plurality of cut lines 53, 55 may define or approximate a squircle.

The second aperture A2 may comprise a plurality of first or full teeth 50*a* disposed about the second aperture A2. Each of the plurality of first teeth 50*a* comprises an engaging edge E2 opposing a hinged edge. The engaging edges E2 are defined by a linear portion of a cut line defining the second aperture A2. Each engaging edge E2 defines a part or side of a polygon. The illustrated embodiment comprises four first teeth 50*a* together defining a portion of a polygon. Each tooth 50*a* comprises a pair of side edges, the side edges are defined by cut lines 51 extending radially outward from respective vertices of the polygon. That is to say from a respective vertex between a pair of adjacent linear portions of the cut line defining the second aperture A2. The cut lines 51 are divergently arranged with respect to each other and define an angle therebetween, the angle may be about 22.5°.

The second article retention structure RT2 may comprise a plurality of first circumferential cut lines 53. Each of the plurality of first circumferential cut lines 53 is aligned with one of the radial cut lines 51 such that said one of the radial cut lines 41, or a notional extension thereof, bisects a respective one of the plurality of first circumferential cut lines 53.

Each of the plurality of first circumferential cut lines 53 is spaced apart from said one of the radial cut lines 41 bisecting it so as to define a connecting nick or bridge portion between a pair of adjacently disposed teeth 50*a*, 50*b*, 50*c*. The connecting nick or bridge portion is disposed proximate a base of the teeth 50*a*, 50*b*, 50*c*.

Each of the plurality of first circumferential cut lines 53 may be linear in shape.

The second article retention structure RT2 may comprise a plurality of second circumferential cut lines 55. Each of the plurality of second circumferential cut lines 55 is disposed between a pair of the plurality of first circumferential cut lines 53 and is spaced apart therefrom so as to define a pair of connecting nick or bridge portions between each tooth 50*a*, 50*b*, 50*c* and the main panel 12. The pair of connecting nick or bridge portions provide a hinged or foldable connection between each tooth 50*a*, 50*b*, 50*c* and the main panel 12.

Each of the plurality of second circumferential cut lines 55 may be linear in shape.

The plurality of teeth 50*a*, 50*b*, 50*c* is interrupted by a first recess or cutaway C1, by a second recess or cutaway C2 and by a third recess or cutaway C3. The second and third recesses C2, C3 each lie upon the second notional line extending longitudinally of the blank 10. The second notional line extends radially from the centre of the second aperture A2 and passes through the centre of each of the second and third recesses C2, C3.

The first and second recesses C1, C2 are substantially similar in construction and arrangement to the first and second recesses C1, C2 of the first article retention structures RT1. The third recess is substantially similar in construction and arrangement to the second recess C1, C2 albeit in opposition thereto.

The second and third recesses C2, C3 are diametrically opposed to each other.

The first recess C1 is oriented or disposed substantially orthogonally to the second and third recesses C2, C3.

The centres of the second and third recesses C2, C3 of the second article retention structure RT2 are collinear with the centre of the second recess C2 of the first article retention structure RT1.

The third recess C3 of the second article retention structure RT2 is disposed proximate to the second recess C2 of the first article retention structure RT1 and is oriented in opposition thereto.

Each of the first recesses C1 of the second article retention structures RT2 is disposed proximate to a first recess C1 of an adjacently disposed second article retention structures RT2, and is oriented in opposition thereto.

Each of the first recesses C1 of the first article retention structures RT1 is disposed proximate to a first recess C1 of an adjacently disposed first article retention structures RT1, and is oriented in opposition thereto.

The second article retention structure RT2 may comprise at least one tab 54. The illustrated embodiment comprises a single tab 54. The tab 54 may engage an article received in second article retention structure RT2, the tab 54 does not support or bear the load (or part thereof) of the article B.

The tab 54 facilitates folding of one of the side panels 18, 20 and/or retention of the side panels 18, 20 in a folded condition.

Each of the second article retention structure RT2 comprises at tab 54 integral with one of the first and second side panels 18, 20. The tab 54 is disposed opposite the first recess C1. A centre of tab 54 lies upon the first notional line.

The tabs 54 are defined, at least in part, by a cut line. The cut line is substantially 'U' shaped. The cut line is symmetric. The cut line comprises a base portion defining a portion of the aperture A2 and a pair of leg portions extending therefrom. A first one of the leg portions is equal in length to a second one of the leg portions.

The second article retention structure RT2 may comprise second partial teeth 50*c* disposed upon opposing sides of the tab 54. The second partial teeth 50*c* are separated from the tab 54 by one of the first or second leg portions of the 'U' shaped cut line.

The tab 54 is longer or taller in height than the engaging teeth 50*a*, 50*b*, 50*c*. The tab 54 can be considered to extend into the aperture A2 so as to reduce the width or radius of the aperture A2.

The plurality of first and second circumferential cut lines 53, 55 define an opening having non-circular shape. The opening may be a squircle or truncated circle.

The full teeth 50*a* may have a radial height dimension which is constant over an arc or sector which they define. The hinged connection of each full tooth 50*a* may define a portion of a circle.

The partial teeth 50*b*, 50*c* may have a radial height dimension that varies across their width. The height of the partial teeth 50*b*, 50*c*, the distance between the hinged connection to the main panel 12 and the opposing free edge defined by the aperture A2 may reduce as towards a recess C1, C2, C3 or tab 54.

The second article retention structures RT2 may comprise discrete groups of teeth 50*a*, 50*b*, 50*c*, defined between a pair of recess C1, C2, C3 or between one of the recesses C1, C2, C3 and the tab 44. Each group of teeth 50*a*, 50*b*, 50*c* may comprise one full tooth 50*a* and a pair of partial teeth 50*b*, 50*c*. A partial tooth 50*b*, 50*c* may be disposed on opposite sides of the full tooth 50*a* and separated therefrom by a radial cut line 51. The second article retention structures RT2 may comprise at least one, two or more discrete groups of at least two, three, or more teeth 50*a*, 50*b*, 50*c*.

Each group of teeth 50*a*, 50*b*, 50*c* is hinged to the main panel 12 by a hinged connection the hinged connection is non-circular in shape, and may be defined by a portion of a squircle, truncated circle, flattened circle or rounded square. The shape may be or approximate a superellipse or hyperellipse.

The fold line 13 hinging the first end panel 14 to the main panel 12 is non-linear and may be curvilinear or arcuate. The fold line 13 hinging the first end panel 14 to the main panel 12 extends substantially between a pair of adjacently disposed first article retention structures RT1. The fold line 13 defines a convex hinged portion when viewed from an external viewpoint.

The fold line 15 hinging the second end panel 16 to the main panel 12 is non-linear and may be curvilinear or arcuate. The fold line 15 hinging the second end panel 16 to the main panel 12 extends substantially between a pair of adjacently disposed first article retention structures RT1. The fold line 15 defines a convex hinged portion when viewed from an external viewpoint.

The fold line 17 hinging the first side panel 18 to the main panel 12 is non-linear and may be curvilinear or arcuate. The fold line 17 hinging the first side panel 18 to the main panel 12 comprises plurality of curvilinear portions extending substantially between pairs of adjacently disposed article retention structures RT1, RT2. The fold line 17 defines a plurality of convex hinged portions when viewed from an external viewpoint.

The fold line 19 hinging the second side panel 20 to the main panel 12 is non-linear and may be curvilinear or arcuate. The fold line 19 hinging the second side panel 20 to the main panel 12 comprises plurality of curvilinear portions extending substantially between pairs of adjacently disposed article retention structures RT1, RT2. The fold line 19 defines a plurality of convex hinged portions when viewed from an external viewpoint.

Each curvilinear hinged portion extends substantially between a pair of tabs 42, 44.

Each curved fold line 13, 15, 17, 19 curves towards and terminates at, or in close proximity to, a curvilinear hinged connection between a group of teeth 40*a*, 40*b*, 40*c*; 50*a*, 50*b*, 50*c*.

Each curved fold line 13, 15, 17, 19 and/or curvilinear hinged connection between a group of teeth 40*a*, 40*b*, 40*c*; 50*a*, 50*b*, 50*c* terminates at, or in close proximity to, an end of a cut line defining a tab 42, 44.

In the embodiment illustrated in FIG. 1, the fold lines 13, 15, 17, 19 are defined by a plurality of spaced apart cut lines. The curvilinear hinged connection between groups of teeth 40*a*, 40*b*, 40*c*; 50*a*, 50*b*, 50*c* and the main panel 12 is defined by a plurality of spaced apart circumferential cut lines 43, 45, 53, 55. A notional extension of the endmost or terminal cutline defining the fold lines 13, 15, 17, 19 intersects or converges with a notional extension of the endmost or terminal cutline defining the curvilinear hinged connection between groups of teeth 40*a*, 40*b*, 40*c*; 50*a*, 50*b*, 50*c* and the main panel 12; in the illustrated embodiment, this is provided by one of the second circumferential cutlines 45, 55.

Each curved fold line 13, 15, 17, 19 converges with a respective curvilinear hinged connection between a group of teeth 40*a*, 40*b*, 40*c*; 50*a*, 50*b*, 50*c* at, or in close proximity to, a tab 42, 44, and may converge at an end of a cut line defining said tab 42, 44.

This may provide the benefit of directing load forces or stresses onto the side wall of the article B so as to increase the structural integrity or rigidity of the carrier 90; and may be particularly advantageous for impact forces directed at ends or sides of the carrier 90.

The curved fold lines 13, 15, 17, 19 may create tension, or a bias, in the side or end walls 14, 16, 18, 20. This may increase the side or end walls 14, 16, 18, 20 resistance to impacts.

The curved fold lines 13, 15, 17, 19 may create tension or a bias in the side or end walls 14, 16, 18, 20 which may have the effect of creating an over-centre or toggle mechanism creating bi-stability-two stable states or positions, a folded stable position and an unfolded stable position. This may facilitate retention of the side or end walls 14, 16, 18, 20 in a folded condition relative to the main panel 12 either in addition to or alternative to the tabs 42, 44. In this way the requirement of adhesive or other such fastening means may be negated.

Fold lines 13, 15, 17, 19 are non-linear such that at least one end portion thereof is curved toward an adjacent annular fold line about one of the article retention structures RT1, RT2 where the annular fold line is defined by the plurality of circumferential cut lines 43, 45, 53, 55.

Fold lines 13, 15, 17, 19 are non-linear such that at least one end portion thereof is curved toward an adjacent engaging tooth 40*c*.

Fold lines 13, 15, 17, 19 are non-linear such that at least one end portion thereof is curved toward the adjacent article receiving opening or aperture A1, A2.

Fold lines 17, 19 are curved such a first distance d1 between a terminal end of the fold lines 17, 19 and a second notional line Y-Y oriented longitudinally of the blank 10 and passing through the centres of receiving apertures A1, A2 is less than a second distance d2 where second distance d2 is the maximum distance between the line Y-Y and the respective fold line 17, 19. It will be appreciated that the fold lines 13, 15 are similarly arranged with respect to a first notional line X-X oriented transversely of the blank 10 and passing through the centres of receiving apertures A1.

The first end panel 14 is hingedly connected to the main panel 12 at first and second ends by first and second sections of the hinged connection in the form of a pair of fold lines 13*a*, 13*b*. The pair of fold lines 13*a*, 13*b* are divergently arranged with respect to each other.

The first side panel 18 is hingedly connected to the main panel 12 at first and second ends by first and second sections of the hinged connection in the form of a pair of fold lines 17*a*, 17*b*. The pair of fold lines 17*a*, 17*b* are divergently arranged with respect to each other.

The first end of the first end panel 14 and the first end of the first side panel 18 are hinged about a first corner 12*a* of the main panel 12. The first section 13*a* of the fold line 13 and the first section 17*a* of the fold line 17 are convergently arranged with respect to each other and may be obliquely arranged. The first section 13*a* of the fold line 13 and the first section 17*a* of the fold line 17 define, at least in part, a substantially triangular corner portion of the main panel 12 adjacent to a first article retention structure RT1.

The second end panel 16 is hingedly connected to the main panel 12 at first and second ends by first and second sections of the hinged connection in the form of a pair of fold lines 15*a*, 15*b*. The pair of fold lines 15*a*, 15*b* are divergently arranged with respect to each other.

The second side panel 20 is hingedly connected to the main panel 12 at first and second ends by first and second sections of the hinged connection in the form of a pair of fold lines 19*a*, 19*b*. The pair of fold lines 97*a*, 19*b* are divergently arranged with respect to each other.

The main panel 12 comprises four corner regions 12*a*, 12*b*, 12*c*, 12*d*, each is defined, at least in part, by obliquely arranged fold line sections 13*a*, 17*a*; 13*b*, 19*a*; 15*a*, 17*b*; 15*b*, 19*b*.

The blank 10 may comprise a handle structure H.

The handle structure H comprises a handle or finger opening disposed on a longitudinal axis bisecting the main panel 12.

The handle opening is provided between a group of four article retention structures RT1, RT2. The group of four article retention structures RT1, RT2 is provided medially of the main panel 12. The handle opening is disposed between a second row of intermediate article retention structures RT2 and a third row of intermediate article retention structures RT2. The handle opening is located at the centre of the second group of four article retention structures RT2.

The handle opening lies, at least in part, between a first column of article retention structures RT1, RT2 and a second column of article retention structures RT1, RT2.

The handle opening is defined by a plurality of tabs 60, 62. The handle opening comprises four tabs 60, 62. Each tab 60, 62 is hinged to the main panel 12 by a hinged connection in the form of a fold line. An arcuate or curvilinear cut line may be provided between each fold line to define a corner or vertex of the handle opening. The handle opening is substantially rhombus or diamond shaped, in other embodiments other shapes may be employed such as, but not limited to square. The handle opening comprises a pair of major tabs 60 and a pair of minor tabs 62.

The pair of major tabs 60 are separated from each other by a first cut line or severable line. The pair of minor tabs 62 are separated from each other by the first cut line or severable line.

The pair of major tabs 60 are separated from the pair of minor tabs 62 by a second cut line or severable line.

The first cut line is colinear with a notional line passing transversely though the centre of the group of four intermediate article retention structures RT2.

The first cut line may be linear in shape and may extend between a first pair of opposed vertices of the handle opening.

The second cut line may be non-linear in shape and may extend between a second pair of opposed vertices of the handle opening. The second cut line intersects the first cutline, the second cut line comprises a "V" or "U" shaped medial portion; a vertex of the "V" or "U" shaped portion intersects the first cutline.

One of the pair of major tabs 60 is hinged to the main panel 12 by a first fold line. The other one of the pair of major tabs 60 is hinged to the main panel 12 by a second fold line. The first fold line is divergently arranged with respect to the second fold line.

One of the pair of minor tabs 62 is hinged to the main panel 12 by a third fold line. The other one of the pair of minor tabs 62 is hinged to the main panel 12 by a fourth fold line. The third fold line is divergently arranged with respect to the fourth fold line.

The first fold line is divergently arranged with respect to the third fold line. The second fold line is divergently arranged with respect to the fourth fold line.

Each of the pair of major tabs 60 may comprise a fold line extending thereacross. The fold line may be substantially parallel to the fold line hinging the respective one of the pair of major tabs 60 to the main panel 12. The fold line may extend between the first cut line or severable line and the second cut line or severable line. The fold lines across the pair of major tabs 60 may define a "V" shaped fold arranged in opposition to the V" or "U" shaped medial portion of the second cut line.

The blank 10 may comprise one, two or more alignment or registration devices W1, W2. Each of the registration devices W1, W2 takes the form of a cutaway or recess defining a registration edge of the blank 10 for receiving or engaging a reference pin (discussed in greater detail below). The blank 10 comprises a pair of first registration devices W1 each defining a downstream or leading registration edge. The blank 10 may also comprise a pair of registration devices W2 each defining an upstream or trailing registration edge. Each of the cutaways or recesses defining a registration devices W1, W2 is struck from one of the first and second side panels 18, 20.

The registration devices W1, W2 are disposed so as to be offset—inset—from end edges of the main panel 12. The end edges of the main panel 12 are defined by fold lines 13, 13*a*, 13*b*, 15, 15*a*, 15*b*. Insetting the registration devices W1, W2 is advantageous since it allows the tools carrying the reference pin to be more compact, the tools do not extend beyond the footprint of the group of articles in upstream or downstream directions. A notional line N1 passing through the registration edges of the pair of first registration devices W1 passes through the opening and/or aperture A1 of a first pair of first article retention structures RT1. A notional line N2 passing through the registration edges of the pair of second registration devices W2 passes through the opening and/or aperture A1 of a second pair of first article retention structures RT1.

The blank 10 may comprise at least one stabilisation device M. In the illustrated embodiment, the blank 10 comprises two stabilisation devices M. The stabilization device takes the form of an opening struck from the blank 10. A first stabilisation device M is disposed between first group of four article retention structures RT1, RT2 located proximate a first or leading end edge of the blank 10 and may be disposed centrally between said group of article retention structures RT1, RT2. A second stabilisation device M is disposed between a second group of four article retention structures RT1, RT2 located proximate a second or trailing end edge of the blank 10 and may be disposed centrally between said group of article retention structures RT1, RT2. The stabilisation devices M are configured to receive an abutment peg or dog (described in further detail below).

The opening of the stabilisation devices M may be non-circular in shape, and may be substantially square or diamond shaped. The opening may be defined by at least one tab 94 struck from the main panel 12 and hingedly connected thereto. In the illustrated embodiment, the opening is defined by a pair of tabs each struck from the main panel 12 and hingedly connected to the main panel 12 in opposition to each other. The pair of tabs 94 may be separated from each other by a cut or severable line 95.

In some embodiments, the stabilisation devices M may be arranged to provide an additional handle opening. In the embodiment of FIG. 1, the stabilisation devices M are generally too small in dimension to accept a finger or portion of a user's finger. This may be advantageous in that a greater amount of substrate material is provided in the main panel 12 between the stabilisation devices M and the openings of article retention structures RT1, RT2, whereby improving the robustness and integrity of the article carrier 90.

In other embodiments, the handle opening may be configured for use as a stabilization device. A peg or dog may be provided for engaging the blank 10 via the handle opening to prevent or inhibit linear or rotation movement of the blank 10 with respect to the dog. The dog may be mounted to, or integral with, an applicator device, described in more detail below, for applying the blank 10 to a group of articles B.

The opening of the stabilization device or handle opening may comprise at least one flat or linear portion for engaging a complementary flat or linear portion of the dog. In other embodiments, the stabilization device or handle opening may comprise at least one generally "V" or "U" shaped portion for engaging a complementary portion of the dog.

The blank 10 is assembled about a group of articles B. The main panel 12 of the blank 10 is applied to the group of articles B. The main panel 12 is lowered with respect to the articles B. Each of the retention structures RT1, RT2 receives one of the articles B.

The blank 10 is folded, about fold lines 13, 15, 17, 19, about the sides and ends of the article group to bring the side and end panels into face-to-face relationship therewith.

The tabs 42, 44 are folded about side walls of a respective article B. The tabs 42, 44 remain substantially coplanar with the side or end panel 14, 16, 18, 20 from which they extend. An inner face of the tabs 43, 44 abut a side wall, rim or chime of the articles B.

FIG. 2 shows the assembled carrier 90, the tabs 42, 44 abut side walls of the articles B encouraging the side and end panels 14, 16, 18, 20 into a folded condition.

The corner regions 12*a*, 12*b*, 12*c*, 12*d* of the main panel 12 adopt a non-coplanar arrangement with the main panel 12. The corner regions 12*a*, 12*b*, 12*c*, 12*d* are inclined upwardly as they extend outwardly due to the convergent nature of the fold line pairs 13*a*/17*a*; 13*b*/19*a*; 15*a*/17*b*; 15*b*/19*b*. This may be beneficial to impart additional strength or rigidity to the carrier 90 and reduce the likelihood of deformation when the carrier 90 is wrapped in a sheet or film of material such as, but not limited to heat or shrink wrap.

In the assembled carrier 90, each of the curved fold lines 13, 15, 17, 19 couples or joins with the curvilinear hinged connection between an adjacent group of teeth 40*a*, 40*b*, 40*c*; 50*a*, 50*b*, 50*c* and the main panel 12. The curved fold lines 13, 15, 17, 19 and curvilinear hinged connection may define or form convergent folds or creases in the substrate forming the carrier 90. In other embodiments each of the curved fold lines 13, 15, 17, 19 may be coupled or joined to an adjacent curvilinear hinged connection by a third fold or crease. The curved fold lines 13, 15, 17, 19 and curvilinear hinged connection meet or join in a location disposed in close proximity to an article B.

In some embodiments, the curved fold lines 13, 15, 17, 19 have the effect of encouraging the side and/or end walls 14, 16, 18, 20 to bow outwardly—to be convex when viewed from an external vantage point—in regions between a pair of adjacent articles B.

In some embodiments, the curved fold lines 13, 15, 17, 19 have the effect of encouraging the main panel 12 to bow downwardly—to be concave when viewed from an external vantage point above the main panel 112—in regions between a pair of adjacent articles B. In such embodiments, the side and/or end walls 14, 16, 18, 20 may be substantially planar.

Figure 3:
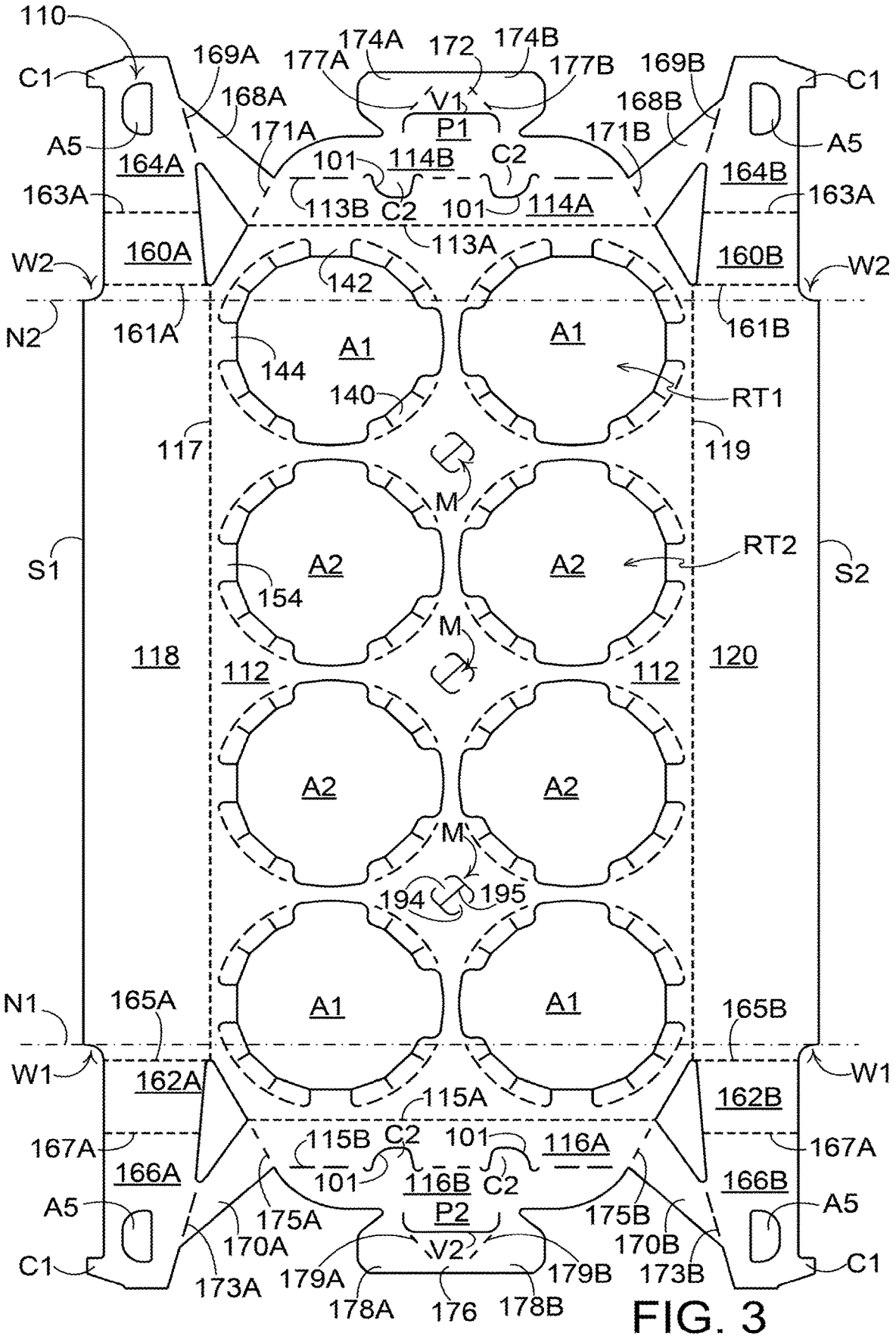
FIG. 3 is a plan view from above of a blank for forming a carrier according to various embodiments of the present disclosure.
Figure 4:
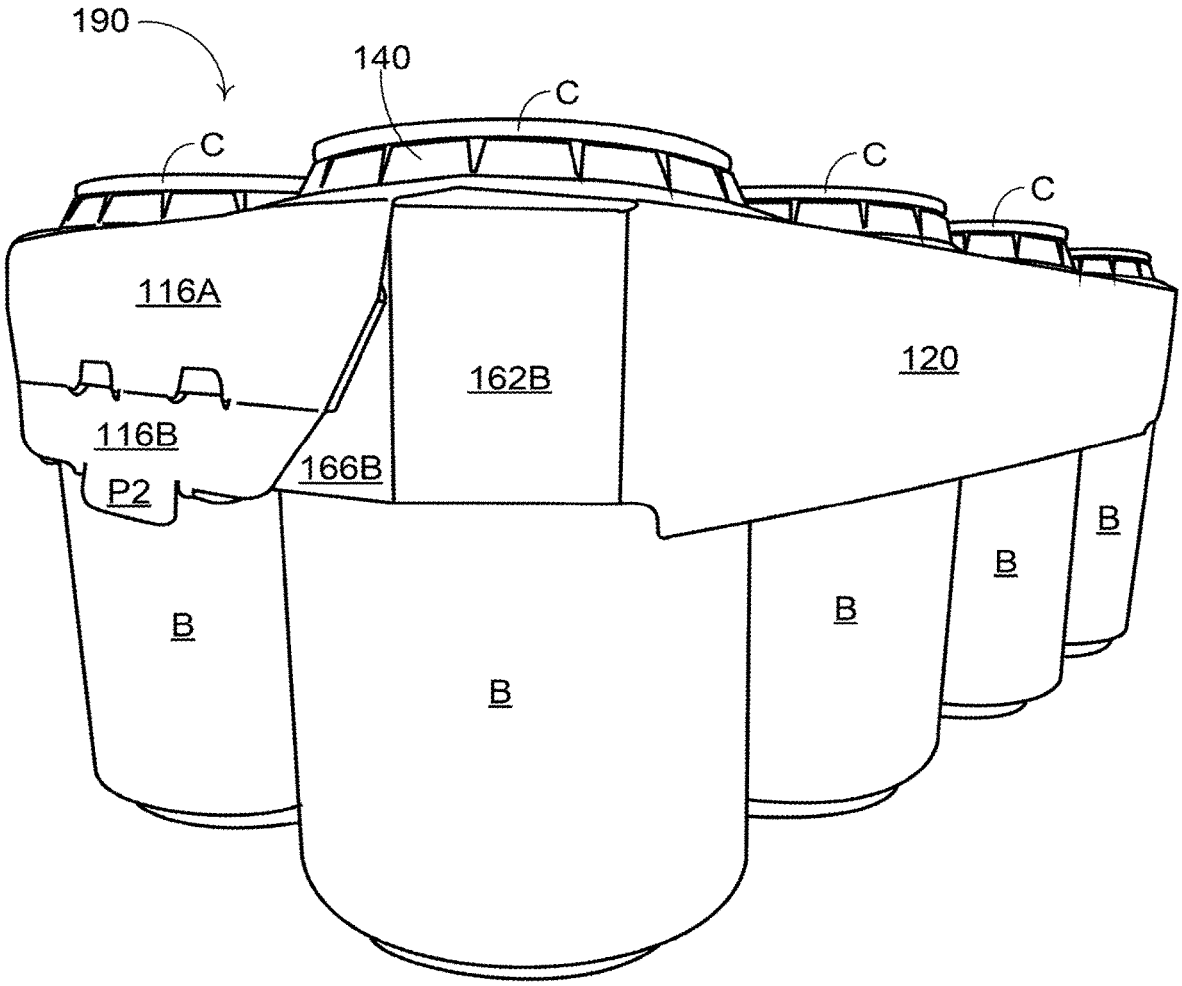
FIG. 4 is a perspective view from above of a carrier formed from the blank of FIG. 3.

Referring now to FIGS. 3 and 4 there is shown an alternative blank for use in the packaging system of the present disclosure. In the illustrated embodiment, like numerals have, where possible, been used to denote like parts, albeit with the addition of the prefix "100" to indicate that these features belong to the second embodiment. The alternative embodiment shares many common features with the embodiment of FIGS. 1 and 2, therefore only the differences from the embodiment illustrated in FIGS. 1 and 2 will be described in any greater detail.

FIG. 3 shows a blank 110 comprising a plurality of panels 112, 114A, 214B, 116A, 116B, 118, 120, including a main panel 112 for forming a top wall or engaging panel of a carrier 190 (see FIG. 4).

The main panel 112 comprises at least one article retention structure RT1, RT2. The main panel 112 comprises a plurality of article retention structures RT1, RT2, specifically eight article retention structures RT1, RT2 arranged in 2×4 matrix or array. Each of the article retention structures RT1, RT2 comprises an opening or aperture A1, A2.

The article retention structures RT1, RT2 of FIG. 3 are substantially similar to those of FIG. 1 albeit the tabs 142, 144, 154 are smaller in height dimension relative to the teeth 140 than the tabs 42, 44, 54 of FIG. 1.

A first side panel 118 is hingedly connected to a first side of the main panel 112 by a hinged connection in the form of a fold line 117.

A second side panel 120 is hingedly connected to a second side of the main panel 112 by a hinged connection in the form of a fold line 119.

The blank 110 comprises a first end structure. The first end structure comprises a first upper end panel 114A hingedly connected to a first end of the main panel 112 by a hinged connection in the form of a fold line 113A. A first lower end panel 114B is hingedly connected to the first upper end panel 114A by a hinged connection in the form of a fold line 113B.

The first end structure comprises a first corner panel 160A hingedly connected to a first end of the first side panel 118 by a hinged connection in the form of a fold line 161A. A second corner panel 160B is hingedly connected to a first end of the second side panel 120 by a hinged connection in the form of a fold line 161B.

The first end structure comprises a first securing panel 164A hingedly connected to the first corner panel 160A by a hinged connection in the form of a fold line 163A. A second securing panel 164B is hingedly connected to the second corner panel 160B by a hinged connection in the form of a fold line 163B.

A first web panel 168A is hingedly connected at one end to the first securing panel 164A by a hinged connection in the form of a fold line 169A and is hingedly connected at a second end to the first upper end panel 114A by a hinged connection in the form of a fold line 171A.

A second web panel 168B is hingedly connected at one end to the second securing panel 164B by a hinged connection in the form of a fold line 169B and is hingedly connected at a second end to the first upper end panel 114A by a hinged connection in the form of a fold line 171B.

The blank 110 comprises a second end structure. The second end structure comprises a second upper end panel 116A hingedly connected to a second end of the main panel 112 by a hinged connection in the form of a fold line 115A. A second lower end panel 116B is hingedly connected to the second upper end panel 116A by a hinged connection in the form of a fold line 115B.

The second end structure comprises a third corner panel 162A hingedly connected to a second end of the first side panel 118 by a hinged connection in the form of a fold line 165A. A fourth corner panel 162B is hingedly connected to a second end of the second side panel 120 by a hinged connection in the form of a fold line 165B.

The first end structure comprises a third securing panel 166A hingedly connected to the third corner panel 162A by a hinged connection in the form of a fold line 167A. A fourth securing panel 166B is hingedly connected to the fourth corner panel 162B by a hinged connection in the form of a fold line 167B.

A third web panel 170A is hingedly connected at one end to the third securing panel 166A by a hinged connection in the form of a fold line 173A and is hingedly connected at a second end to the second upper end panel 116A by a hinged connection in the form of a fold line 175A.

A fourth web panel 170B is hingedly connected at one end to the fourth securing panel 166B by a hinged connection in the form of a fold line 173B and is hingedly connected at a second end to the second upper end panel 116A by a hinged connection in the form of a fold line 175B.

It will be appreciated that the first side panel 118, the first corner panel 160A, the first securing panel 164A, the third corner panel 162A, and the third securing panel 166A form a first strap 164A/160A/118/162A/166A along a first side of the main panel 112. The second side panel 120, the second corner panel 160B, the second securing panel 164B, the fourth corner panel 162B, and the fourth securing panel 166B form a second strap 164B/160B/120/162B/166B along a second side of the main panel 112.

The blank 110 comprises first flap 172 hingedly connected to the first lower end panel 114B by a hinged connection. The hinged connection is defined, at least in part, by a cut line V1. Cut line V1 defines a tab P1 extending from an outer or lower edge of the first lower end panel 114B. The cut line V1 forms a receiver, in the form of an opening, slot or slit, for receiving a locking tab or detent C1. Each of the first and second securing panels 164A, 164B comprises a locking tab or detent C1 extending from a lower edge thereof.

The first flap 172 may comprise a pair of wing portions 174A, 174B hingedly connected by a respective fold line 177A, 177B to a central portion of the first flap 172. The fold lines 177A, 177B may be divergently arranged with respect to each other, the fold lines 177A, 177B diverge towards the first lower end panel 114B.

Each of the first and second securing panels 164A, 164B comprises a cutaway in the form of an aperture A5. Each aperture A5 forms a second receiver for receiving a respective second locking tab or detent C2. The first upper end panel 114A comprises a pair of cut lines 101, each of which is substantially "U" shaped, each cut line 101 defines a respective detent C2.

The blank 110 comprises second flap 176 hingedly connected to the second lower end panel 116B by a hinged connection. The hinged connection is defined, at least in part, by a cut line V2. Cut line V2 defines a second tab P2 extending from an outer or lower edge of the second lower end panel 116B. The cut line V2 forms a receiver, in the form of an opening, slot or slit, for receiving a locking tab or detent C2. Each of the third and fourth securing panels 166A, 166B comprises a locking tab or detent C2 extending from a lower edge thereof.

The second flap 176 may comprise a pair of wing portions 178A, 178B hingedly connected by a respective fold line 178A, 178B to a central portion of the second flap 176. The fold lines 179A, 179B may be divergently arranged with respect to each other, the fold lines 179A, 179B diverge towards the second lower end panel 116B.

Each of the third and fourth securing panels 166A, 166B comprises a cutaway in the form of an aperture A5. Each aperture A5 forms a second receiver for receiving a respective second locking tab or detent C2. The second upper end panel 116A comprises a pair of cut lines 101, each of which is substantially "U" shaped, each cut line 101 defines a respective detent C2.

The end structures are folded to secure the first and second side panels 118, 120 about sides of a group of articles B. The blank 110 can be applied to the group of articles B in a flat form and folded thereabout.

The main panel 112 is lowered with respect to a group of articles B. The first and second side panels 118, 120 are folded about the opposing sides of the group of articles B. The corner panels 160A, 160B, 162A, 162B are folded about the corners of the group of articles B and the securing panels 164A, 164B, 166A, 166B are folded about ends of the group of articles B.

The first and second upper end panels 114A, 116A are folded downwards about a respective end of the group of articles B. The first and second lower end panels 114B, 116B are folded upwardly with respect to the first and second upper end panels 114A, 116A such that the detents C2 can be inserted into the apertures A5. The first and second lower end panels 114B, 116B are folded downwardly to return to a substantially coplanar relationship with the respective one of the first and second upper end panels 114A, 116A to which they are hinged.

Figure 8:
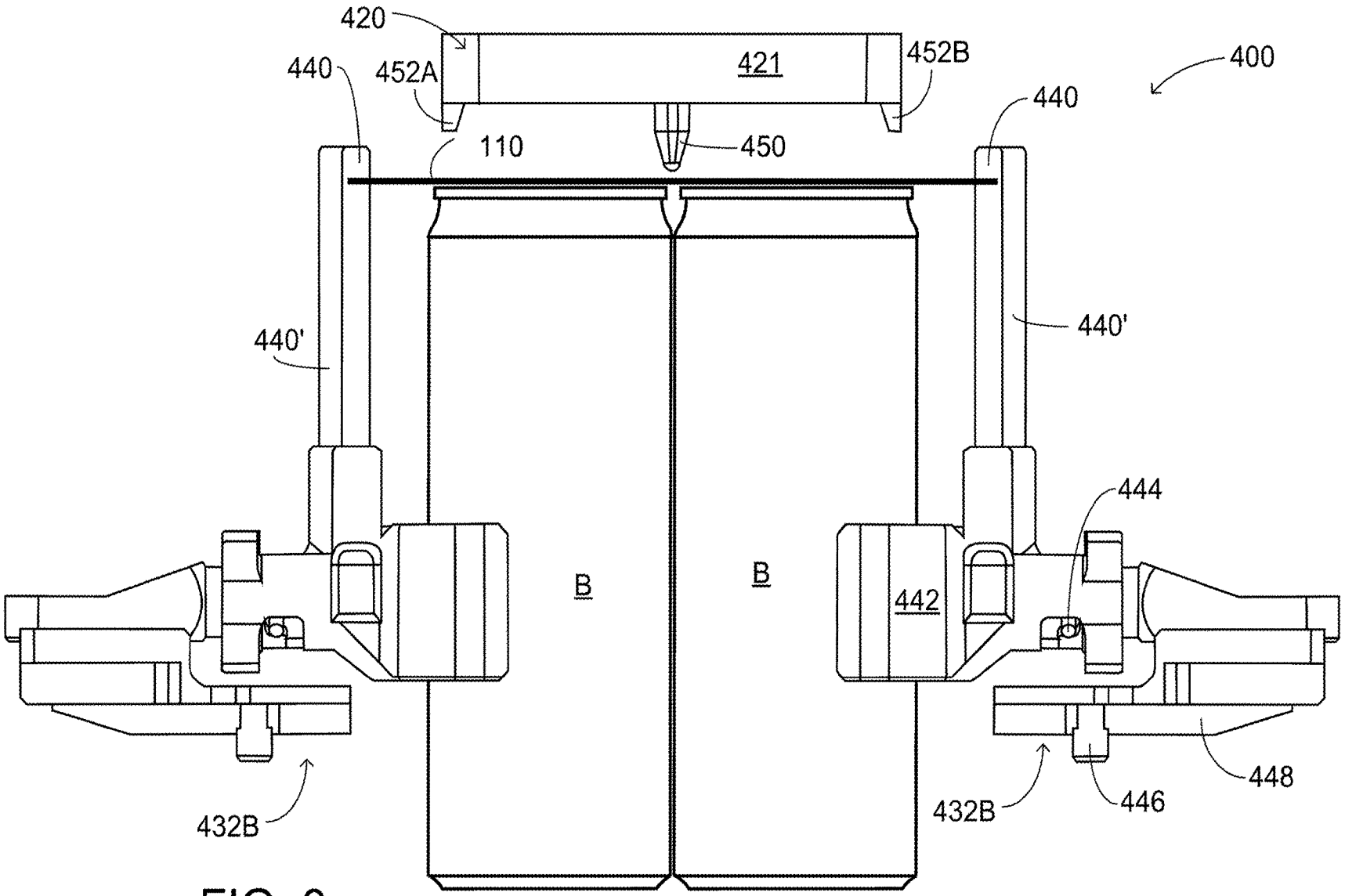
FIG. 8 is an end view of the packaging apparatus of FIG. 7.

The first and second flaps 172, 176 are folded internally, the wing portion 174A, 174B, 176A, 176B are folded with respect to the central portion so as to pass the side walls of adjacently disposed articles B, as shown in FIG. 8.

The blank 110 may comprise at least one, and may comprise at least two, alignment or registration devices W1, W2. Each of the registration devices W1, W2 takes the form of a cutaway or recess defining a registration edge of the blank 110 for receiving or engaging a reference pin (discussed in greater detail below). The blank 110 comprises a pair of first registration devices W1 each defining a downstream or leading registration edge. The blank 110 may also comprise a pair of registration devices W2 each defining an upstream or trailing registration edge. Each of the cutaways or recesses defining a registration devices W1, W2 is struck from one of the first and second side panels 118, 120.

The blank 110 may comprise at least one stabilisation device M. In the illustrated embodiment, the blank 110 comprises two stabilisation devices M. The stabilization device takes the form of an opening struck from the blank 110. A first stabilisation device M is disposed between first group of four article retention structures RT1, RT2 located proximate a first or leading end edge of the blank 110 and may be disposed centrally between said group of article retention structures RT1, RT2. A second stabilisation device M is disposed between a second group of four article retention structures RT1, RT2 located proximate a second or trailing end edge of the blank 110 and may be disposed centrally between said group of article retention structures RT1, RT2. The stabilisation devices M are configured to receive an abutment peg or dog (described in further detail below).

The opening of the stabilisation devices M may be non-circular in shape, and may be substantially square or diamond shaped. The opening may be defined by at least one tab 194 struck from the main panel 112 and hingedly connected thereto. In the illustrated embodiment, the opening is defined by a pair of tabs each struck from the main panel 112 and hingedly connected to the main panel 112 in opposition to each other. The pair of tabs 194 may be separated from each other by a cut or severable line 195.

In some embodiments, the stabilisation devices M may be arranged to provide an additional handle opening. In the embodiment of FIG. 3, the stabilisation devices M are generally too small in dimension to accept a finger or portion thereof of a user's finger. This may be advantageous in that a greater amount of substrate material is provided in the main panel 112 between the stabilisation devices M and the of article retention structures RT1, RT2, whereby improving the robustness and integrity of the article carrier 190.

Figure 5A:
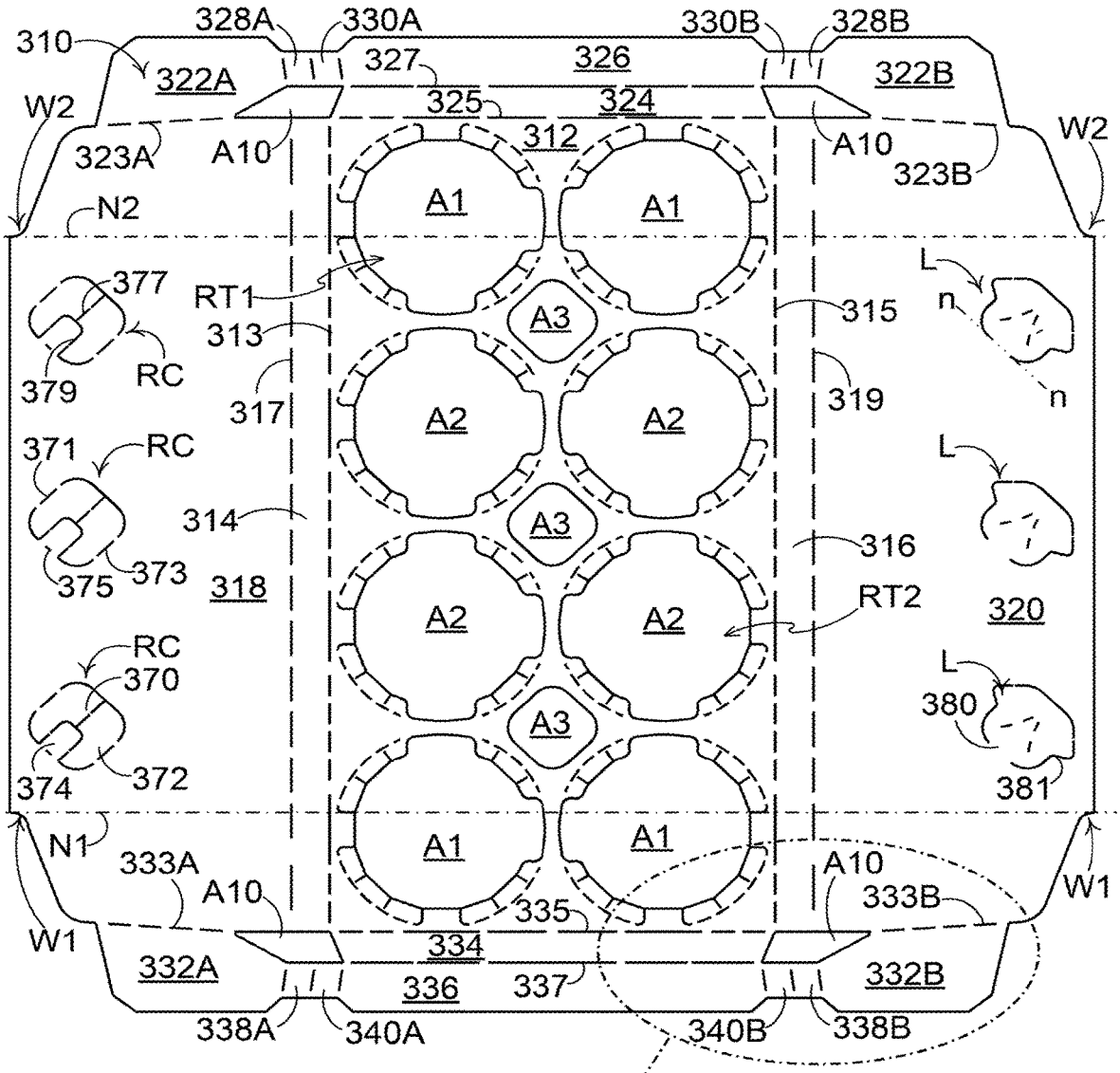
FIG. 5A is a plan view from above of a blank for forming a carrier according to embodiments of the present disclosure.
Figure 5B:
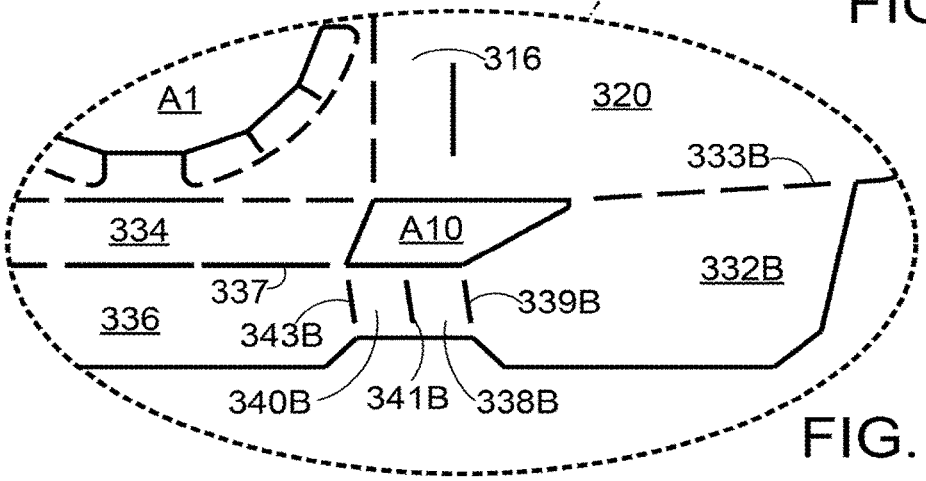
FIG. 5B is an enlarged plan view of a portion of the blank of FIG. 5A.
Figure 6:
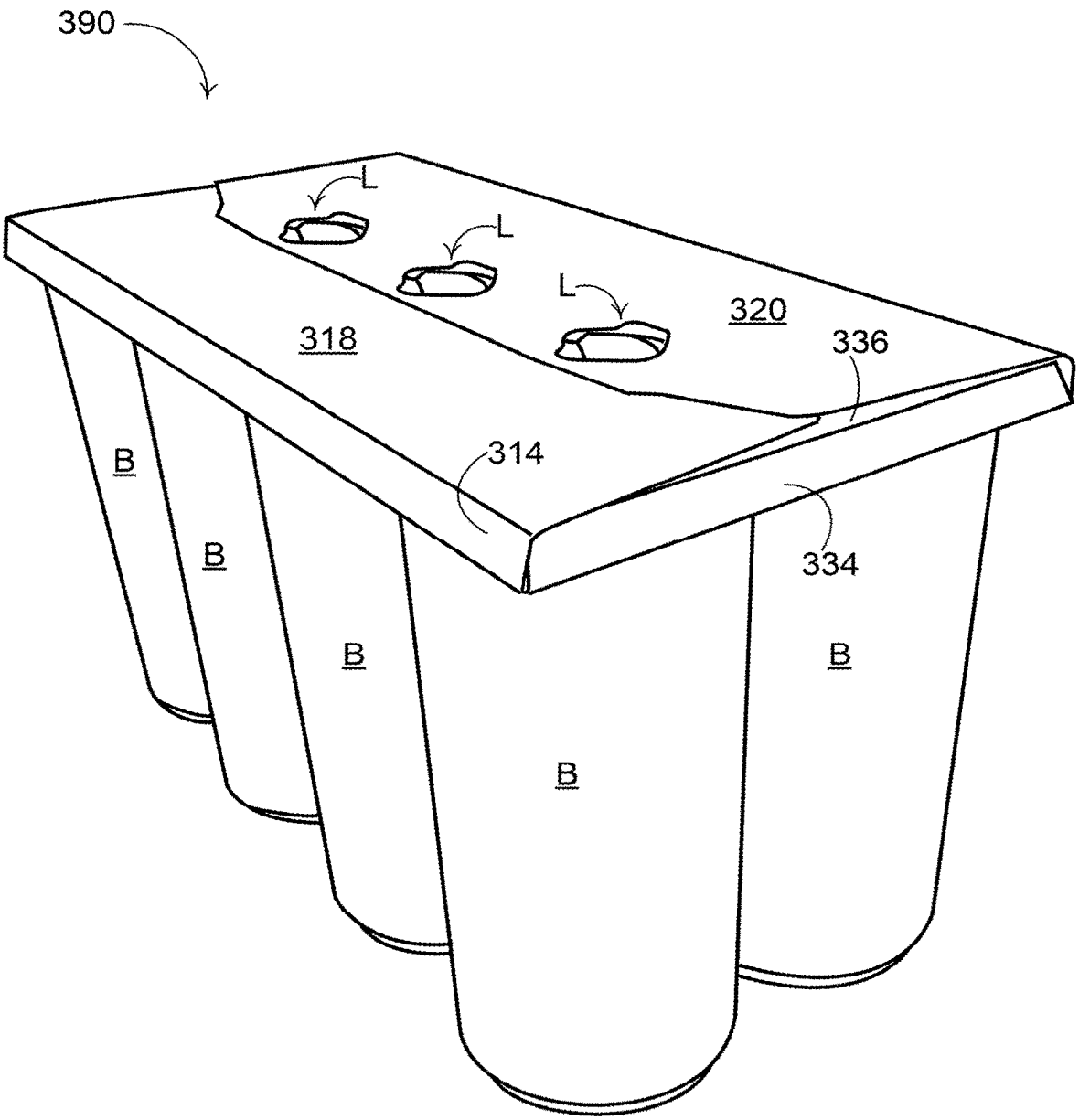
FIG. 6 is a perspective view from above of a carrier formed from the blank of FIG. 5A.
Figure 7:
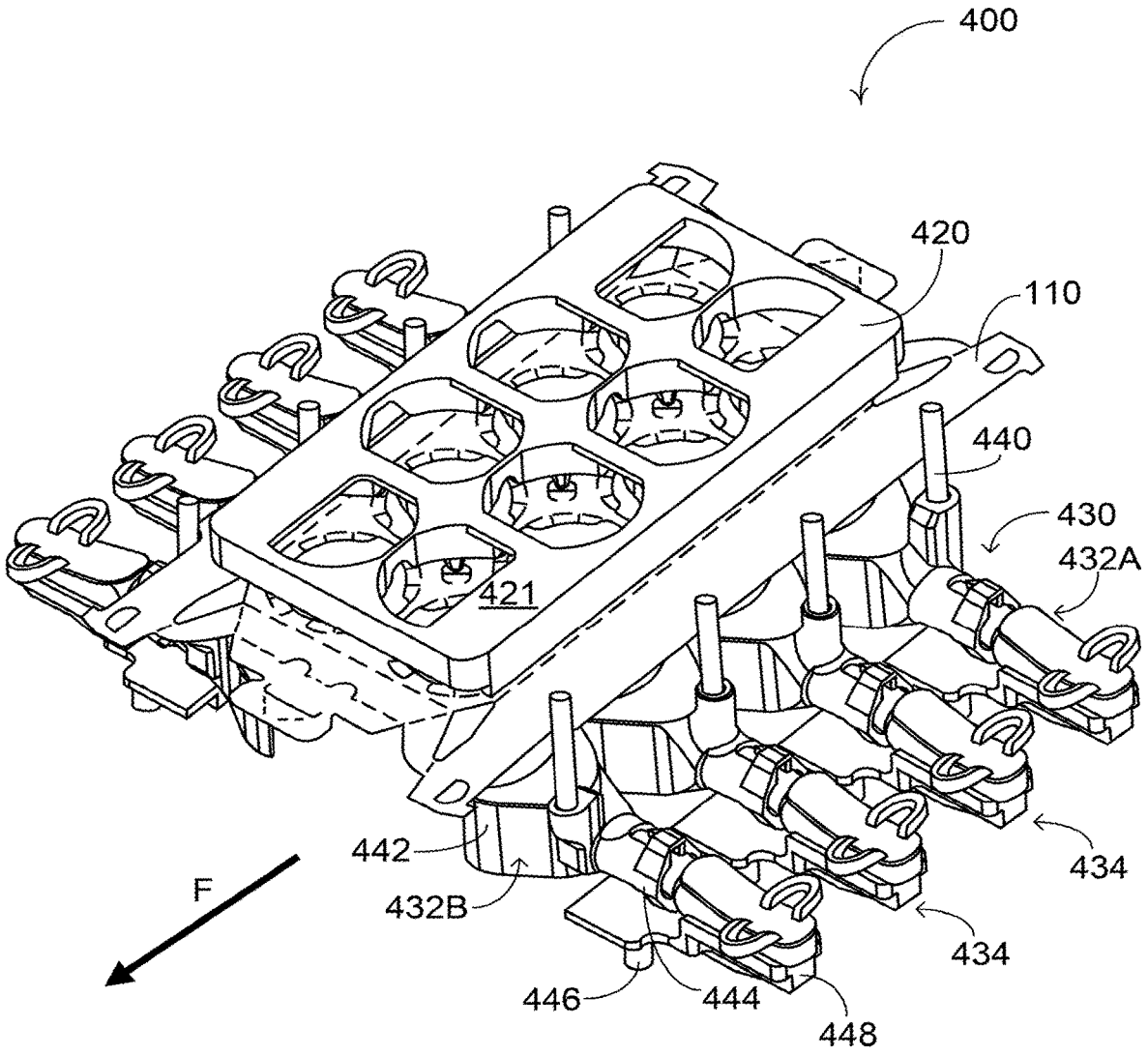
FIG. 7 is a perspective view from above of a packaging apparatus forming a part of a packing system according to embodiments of the present disclosure.

Referring now to FIGS. 5A, 5B, and 6 there is shown an alternative blank for use in the packaging system of the present disclosure. In the illustrated embodiment, like numerals have, where possible, been used to denote like parts, albeit with the addition of the prefix "300" to indicate that these features belong to the third embodiment. The alternative embodiment shares many common features with the embodiments of FIGS. 1 to 4, therefore only the differences from the embodiment illustrated in FIGS. 1 to 4 will be described in any greater detail.

Referring to FIG. 5A there is shown a blank 310 comprising a plurality of panels 312, 314, 316, 318, 320, including a main panel 312 for forming a lower wall or engaging panel of a carrier 390 (see FIG. 6).

A first side panel 314 is hingedly connected to a first side of the main panel 312 by a hinged connection in the form of a fold line 313. A first top or cover panel 318 is hingedly connected to the first side panel 314 by a hinged connection in the form of a fold line 317.

A second side panel 316 is hingedly connected to a second side of the main panel 312 by a hinged connection in the form of a fold line 315. A second top or cover panel 320 is hingedly connected to the second side panel 316 by a hinged connection in the form of a fold line 319.

The main panel 312 of the blank 310 includes at least one article retention structure RT1, RT2. The main panel 312 comprises a plurality of article retention structures RT1, RT2, specifically eight article retention structures RT1, RT2 arranged in 2×4 matrix or array. Each of the article retention structures RT1, RT2 comprises an opening or aperture A1, A2. The article retention structures RT1, RT2 are substantially similar to those shown in FIGS. 3 and 4 and will not be described in further detail.

The main panel 312 comprises a handle structure. The handle structure may comprise at least one handle opening A3. In the illustrated embodiment, the blank 310 comprises three handle openings A2. Each handle opening A3 is defined in or struck from a region of the main panel 312 disposed centrally between four apertures A1, A2 arranged as two adjacent pairs of apertures A1, A2.

The first and second top panels 318, 320 are arranged to be disposed in at least partially overlapping relationship with each other. The overlapping portions of the first and second top panels 318, 320 are provided with a locking structure for locking the first and second top panels 318, 320. The locking structure cooperates with the handle openings in the main panel 312 to secure the first and second top panels 318, 320 to the main panel 312.

The locking structure comprises at least one receiver RC in the form of an opening in the first top panel 318. The first top panel 318 comprises a plurality of openings, more specifically three openings, although in other embodiments one, two or more than three openings may be provided. Each of the openings is arranged to be in vertical registry or alignment with a handle opening A3 provided in the main panel 312. The openings may be defined by at least one tab 392, 394, 396 (also referred to herein as female tabs or receiver tabs). In the illustrated embodiment, the openings are defined by three tabs 392, 394, 396. The openings may be substantially square or diamond shaped, In the illustrated embodiment, the corners of the opening are rounded or filleted. A first tab 396 is hinged to the first top panel 318 by a first hinged connection in the form of a first fold line 391. A second tab 392 is hinged to the first top panel 318 by a second hinged connection in the form of a second fold line 393. The second tab 392 is hinged to the first top panel 318 in opposition to the first tab 396. The first tab 396 is separated in part from the second tab 392 by a first severance line or cut line 397 and in part by a third tab 394. The third tab 394 is defined by a second severance line or cut line 399. The second cut line 399 is substantially 'U' shaped. The third tab 394 is hinged to the first top panel 318 by a third hinged connection in the form of a third fold line 395. The third hinged connection is disposed adjacent to the first and/or second hinged connection, and may be substantially orthogonal thereto. The third tab 394 defines a cut-out or recess in each of the first and second tabs 396, 392. The cut-out or recess is struck from a free end edge opposing the first and second hinged connections respectively.

The locking structure comprises at least one locking element L for being received in the receiver RC. The locking element L comprises a tab 380 struck from the second top panel 320, the illustrated embodiment comprises three tabs 380 each arranged to be engageable with one of the receiver openings and a respective one of the handle openings A2. Each tab 380 is hinged to the second top panel 320 by a hinged connection 381. Each tab 380 may comprise at least one fold line. In the illustrated embodiment, the tab 380 comprises a pair of fold lines. The pair of fold lines may be divergently arranged with respect to each other. Each of the pair of fold lines may be non-linear in shape for example but not limited to arcuate or curvilinear in shape.

The nonlinear fold lines may encourage the tab 380 to return to a planar arrangement so as to increase security of the tab 380 within the receiver and the handle opening A3.

The tab 380 may be substantially 'arrow head' shaped so as to define a pair of opposing shoulders or detents for securely engaging the handle opening A3 and/or receiver RC.

The first top panel 318, second top panel 320, first and second side panels 314, 316 and main panel 312 form a tubular structure. Each end of the tubular structure is closed by an end closure structure. A first end closure structure comprises a first end panel 324 hingedly connected to a first end of the main panel 312 by a hinged connection in the form of a fold line 325. A first top end flap 326 is hingedly connected to the first end panel 324 by a hinged connection in the form of a fold line 327.

A first anchor flap 322A is hingedly connected to a first end of the first top panel 318 by a hinged connection in the form of a fold line 323A. The first anchor flap 322A is hingedly connected to the first top end flap 326 by a pair of hinged panels 328A, 330A. The pair of hinged panels 328A, 330A form a gusset. A first connecting panel 328A is hingedly connected to the first anchor flap 322A by a hinged connection in the form of a fold line. A second connecting panel 330A is hingedly connected to the first connecting panel 328A by a hinged connection in the form of a fold line. The second connecting panel 330A is hingedly connected to the first top end flap 326 by a hinged connection in the form of a fold line.

A second anchor flap 322B is hingedly connected to a first end of the second top panel 320 by a hinged connection in the form of a fold line 323B. The second anchor flap 322B is hingedly connected to the first top end flap 326 by a pair of hinged panels 328B, 330B forming a second gusset. A third connecting panel 328B is hingedly connected to the second anchor flap 322B by a hinged connection in the form of a fold line. A fourth connecting panel 330B is hingedly connected to the third connecting panel 328B by a hinged connection in the form of a fold line. The fourth connecting panel 330B is hingedly connected to the first top end flap 326 by a hinged connection in the form of a fold line.

The first end panel 324 is separated from each of the first and second anchor flaps 322A, 322B by an aperture A10. The apertures A10 separate each of the pair of hinged panels 328A/330A, 328B/330B from the respective one of the first and second side panels 314, 316.

A second end closure structure comprises a second end panel 334 hingedly connected to a second end of the main panel 312 by a hinged connection in the form of a fold line 335. A second top end flap 336 is hingedly connected to the second end panel 334 by a hinged connection in the form of a fold line 337.

A third anchor flap 332A is hingedly connected to a second end of the first top panel 318 by a hinged connection in the form of a fold line 333A. The third anchor flap 332A is hingedly connected to the second top end flap 336 by a pair of hinged panels 338A, 340A forming a third gusset. A fifth connecting panel 338A is hingedly connected to the third anchor flap 332A by a hinged connection in the form of a fold line. A sixth connecting panel 340A is hingedly connected to the fifth connecting panel 338A by a hinged connection in the form of a fold line. The sixth connecting panel 340A is hingedly connected to the second top end flap 336 by a hinged connection in the form of a fold line.

A fourth anchor flap 332B is hingedly connected to a second end of the second top panel 320 by a hinged connection in the form of a fold line 333B. The fourth anchor flap 332B is hingedly connected to the second top end flap 336 by a pair of hinged panels 338B, 340B forming a fourth gusset. A seventh connecting panel 338B is hingedly connected to the fourth anchor flap 332B by a hinged connection in the form of a fold line 339B (see FIG. 5B). An eighth connecting panel 340B is hingedly connected to the seventh connecting panel 338B by a hinged connection in the form of a fold line 355B. The eighth connecting panel 340B is hingedly connected to the second top end flap 336 by a hinged connection in the form of a fold line 359B.

The second end panel 334 is separated from each of the third and fourth anchor flaps 332A, 332B by an aperture A10. The apertures A10 separate each of the pair of hinged panels 338A/340A, 338B/340B from the respective one of the first and second side panels 314, 316.

The blank 310 may comprise at least two alignment or registration devices W1, W2. Each of the registration devices W1, W2 takes the form of a cutaway or recess defining a registration edge of the blank 310 for receiving or engaging a reference pin (discussed in greater detail below). The blank 310 comprises a pair of first registration devices W1 each defining a downstream or leading registration edge. The blank 310 may also comprise a second pair of registration devices W2 each defining an upstream or trailing registration edge. Each of the cutaways or recesses defining a registration device W1, W2 is struck from, or defined in, one of the first and second top panels 318, 320.

The blank 310 may comprise at least one stabilisation device. In the illustrated embodiment, the blank 110 comprises three stabilisation devices. Each stabilization device comprises an opening in at least one of the first top panel 318, second top panel 320, and the main panel 312. Each stabilization device may comprise an opening in at least two, or all, of the first top panel 318, second top panel 320, and the main panel 312. Each stabilisation device is configured to receive an abutment peg or dog (described in further detail below).

An opening forming at least part of the stabilisation device may be non-circular in shape, and may be substantially square or diamond shaped. The opening or openings in the panels providing the stabilisation device may be defined by at least one tab struck from the panel in which it is formed and hingedly connected thereto.

In the illustrated embodiment, an opening is defined in part by a pair of tabs 370, 372 each struck from the first top panel 318 and hingedly connected to the first top panel 318 in opposition to each other. The pair of tabs 370, 372 may be separated from each other by a cut or severable line 377.

A first stabilisation device is arranged to be disposed in vertical registration with a gap or void between a first group of four articles being packaged within the carrier 390. A second stabilisation device is arranged to be disposed in vertical registration with a gap or void between a second group of four articles. A third stabilisation device is arranged to be disposed in vertical registration with a gap or void between a third group of four articles.

Turning to the construction of the carrier 390 from the blank 310, the blank 310 may be formed into an assembled carrier 390, as shown in FIG. 6.

The blank 310 is applied to a group of articles B. The blank 310 is lowered with respect to a group of articles B. Each of the article retention structures RT1, RT2 of the blank 310 is aligned with a respective article B in the group. Portions of the articles B pass through the main panel 312. The toothed regions of the main panel 312 about each of the article retention structures RT1, RT2 may be folded out of the plane of the main panel 312.

Each toothed region of the main panel 312 may be folded about one of the articles B received in the respective one of the article retention structures RT1, RT2. The main panel 312 may deform about the article B for example but not limited to a shoulder portion of the article B, where the article B is a can the shoulder portion may be provide by the neck-in.

The blank 310 may be partially folded about fold lines 313, 315 to bring the first and second side panels 314, 316 into non-coplanar relationship with the main panel 312.

The blank 310 is folded about fold lines 323A, 323B, 333A, 333B to fold the first, second, third and fourth anchor flaps 322A, 322B, 332A, 332B into substantially face to face relationship with the first or second side panels 314, 316 to which they are hinged.

The blank 310 is folded about fold lines 325, 335 to fold the first and second end panels 324, 334 into substantially at least perpendicular relationship with the main panel 312. In some embodiments the first and second end panels 324, 334 may be folded through an angle greater than 90° so as to be inclined.

The blank 310 is folded about fold lines 327, 337 to fold the first and second top end flaps 326, 336 with respect to the respective one of the first and second end panels 324, 334 to which they are hinged.

The first and second top end flaps 326, 336 may be folded over an upper end of an article B or articles B disposed adjacent to the first and second ends of the main panel 312.

The first and second top end flaps 326, 336 may be folded to be substantially parallel to the main panel 312.

The first and second end panels 324, 334 and first and second top end flaps 326, 336 may be folded automatically in response to folding the first, second, third and fourth anchor flaps 322A, 322B, 332A, 332B into substantially face contacting relationship with the respective one of the first and second side panels 314, 316.

The blank 310 is folded about fold lines 313, 315 to bring the first and second side panels 314, 316 into substantially perpendicular relationship with the main panel 312.

The blank 310 is folded about fold line 317 to fold the first top panel 318 over the tops of the articles B. The blank 310 is folded about fold line 319 to fold the second top panel 320 over the tops of the articles B and into overlapping relationship with the first top panel 318 to form a composite top panel 318/320.

The locking tabs 380 are displaced out of the plane of the second top panel 320, downwardly so as to pass through a respective one of the receiver openings. The receiver tabs 392, 394, 396 displaced out of the plane of the first top panel 318 as a consequence.

The locking tabs 380 are engaged with the first and second receiver tabs 396, 392. Shoulders of the locking tab 380 may engage not only with the perimeter of the respective handle opening A3 but also with an edge of each of the first and second receiver tabs 396, 392. The shoulders of the locking tab 380 engage with an edge of each of the first and second receiver tabs 396, 392 defined by a cutaway or recess in the free edge opposing their hinged connections 391, 393 to the first top panel 318.

The recessed edges of the first and second receiver tabs 396, 392 prevent or inhibit disengagement of the locking tabs 380 from the locked condition with the first and second receiver tabs 396, 392.

The locking tabs 380 and the receiver tabs 396, 392 may also serve to function as a spacer between the composite top panel 318/320 and the main panel 312. The locking tabs 380 may engage the main panel 312 along the perimeters of the handle openings A3 and/or the lower surface of the main panel 312 and may thereby serve as tension members for maintaining a spacing between the main panel 312 and the composite top panel 318/320 so as to prevent the spacing from increasing. Additionally, the receiver tabs 396, 392 and/or the locking tabs 380 may engage or abut with the inside or upper surface of the main panel 312 and may thereby brace between the composite top panel 318/320 and the main panel 312 to maintain a spacing therebetween so as to assist in preventing the spacing from decreasing. Thus, at least a portion of the locking tab 380 and/or at least a portion of one or more of the receiver tabs 396, 392 may be disposed between the first top panel 318 and the main panel 312 to maintain a spacing therebetween.

The locking tab 380 may also provide a cushioning tab improving comfort when the package 390 is carried by inserting one or more fingers into the openings in the composite top panel 318/320 and the main panel 312.

The first and second receiver tabs 396, 392 when folded may extend through the handle openings A3.

The locking tabs 380 may also engage with the main panel 312, passing through a respective one of the handle openings A3. The shoulders of the locking tab 380 may engage with an underside of the main panel 312; the underside being a second side of the main panel 312 opposing a first side through which the locking tab 380 was received.

The third tab 394 may provide a biasing mechanism. The third tab 394 has natural or inherent tendency to return to the unfolded condition. This may provide, or supplement, the resilient bias of the locking tab 380 to return to an unfolded condition. The third tab 394 encourages the locking tabs 380 towards an end stop defined by the recessed edge of the first and second receiver tabs 396, 392. The end stop inhibits or prevents the locking tab 380 from returning to the unfolded condition.

FIGS. 7 to 12 illustrate embodiments of a packaging apparatus 400, 500, 600 forming part of a packaging machine for assembling the blanks 10; 110; 310 of FIGS. 1 to 6 about a group of articles B.

Figure 11:
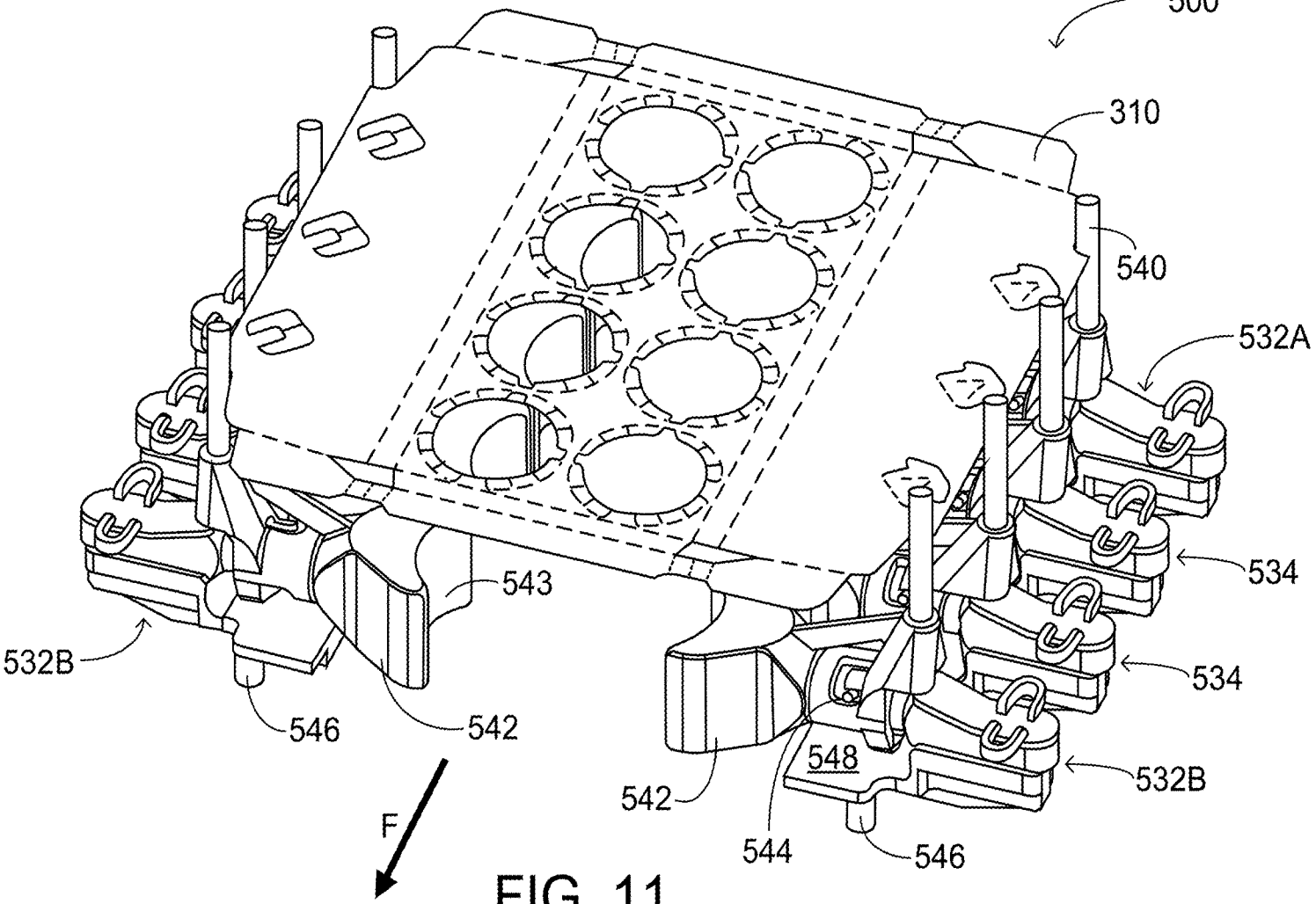
FIG. 11 is a perspective view from above of a packaging apparatus forming a part of a packing system according to alternative embodiments of the present disclosure.
Figure 12:
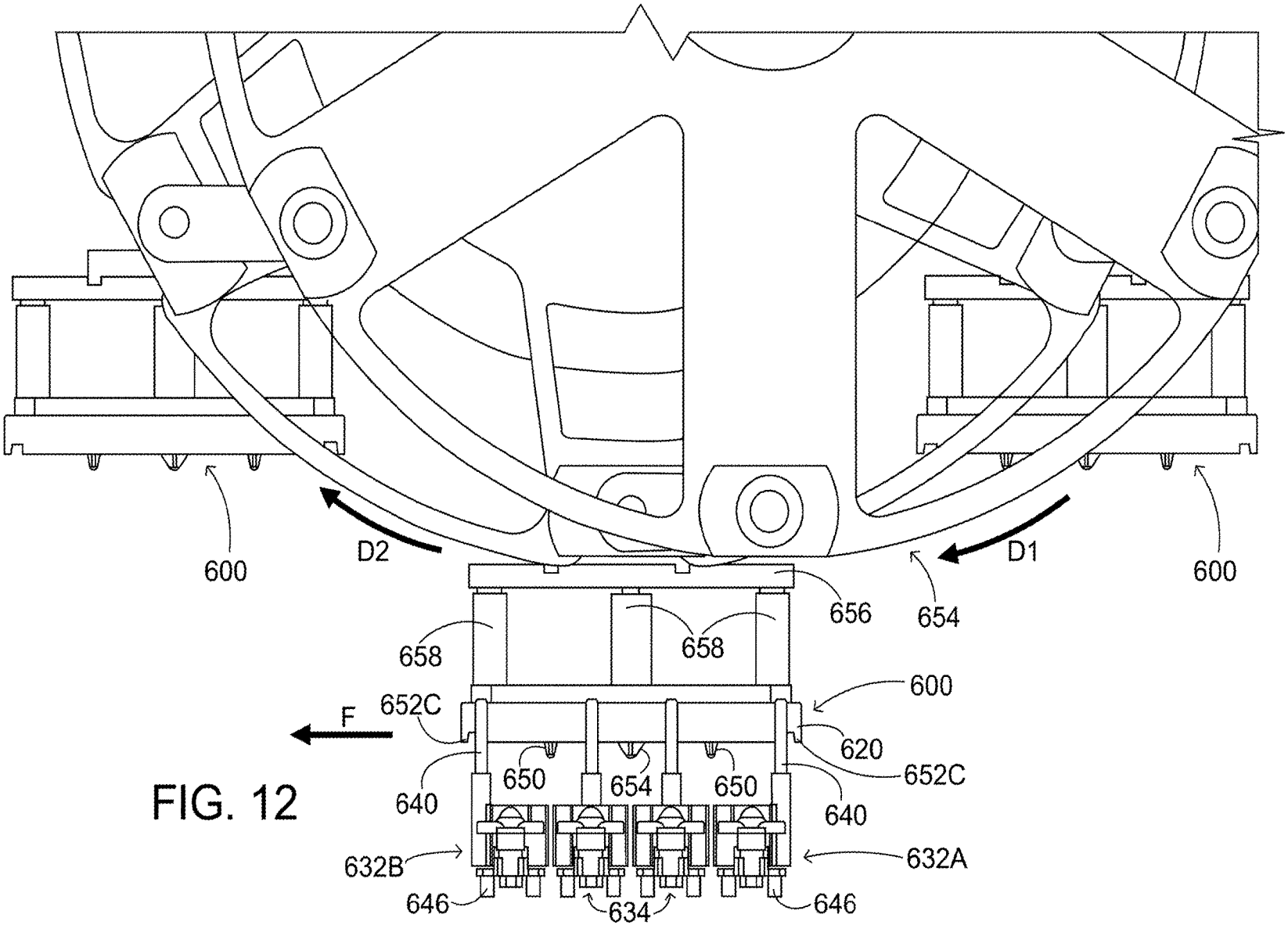
FIG. 12 is a side view from above of a packaging apparatus forming a part of a packing system according to embodiments of the present disclosure.

FIGS. 7 to 10 show views of a packaging apparatus 400 adapted to assemble the blank 110 of FIG. 3. FIG. 11 shows a view of a packaging apparatus 500 adapted to assemble the blank 310 of FIG. 5. FIG. 12 shows a view of a packaging apparatus 600 adapted to assemble the blank 10 of FIG. 1.

Figure 9:
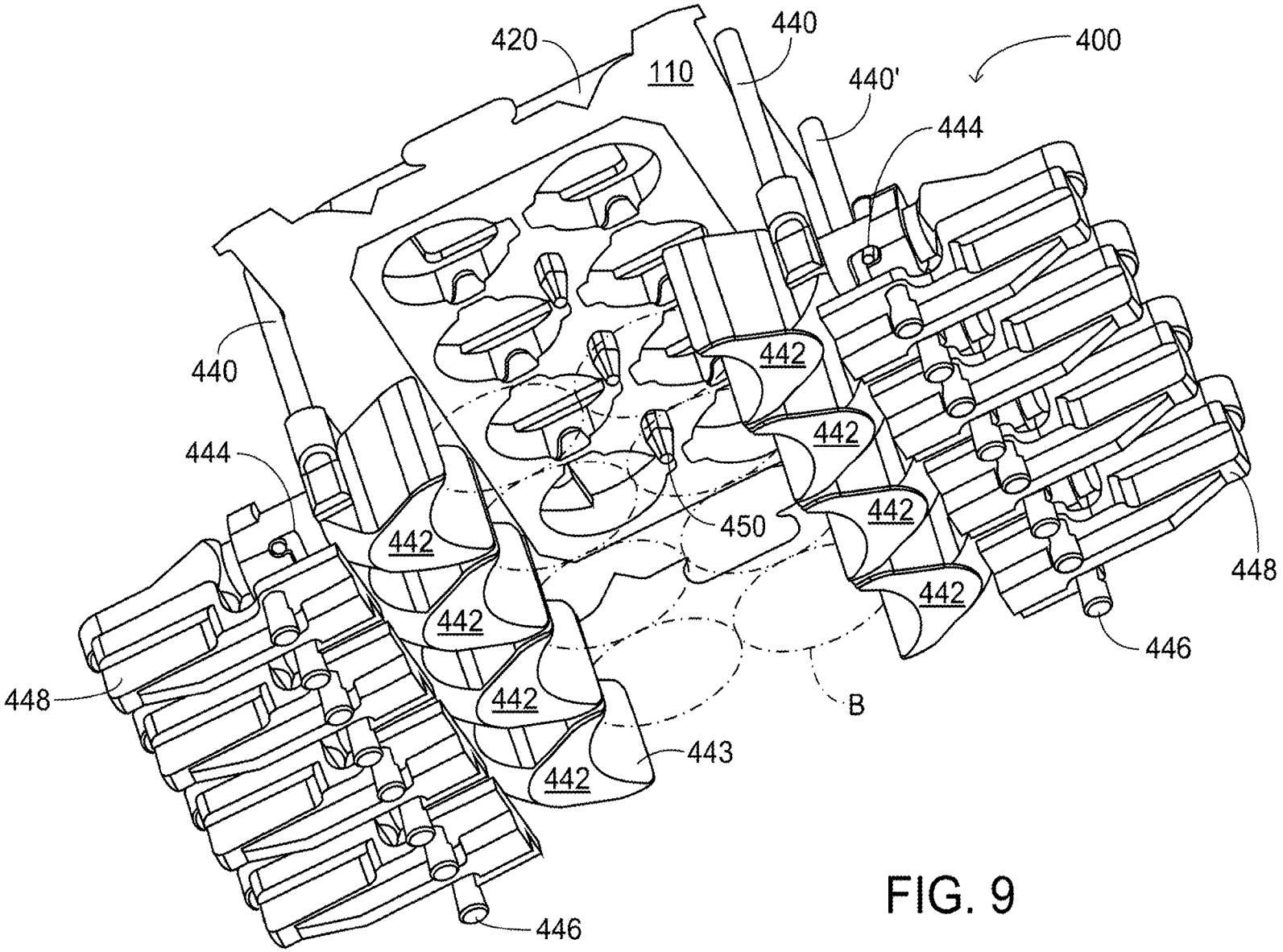
FIG. 9 is a plan view of the packaging apparatus of FIG. 7.
Figure 10:
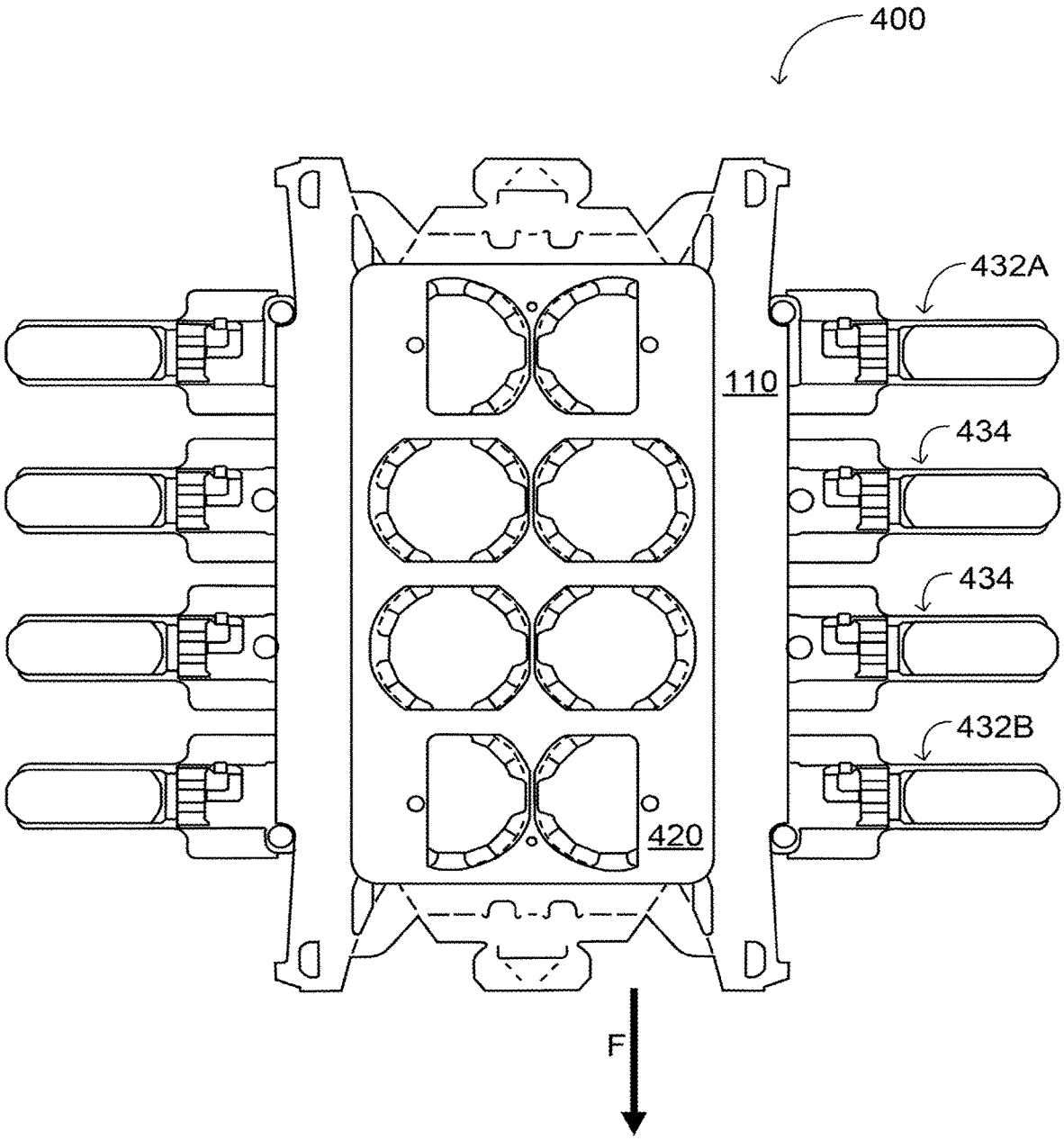
FIG. 10 is a perspective view from below of the packaging apparatus of FIG. 7.

Returning to FIG. 7 there is shown a packaging apparatus 400 comprising a grouping and metering apparatus and an applicator 420 for applying the blank 110 to a metered group of articles (not shown in FIG. 7, FIG. 8 shows the articles B, and FIG. 9 shows the position of the articles B in phantom lines).

The metering apparatus comprises a first plurality of article engaging tools 432A, 432B, 434 for engaging, metering and driving a first column of articles B through the packaging apparatus 400. The metering apparatus comprises a second plurality of article engaging tools 432A, 432B, 434 for engaging, metering and driving a second column of articles B through the packaging apparatus 400. The second plurality of article engaging tools 432A, 432B, 434 is arranged in opposition to the first plurality of article engaging tools 432A, 432B, 434.

Each of the article engaging tools 432A, 432B, 434 is coupled to or comprises a drive mechanism to propel each of the first and second plurality of article engaging tools 432A, 432B, 434 about a respective track or loop.

Each of the article engaging tools 432A, 432B, 434 is coupled to or mounted to a track a respective track or loop (not shown) having a working reach and a return reach. The article engaging tools 432A, 432B, 434 may comprise a magnet (not shown) for holding the article engaging tools 432A, 432B, 434 to the track. The track comprises a drive mechanism for driving the article engaging tools 432A, 432B, 434 about the track. The drive mechanism may take the form of a linear motor. A stator comprising coils is mounted to the track and generates propulsive force by acting upon the magnet to drive the article engaging tools 432A, 432B, 434 about the track. Each of the article engaging tools 432A, 432B, 434 can be independently or individually controlled, in this way the pitch between article engaging tools 432A, 432B, 434 can be varied and the article engaging tools 432A, 432B, 434 can be individually accelerated or decelerated.

Each article engaging tools 432A, 432B, 434 in the first plurality of article engaging tools 432A, 432B, 434 is driven in synchronicity with a respective one of the article engaging tools 432A, 432B, 434 in the second plurality of article engaging tools 432A, 432B, 434, at least through a working reach of the packaging apparatus 400, 500, 600.

The packaging apparatus 400 may merge a first stream of articles B with a second stream of articles B, the first plurality of article engaging tools 432A, 432B, 434 engaging articles from the first stream and the second plurality of article engaging tools 432A, 432B, 434 engaging articles from the second stream.

Each article engaging tool 432A, 432B, 434 comprises a carriage 448 having at least one wheel or follower 446, in some embodiments two, three, four or more wheels or followers 446 may be provided on each carriage 448 and engage with the track.

Each carriage 448 comprises a head 442 detachably mounted thereto by a securing mechanism 444. In some embodiments, the lock mechanism 444 may take the form of a bayonet style fitting or mount. In this way the head 442 is readily separated from the carriage 448 and may be interchanged, swapped or replaced. This allows the head 442 to be changed for a different head to accommodate a different carton blank 10; 110; 310 or article B or to enable replacement of a damaged or broken head.

Each of the heads 442 comprises a gripper or scoop 443 providing at least one engaging surface for engaging an article B. The gripper 443 comprises a pair of fingers or limbs defining a recess or channel arranged to accommodate a portion of the article B.

Each of the heads 442 may comprise a reference pin or post 440 extending upwardly therefrom. The reference pin 440 is mounted to the head 442 at a first proximal end and extends upwardly to a distal free end. The distal free end is disposed at an elevation above the upper end of the articles B. In this way the reference pin 440 is configured to engage with a blank 110 when placed upon the upper ends of the articles B in the group of articles B. The heads 442 forming leading and trailing article engaging tools 432A, 432B may comprise a first reference pin or post 440. The heads 442 forming intermediate article engaging tools 434 may comprise an optional second reference pin or post 440'. The second reference pin or post 440' may be offset with respect to the first reference pins 440 provided by the leading and trailing article engaging tools 432A, 432B, best illustrated in FIG. 8.

The reference pin 440 is arranged to be located between a leading portion of the head 442 and a trailing portion of the head 442. The reference pin 440 is located upstream of a downstream end, edge or wall of the article B engaged by the head 442 to which it is mounted and the reference pin 440 is located downstream of an upstream end, edge or wall of the article B engaged by said head 442.

The reference pin 440 may be disposed within the footprint of the carriage 448 and/or head 442. In this way two adjacent carriages 448 or head 442 can be brought into close proximity without interference by the reference pin 440 or its mounting. This enables two or more article engaging tools 432A, 432B, 434 to bring two or more articles B into close proximity or to engage two or more articles B which are disposed in close proximity.

In order to form a metered group of articles B pairs of article engaging tools 432A, 432B, 434 bring together pairs of articles B, one from each of the first and second columns or streams of articles B.

Two or more pairs of article engaging tools 432A, 432B, 434 may be employed to form a group of articles B, in the illustrated embodiment four pairs of article engaging tools 432A, 432B, 434 form a group of eight articles B in a 2×4 matrix or array.

In order to form the group, the leading pair of article engaging tools 432B may be retarded to allow the intermediate pairs of article engaging tools 434, and the trailing pair of article engaging tools 432A to catch up with the pair of article engaging tools 432A, 432B, 434 disposed downstream thereof. Once each upstream pair of article engaging tools 432A, 432B, 434 catch the adjacent downstream pair of article engaging tools 432A, 432B, 434, they too may be retarded to match the speed of said downstream pair. In alternative embodiments, it will be appreciated that speed of an upstream pair of article engaging tools 432A, 432B, 434 may be increased or accelerated to catch an adjacent downstream pair of article engaging tools 432A, 432B, 434.

As the article engaging tools 432A, 432B, 434 form the group of articles B a blank 110 is lowered onto the upper ends of the articles B forming the group.

The blank 110 is lowered or fed from above by an overhead conveyor (not shown) and is moved in the downstream direction with the articles B, the leading registration edges provided by the pair of first registration devices W1 are brought into contact with the reference pin 440 of respective ones of the leading pair of article engaging tools 432B.

When the trailing pair of article engaging tools 432A completes formation of the group of articles B the reference pin 440 of respective ones of the trailing pair of article engaging tools 432A are brought into contact with the trailing registration edges provided by the pair of second registration devices W2. The blank 110 is confined between the reference pins 440 of the leading and trailing article engaging tools 432B, 432A. The reference pins 440 ensure the blank is correctly aligned with respect to the group of article B and maintains this alignment as the blank 110 and articles B move in a downstream direction through the packaging apparatus.

It will be appreciated that in some embodiments only one of the trailing pair of article engaging tools 432A and one of the leading pair of article engaging tools 432B may comprise a reference pin 440; said reference pins 440 being disposed on diagonally opposed ones of the trailing pair of article engaging tools 432A and leading pair of article engaging tools 432B.

The reference pins 440' (when provided) of the intermediate pairs of article engaging tools 434 may contact or engage side edges S1, S2 of the blank 110 to further support alignment of the blank 110 with respect to the group of articles B.

The reference pins 440, 440' each engage a panel 118, 120 hingedly connected to the main or engaging panel 112. The panel 118, 120 is folded about a side or end of the article group, in doing so the panel 118, 120, in particular the registration edges, are disengaged from the reference pins 440, 440'.

The packaging apparatus 400 comprises an applicator 420 for effecting folding of the panel 118, 120 with respect to the main or engaging panel 112.

The applicator 420 comprises a plate 421, a lower or engaging surface of the plate 421 comprises a plurality of recesses or orifices each adapted to receive an upper portion of an article B. The illustrated embodiment comprises eight orifices arranged in 2×4 matrix or array.

The plate 421 comprises one or more folding dies or brakes 452A, 452B depending from the lower or engaging surface of the plate 421. The folding dies or brakes 452A, 452B effect folding of the side panels 118, 120 with respect to the main or engaging panel 112.

The plate 421 comprises one or more retention or stabilising pins or lugs 450 depending from the lower or engaging surface of the plate 421. The illustrated embodiment comprises three stabilising pins 450, best shown in FIG. 9.

The stabilising pins 450 are longer in length than the folding dies 452A, 452B, so as to extend therebelow. The stabilising pins 450 are the first parts of the applicator 420 to engage the blank 110. The stabilising pins 450, also referred to herein as abutment pegs, are received by a respective stabilisation device M. The stabilising pins 450 are inserted into the opening of the stabilisation device M, the tabs 94 when present are folded out of the plane of the main panel 112 as the stabilising pins 450 are received. The stabilising pins 450 prevent or inhibit movement of the blank 110 with respect to the applicator 420 and retain the blank 110 in correct alignment with the articles B as the side panels 18, 120 are folded about the sides of the article group.

The applicator 420 is lowered with respect to the articles B so as to press the blank 110 over the upper ends of the articles B. The applicator 420 is brought into contact with the blank 110, the stabilising pins 450 are received by the stabilisation devices M, the side panels 118, 120 are folded downwardly, applicator 420 is lowered further and presses the blank 110 downwardly such that an article B is received in each of the article retention structures RT1, RT2. The tabs 140, 142, 144, 154 are folded out of the plane of the engaging panel 112 and engage below a flange or other suitable projection provided on the articles B.

FIG. 11 shows a view of a packaging apparatus 500 adapted to assemble the blank 310 of FIG. 5. The packaging apparatus 500 comprises heads 542 which have been adapted to accommodate the blank 310. In particular the heads 542 comprise reference pins 540 which are disposed further from the engaging surface 543 of the head 542 than those of the head 442 of the embodiment of FIGS. 7 to 10. In the illustrated embodiment, the securing mechanism 544 is disposed between the engaging surface 543 of the head 542 and the reference pin 540. In the embodiment of FIGS. 7 to 10, the reference pin 440 is disposed between the securing mechanism 444 and the engaging surface 443 of the head 442.

The heads 542 of FIG. 11 and the heads 442 of FIGS. 7 to 10 may be interchangeable, that is to say the head may be selected depending upon the blank being packaged. The carriage 448 and the carriage 548 may be substantially similar such that either head 542 or head 442 can be mounted thereto.

Referring now to FIG. 12 there is shown a view of a packaging apparatus 600 adapted to assemble the blank 10 of FIG. 1.

The applicator 620 comprises a pair of first stabilising pegs or pins 650 adapted to be received in the opening of the stabilisation devices M.

The applicator 620 comprises an optional second stabilising peg or pin 654 adapted to be received in the handle opening of the handle structure H. The second stabilising peg 654 is shaped and dimensioned to fit the handle opening and may be wider, or larger in diameter, than the first stabilising pegs 650.

In some embodiments, the pair of first stabilising pegs or pins 650 may be omitted and only the second stabilising peg or pin 654 may be provided, the second stabilising peg or pin 654 may be shaped to prevent or inhibit rotation of the blank with respect to the applicator 620 when the second stabilising peg or pin 654 is received in a stabilising device provided by the blank 10.

The applicator 620 comprises one or more first folding dies or brakes depending from the lower or engaging surface of the plate. The folding dies or brakes effect folding of the side panels 18, 20 with respect to the main or engaging panel 12.

The applicator 620 comprises one or more second folding dies or brakes 652C, 652C depending from the lower or engaging surface of the plate. The folding dies or brakes effect folding of the end panels 14, 16 with respect to the main or engaging panel 12.

The applicator 620 is mounted to an overhead wheel which is adapted to maintain the orientation of the applicator 620 with respect to a conveyor (not shown). The applicator 620 is maintained substantially parallel with the conveyor, such that the engaging surface of the plate faces towards the articles B and/or conveyor throughout the rotation of the overhead wheel.

Referring now to FIGS. 13 to 19 there is shown alternative embodiments of a packaging system, article carriers and blanks, apparatus and applicators of the present disclosure. The alternative embodiments share many common features with the embodiments of FIGS. 1 to 12, therefore only the differences from the embodiment illustrated in FIGS. 1 to 12 will be described in any greater detail.

Figure 13:
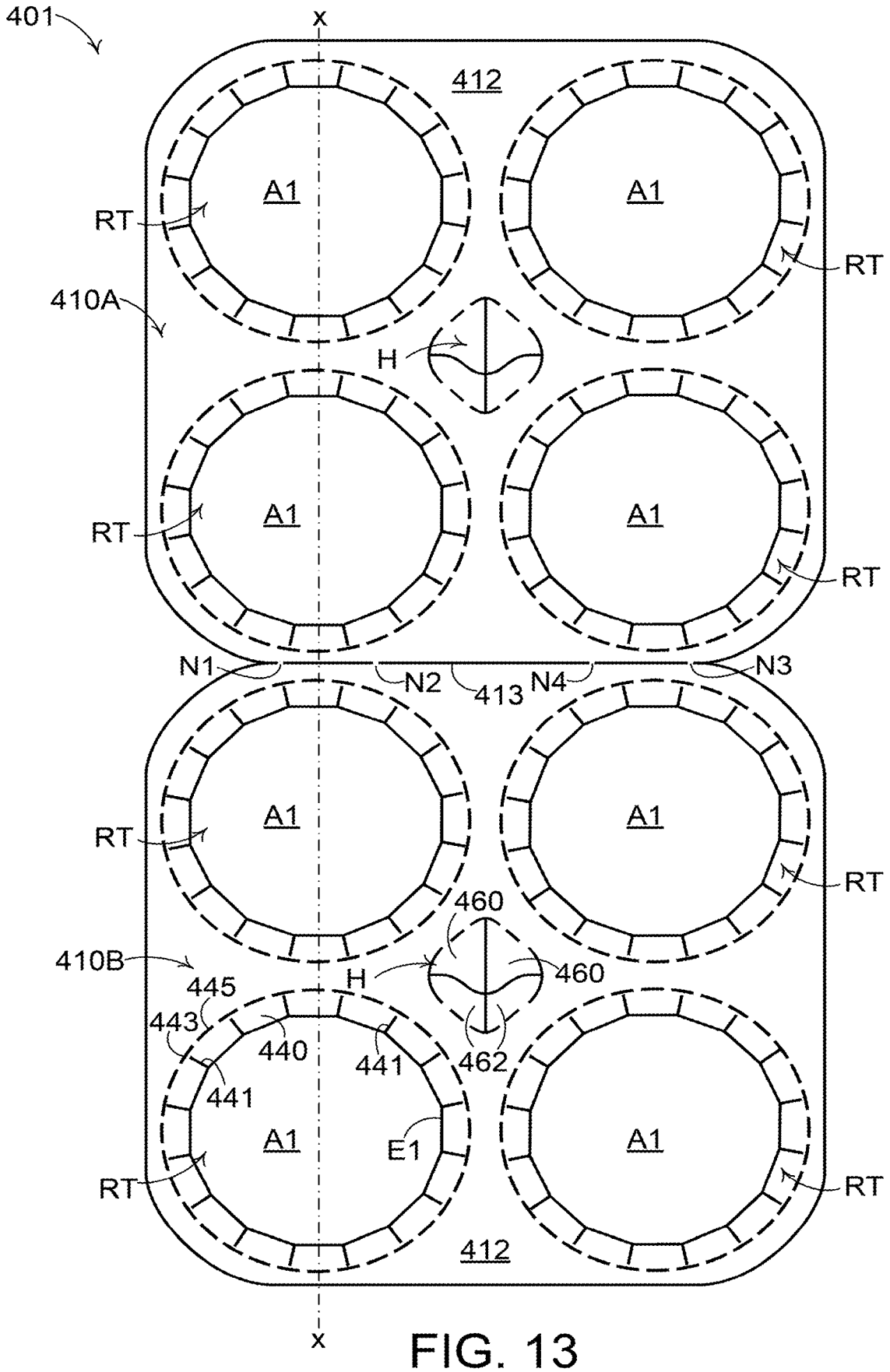
FIG. 13 is a plan view from above of a pair of connected blanks each for forming a carrier according to an embodiment of the present disclosure.
Figure 17:
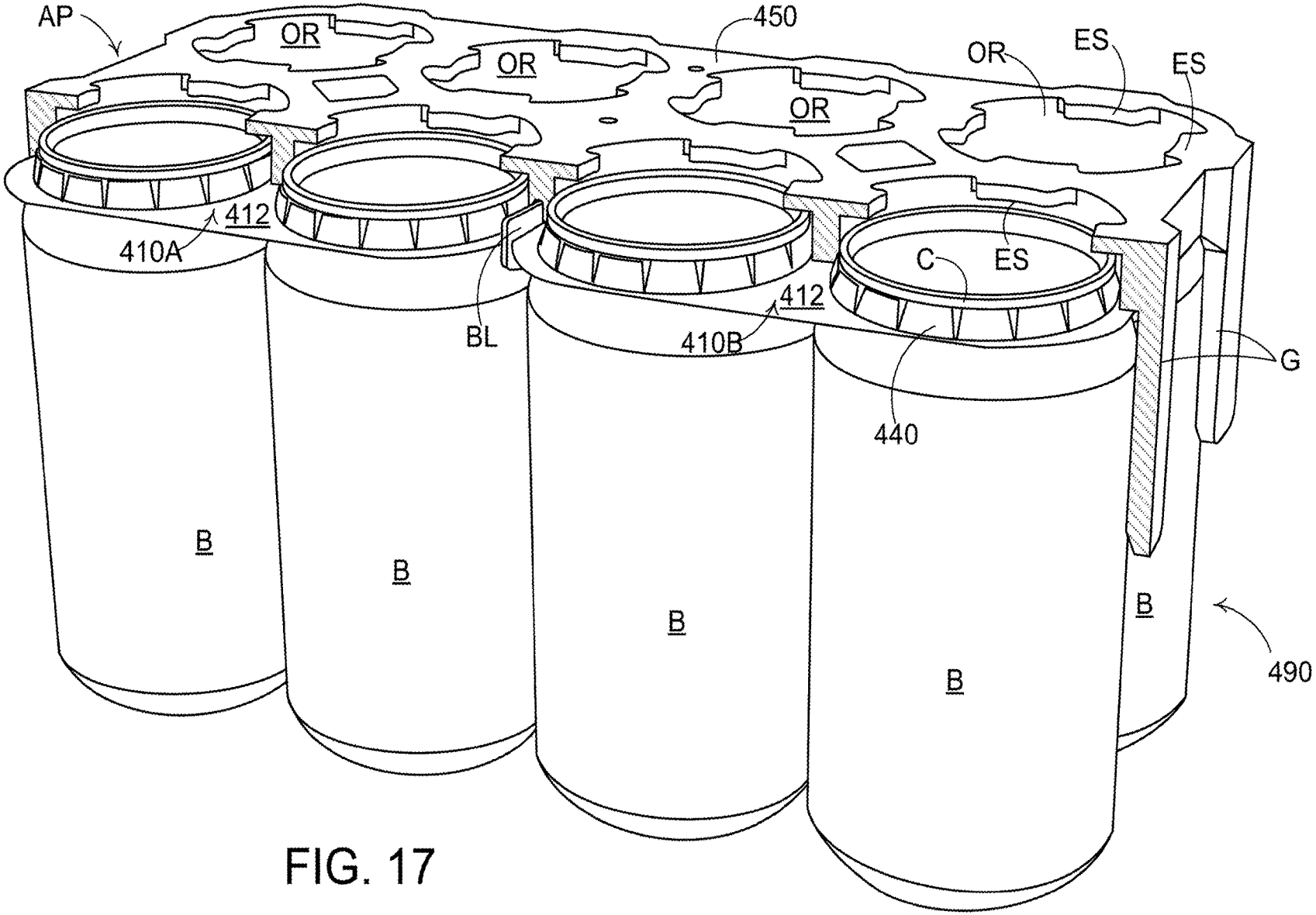

Referring to FIG. 13, there is shown a plan view of a pair of connected blanks 401 each of which is capable of forming a carton or carrier 490, as shown in FIG. 17, for containing and carrying a group of primary products such as, but not limited to, bottles or cans, hereinafter referred to as articles B, as shown in FIG. 17.

In the illustrated embodiments, the blanks 410A, 410B; are configured to form a carton or carrier 490 for packaging an exemplary arrangements of exemplary articles B. In the embodiment illustrated in FIG. 13, each blank 410A, 410B is configured to package article in a 2×2 matrix or array arrangement—two rows of two articles B are provided—and the articles B are beverage cans.

Alternatively, the blanks 410A, 410B may be configured to form a carrier for packaging other types, number and size of articles and/or for packaging articles in a different arrangement or configuration.

Referring to FIG. 13 there is shown a pair of connected blanks 401 comprising a first blank 410A and a second blank 410B. The second blank 410B is severable or frangibly connected to the first blank 410A by a frangible connection 413. Each of the blanks 410A, 410B comprises a main or engaging panel 412 for forming a top wall or an engaging panel of a carrier 490.

The frangible connection 413 may take the form of a plurality of cutlines spaced apart to define connecting nick or bridge portions N1, N2, N3, N4 therebetween. The bridge portions N1, N2, N3, N4 couple the first blank 410A to the second blank 410B. In the illustrated embodiment, the frangible connection 413 comprises four connecting nick or bridge portions N1, N2, N3, N4 arranged in pairs N1/N2, N3/N4. A first pair of connecting nicks N1/N2 is disposed between a first article retention structure RT in the first blank 410A and a second article retention structure RT in the second blank 410B. The second article retention structure RT is disposed adjacent to the first article retention structure RT and each lies upon a notional longitudinal line or axis x-x, the longitudinal line or axis x-x passing through the centre of each of the first and second article retention structures RT. The first pair of connecting nicks N1/N2 are disposed on opposite sides of the longitudinal line x-x. The longitudinal line x-x may define or pass through a region of closest proximity between an article B received in the first blank 410A and an article B received in the second blank 410B. The frangible connection 413 comprises a second pair of connecting nicks N3/N4 disposed between a third article retention structure RT in the first blank 410A and a fourth article retention structure RT in the second blank 410B. The second pair of connecting nicks N3/N4 are disposed on opposing sides of a notional line (not shown) extending longitudinally of the pair of connected blanks 401 and passing through the centres of each of the third and fourth article retention structures RT.

The main panels 412 include at least one article retention structure RT. In the illustrated embodiment, the main panels 412 each comprise a plurality of article retention structures RT specifically four article retention structures RT arranged in 2×2 matrix or array. Each of the main panels 412 comprises two columns of article retention structures RT, each column comprises two article retention structures RT. Each of the article retention structures RT comprises an aperture A1.

Each of the article retention structures RT is substantially similar in construction and will therefore be described in detail with reference to a first one of the article retention structures RT located adjacent to a first end of the second blank 410B as shown in FIG. 13.

The article retention structure RT comprises an article receiving opening defined in part by an aperture A1.

The article retention structure RT comprises a plurality of engaging teeth 440 disposed about the aperture A1.

The plurality of teeth 440 are hinged to the main panel 412 by a fold line. The fold line may be defined by a plurality of cut lines 443, 445. The plurality of cut lines 443, 445 may define or approximate a circle.

Each of the plurality of teeth 440 comprises an engaging edge E1 opposing a hinged edge. The engaging edges E1 are defined by a linear portion of a cut line defining the aperture A1. Each engaging edge E1 defines a part of a polygon. The illustrated embodiment comprises sixteen teeth 440. Each tooth 440 comprises a pair of side edges, the side edges are defined by cut lines 441 extending radially outward from respective vertices of the polygon. That is to say from a respective vertex between a pair of adjacent linear portions of the cut line defining the aperture A1. The cut lines 441 are divergently arranged with respect to each other and define an angle therebetween, the angle may be about 22.5°.

The article retention structure RT may comprise a plurality of first circumferential cut lines 443. Each of the plurality of first circumferential cut lines 443 is aligned with one of the radial cut lines 441 such that said one of the radial cut lines 441 or a notional extension thereof bisects a respective one of the plurality of first circumferential cut lines 443.

Each of the plurality of first circumferential cut lines 443 is spaced apart from said one of the radial cut lines 441 bisecting it so as to define a connecting nick or bridge portion between a pair of adjacently disposed teeth 440.

Each of the plurality of first circumferential cut lines 443 may be linear in shape.

The article retention structure RT may comprise a plurality of second circumferential cut lines 445. Each of the plurality of second circumferential cut lines 445 is disposed between a pair of the plurality of first circumferential cut lines 443 and is spaced apart therefrom so as to define a pair of connecting nick or bridge portions between each tooth 440 and the main panel 412. The pair of connecting nick or bridge portions provide a hinged or foldable connection between each tooth 440 and the main panel 412.

Each of the plurality of second circumferential cut lines 445 may be linear in shape. In alternative embodiments, each of the plurality of first circumferential cut lines 443 may be arcuate or curved. In alternative embodiments, each of the plurality of second circumferential cut lines 445 may be arcuate or curved.

In the illustrated embodiment, the radius of curvature of each of the plurality of second circumferential cut lines 445 is equal to the radius of curvature of each of the plurality of first circumferential cut lines 443 however in other embodiments it may be different.

The blanks 410A, 410B comprise a handle structure H. The handle structure H comprises a handle or finger opening disposed on a longitudinal axis bisecting the main panel 412. The handle opening is provided between a group of four article retention structures RT. The handle opening is provided centrally or medially of the main panel 412.

Each handle opening is defined by a plurality of tabs 460, 462. The handle openings comprise four tabs 460, 462. Each tab 460, 462 is hinged to the main panel 412 by a hinged connection in the form of a fold line. An arcuate or curvilinear cut line may be provided between each fold line to define a corner or vertex of the handle opening. The handle openings are substantially rhombus or diamond shaped, in other embodiments other shapes may be employed such as, but not limited to square. The handle openings comprise a pair of major tabs 460 and a pair of minor tabs 462.

The pair of major tabs 460 are separated from each other by a first cut line or severable line. The pair of minor tabs 462 are separated from each other by the first cut line or severable line. The pair of major tabs 460 are separated from the pair of minor tabs 462 by a second cut line or severable line.

The first cut line is colinear with a notional line passing longitudinally though the centre of the group of four article retention structures RT.

The first cut line may be linear in shape and may extend between a first pair of opposed vertices of the handle opening. The second cut line may be non-linear in shape and may extend between a second pair of opposed vertices of the handle opening. The second cut line intersects the first cutline, the second cut line comprises a "V" or "U" shaped medial portion; a vertex of the "V" or "U" shaped portion intersects the first cutline.

One of the pair of major tabs 460 is hinged to the main panel 412 by a first fold line. The other one of the pair of major tabs 460 is hinged to the main panel 412 by a second fold line. The first fold line is divergently arranged with respect to the second fold line.

One of the pair of minor tabs 462 is hinged to the main panel 412 by a third fold line. The other one of the pair of minor tabs 462 is hinged to the main panel 412 by a fourth fold line. The third fold line is divergently arranged with respect to the fourth fold line.

The first fold line is divergently arranged with respect to the third fold line. The second fold line is divergently arranged with respect to the fourth fold line.

The handle openings may form a stabilisation device during application of the blanks 410A, 410B to a group of articles B. The stabilisation devices are configured to receive an abutment peg or dog (described in further detail below).

The opening of the stabilisation devices may be non-circular in shape, and may be substantially square or diamond shaped.

A peg or dog may be provided for engaging the blanks 410A, 410B via the handle opening to prevent or inhibit linear or rotation movement of the blanks 410A, 410B with respect to the dog. The dog may be mounted to, or integral with, an applicator device, described in more detail below, for applying the blanks 410A, 410B to a group of articles B.

The opening of the stabilization device or handle opening may comprise at least one flat or linear portion for engaging a complementary flat or linear portion of the dog. In other embodiments, the stabilization device or handle opening may comprise at least one generally "V" or "U" shaped portion for engaging a complementary portion of the dog.

Figure 14:
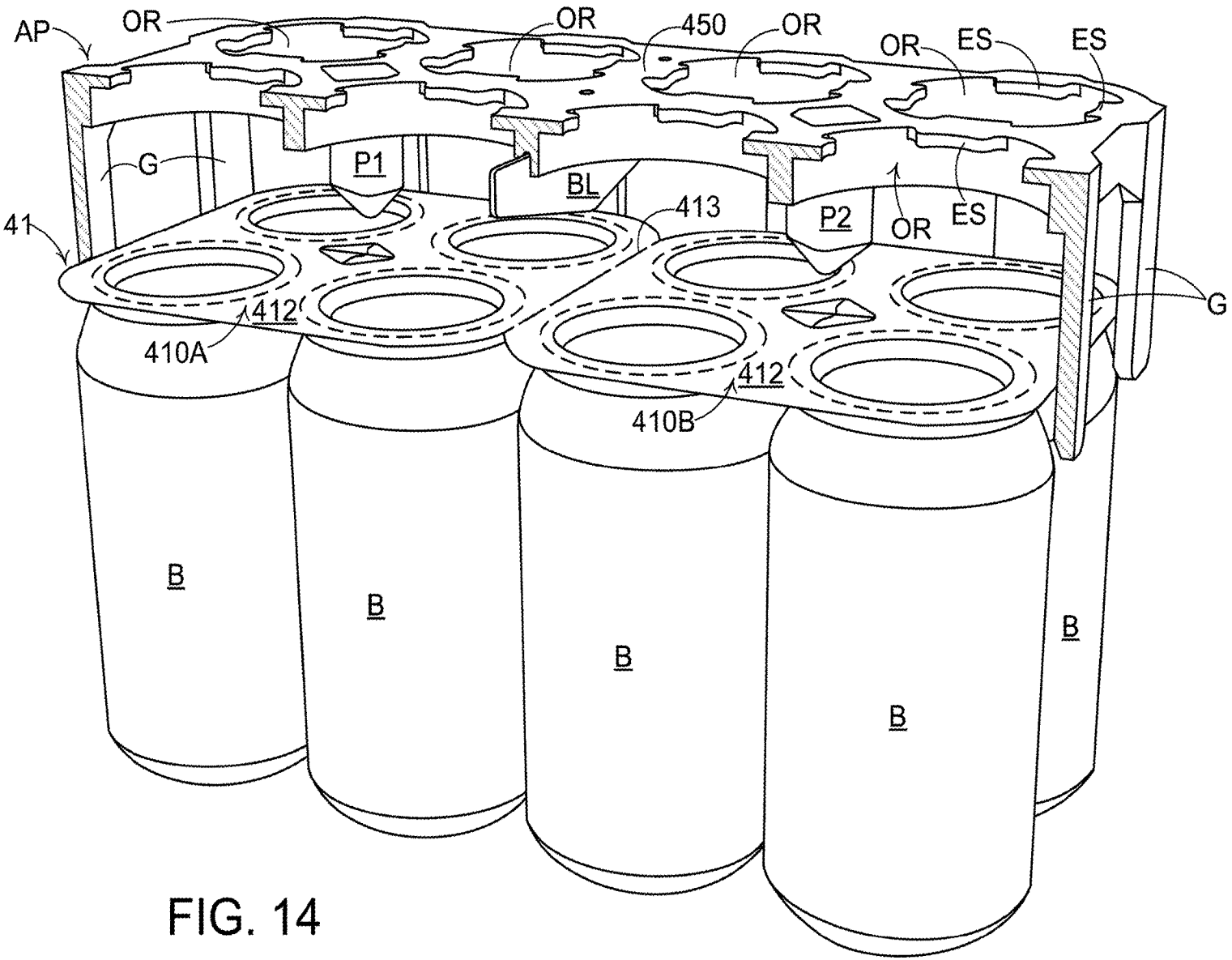
FIGS. 14 to 17 illustrate stages of construction of the connected blanks of FIG. 13 into carriers by an applicator device.
Figure 15:
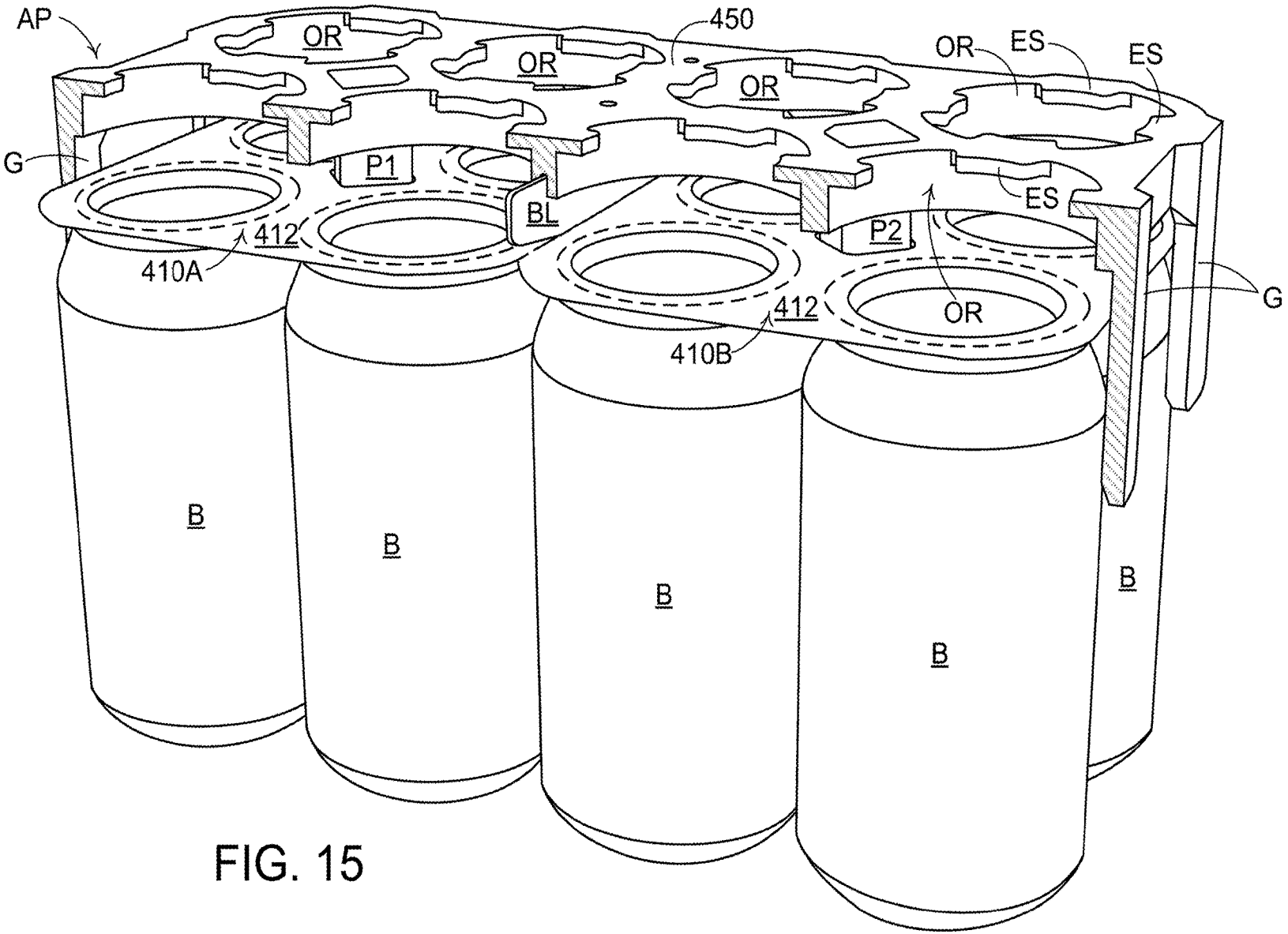

The blanks 410A, 410B are applied simultaneously to a pair of article groups. The main panels 412 of each blank 410A, 410B is applied to one of the groups of articles B. The pair of connected blanks 401 is lowered with respect to the articles B to be at rest thereupon as shown in FIG. 14.

An applicator device AP is provided to engage the blanks 410A, 410B with the articles B. The applicator device AP comprises a plate or body 450 from which a plurality of guides G may extend. The guides G depend downwardly from the plate 450 and ensure the articles B are maintained in the desired configuration or arrangement to be received by the blanks 410A, 410B. The guides may also ensure or retain the pair of connected blanks 401 in alignment with the groups of articles B. In the illustrated embodiment, the guides G take the form of a plurality of fingers or elongate members however in other embodiments the guides may take the form of vertical walls depending downwardly from the plate 450 so as to surround at least an upper portion of the pair of article groups.

The applicator device AP comprises a pair of posts P1, P2 forming retention or stabilising pins or lugs depending from the lower or engaging surface of the plate 450. The illustrated embodiment comprises two stabilising pins, best shown in FIG. 14. In FIGS. 14 to 17 a portion of the applicator device AP has been cutaway, as indicated by hatching, for illustrative purposes. As the applicator device AP is lowered over the pair of connected blanks 401 and articles B, a first post P1 engages the stabilisation device provided by the handle opening of the first blank 410A. A second post P2 engages the stabilisation device provided by the handle opening of the second blank 410B, best shown in FIG. 15. The tabs 460, 462 of the handle structures H are folded out of the plane of the main panels 412 as the stabilising pins are received.

A disconnecting device BL depends from a lower surface of the plate 450, the disconnecting device BL may take the form of a blade mounted substantially perpendicularly with respect to the lower surface of the plate 450. The disconnecting device BL extends transversely across the plate 450.

As the applicator device AP is lowered further with respect to the pair of connected blanks 401 and articles B, the post P1, P2 are inserted further through the handle openings, the disconnecting device BL is aligned with the frangible connection 413 and moves downwardly with respect thereto. In doing so the disconnecting device BL severs or cleaves the connecting nicks or bridge portions N1, N2, N3, N4 thereby separating the first and second blanks 410A, 410B from each other.

Figure 16:
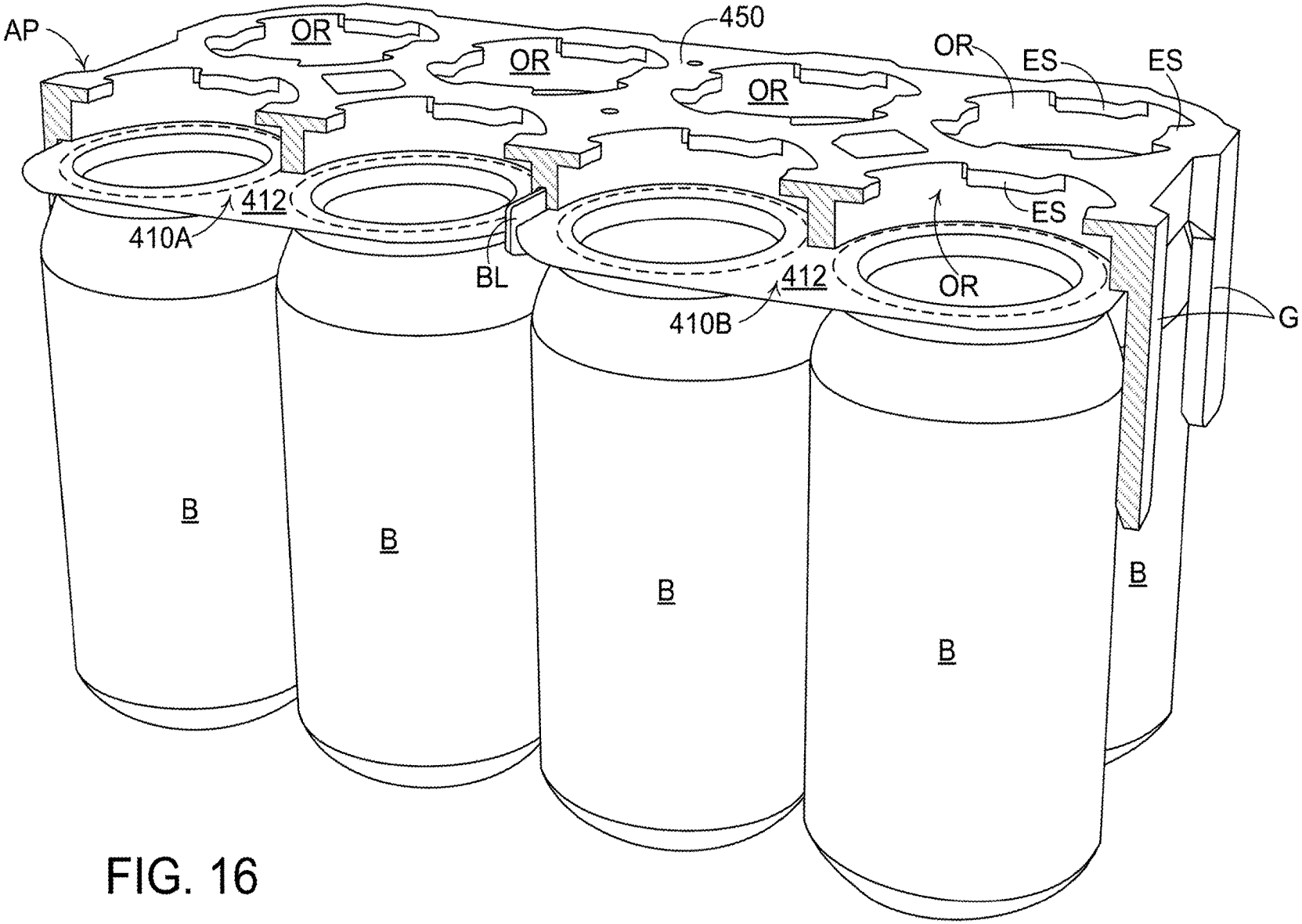

Continued lowering of the applicator device AP with respect to the pair of blanks 410A, 410B and articles B brings a lower or engaging surface of the plate 450 into contact with the blanks 410A, 410B, as shown in FIG. 16.

The lower or engaging surface of the plate 450 comprises a plurality of recesses or orifices OR each adapted to receive an upper portion of an article B. The illustrated embodiment comprises eight orifices OR arranged in 2×4 matrix or array. The orifices OR may be at least partially blind, that is to say they comprise an end stop ES preventing the articles B from passing through the plate 450.

The stabilising pins are now fully inserted into the stabilisation devices so as to prevent or inhibit movement of the pair of blanks 410A, 410B with respect to the applicator AP and retain each blank 410A, 410B in correct alignment with the articles B.

The applicator AP is lowered still further with respect to the articles B so as to press the blanks 410A, 410B over the upper ends of the articles B. The applicator AP presses the blanks 410A, 410B downwardly such that an article B is received in each of the article retention structures RT. The tabs 440 are folded out of the plane of the engaging panels 412 and engage below a flange or other suitable projection provided on the articles B, best shown in FIG. 17 to form packages.

The applicator AP is raised with respect to the packages, the assembled packages may be conveyed to further processing stations or to a point of sale.

Figure 18:
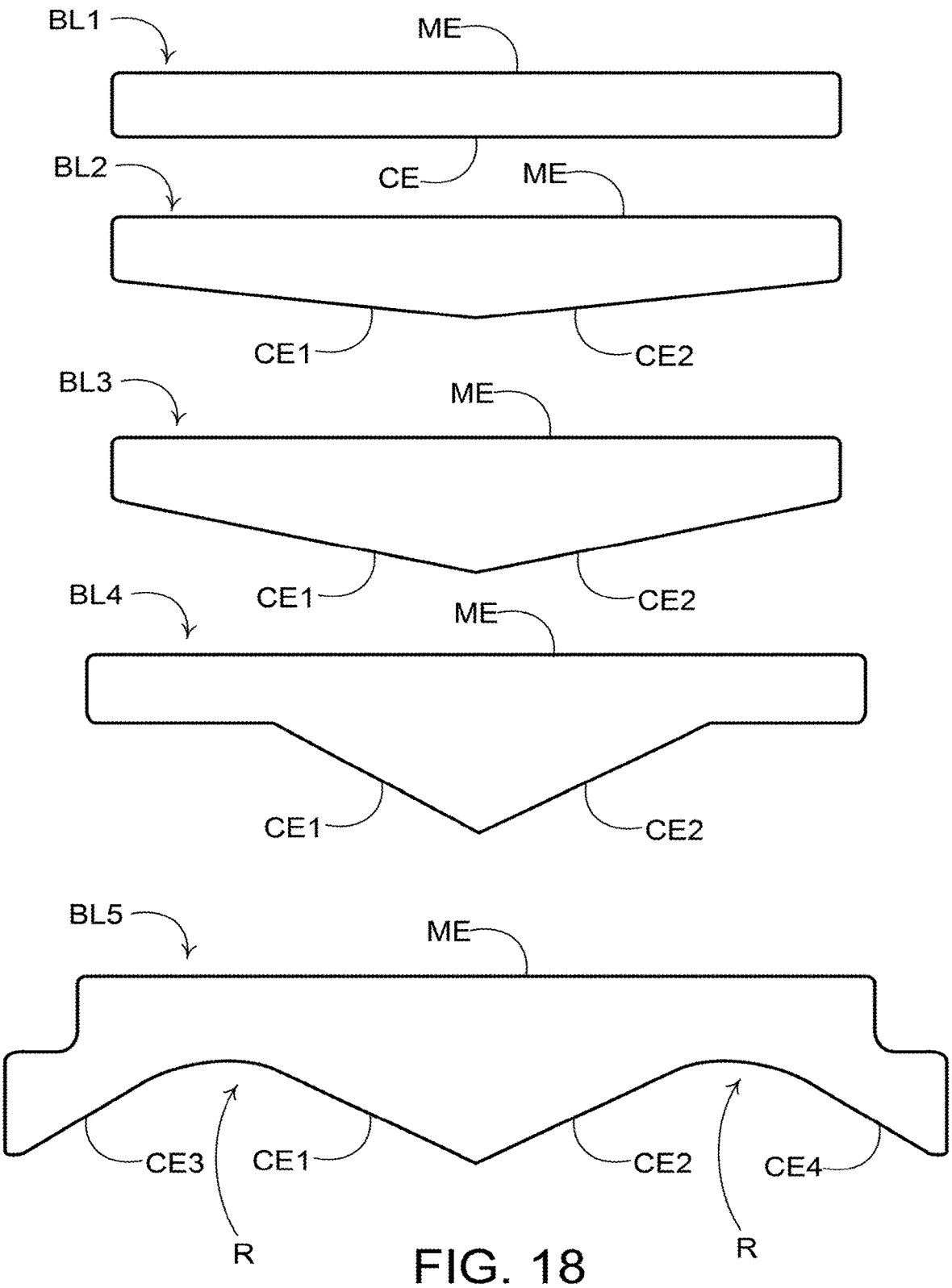
FIG. 18 illustrates disconnecting blades according to various embodiments for use with an applicator device.

FIG. 18 illustrates a number of alternative blade configurations BL1, BL2, BL3, BL4, BL5. A first blade BL1 comprises a single breaking edge CE which is parallel to a mounting edge ME. The entirety of the breaking edge CE engages the frangible connection simultaneously when in use.

A second blade BL2 comprises a pair of breaking edges CE1, CE2 arranged divergently with respect each other to form a point or vertex. Each of the pair of breaking edges CE1, CE2 is non-parallel, or divergently arranged, with respect to a mounting edge ME.

A third blade BL3 is shown in FIG. 18, the third blade BL3 is substantially similar to the second blade BL2 albeit the pair of breaking edges CE1, CE2 are arranged such that a smaller internal angle is defined therebetween.

A fourth blade BL4 is shown in FIG. 18, the fourth blade BL4 is substantially similar to the second and third blades BL2, BL3 albeit the pair of breaking edges CE1, CE2 are arranged such that a smaller internal angle is defined therebetween. In order to achieve this without substantially increasing the height of the fourth blade BL4 each of the pair of breaking edges CE1, CE2 comprises a marginal portion arranged substantially parallel with the mounting edge ME.

A fifth blade BL5 is shown in FIG. 18, the fifth blade BL5 comprises a recess, scalloped or serrated breaking edge. The fifth blade BL5 comprises four divergently arranged breaking edges CE1, CE2, CE3, CE4. A first breaking edge CE1 and a second breaking edge CE2 are divergently arranged with respect each other to form a point or vertex substantially at a centre or medial region of the fifth blade BL5. Third and fourth breaking edges CE3, CE4 are provided at marginal regions of the fifth blade BL5. The third breaking edge CE3 is divergently arranged with respect to the first breaking edge CE1 to define a recess R therebetween. The fourth breaking edge CE4 is divergently arranged with respect to the second breaking edge CE2 to define a recess R therebetween.

The third breaking edge CE3 may be arranged to be parallel to the second breaking edge CE2. The fourth breaking edge CE4 may be arranged to be parallel to the first breaking edge CE1.

The fifth blade BL5 may be considered to have a plurality of breaking edges or blades CE1, CE2, CE3, CE4 mounted to a common base or mounting body.

The fifth blade BL5 may be advantageous when separating a pair of blanks 410A, 410B in which the articles B in a first group being engaged by the first blank 410A are in contact or close proximity to the articles B in a second group being engaged by the second blank 410B. The recesses R avoid a region of contact or close proximity between pairs or cylindrical articles B. In this way the fifth blade BL5 avoids contact or impact with the articles B.

Figure 19:
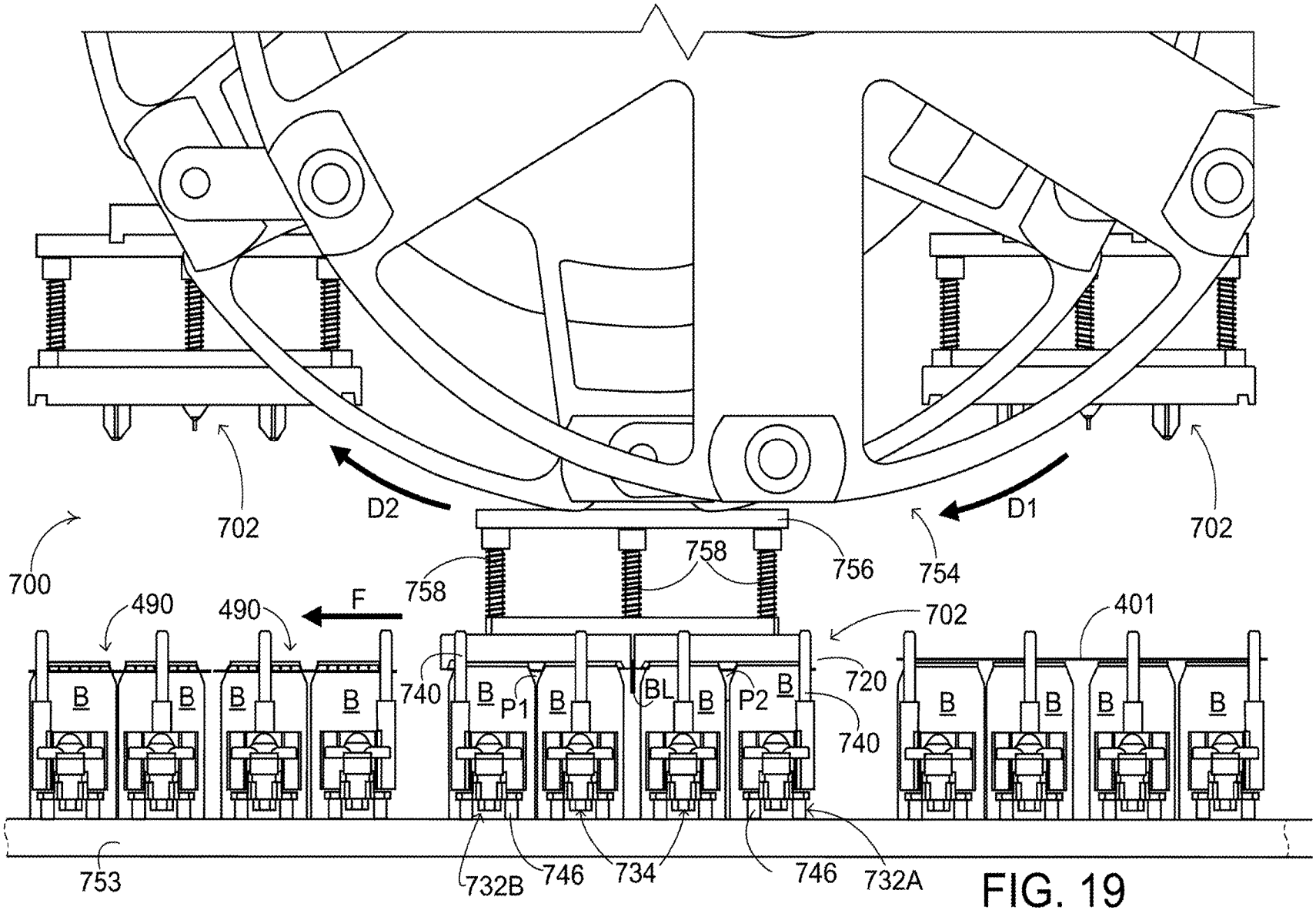
FIG. 19 is a side view of a packaging apparatus forming a part of a packaging system according to embodiments of the present disclosure.
Figure 20:
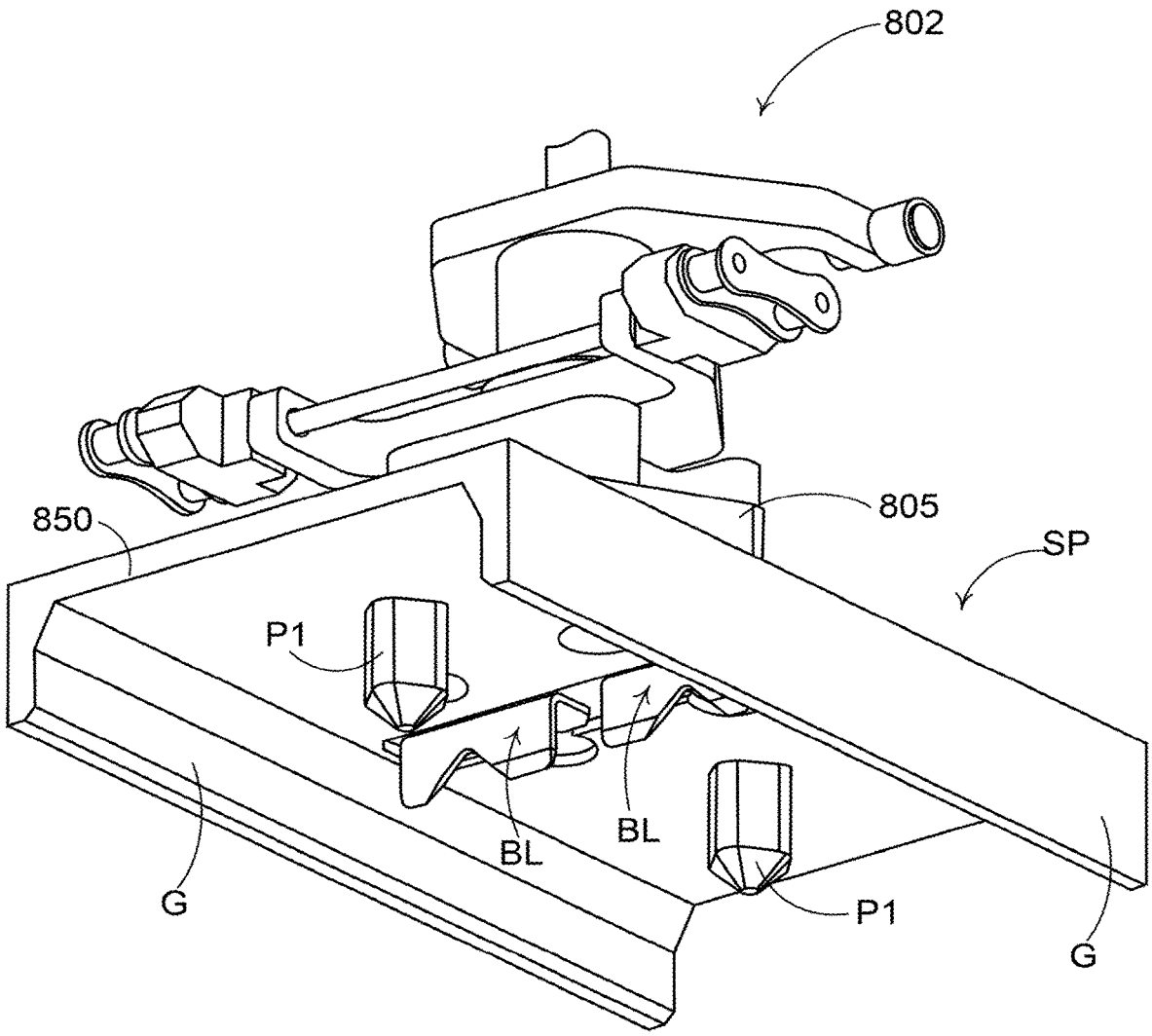
FIG. 20 is a perspective view from below of a separation device forming a part of a packing system according to alternative embodiments of the present disclosure.
Figure 21:
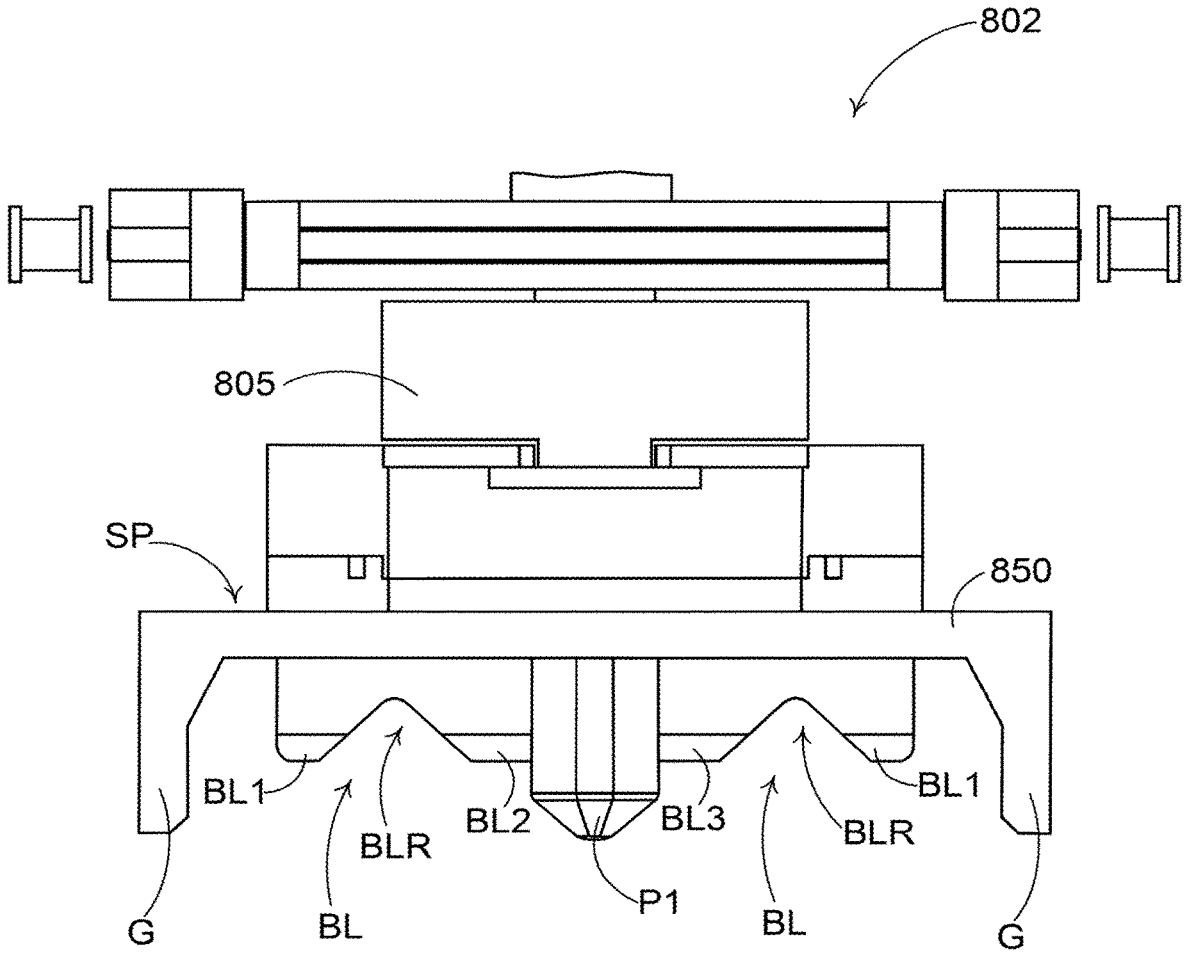
FIG. 21 is an end view of the separation device of FIG. 20.

Referring now to FIG. 19 there is shown a packaging apparatus configured to automate application of the pair of connected blanks 401 to groups of articles B. The packaging apparatus comprises a plurality of tool heads 702 mounted to an overhead wheel arrangement 754.

The overhead wheel arrangement 754 is adapted to maintain the orientation of an applicator 720 with respect to a conveyor 753. The applicator 720 is shown in a cutaway view, as indicated by hatching, for illustrative purposes to illustrate posts P1, P2 mounted thereto. The applicator 720 is maintained substantially parallel with the conveyor 753, such that the engaging surface of the plate 450 faces towards the articles B and/or conveyor throughout the rotation of the overhead wheel.

The applicator 720 is moveably mounted to the tool head 702, and is resiliently biased towards the conveyor 753 by spring mounts 758 depending from a mounting plate 756.

The applicator 720 differs from that shown in FIGS. 13 to 17 in that the guides G have been omitted, instead the pair of connected blanks 401 are aligned with respect to the articles B by reference posts 740 mounted to article engaging tools 732A, 732B, 734.

The packaging apparatus comprises a grouping and metering apparatus and an overhead applicator for applying the pair of connected blanks 410 to metered groups of articles B.

The metering apparatus comprises a first plurality of article engaging tools 732A, 732B, 734 for engaging, metering and driving a first column of articles B through the packaging apparatus. The metering apparatus comprises a second plurality of article engaging tools (not illustrated in FIG. 19), configured in a similar manner to those shown in the embodiments of FIGS. 7 to 11 for engaging, metering and driving a second column of articles B through the packaging apparatus. The second plurality of article engaging tools is arranged in opposition to the first plurality of article engaging tools 732A, 732B, 734.

Each of the article engaging tools 732A, 732B, 734 is coupled to or comprises a drive mechanism to propel each of the first and second plurality of article engaging tools 732A, 732B, 734 about a respective track or loop.

Each of the article engaging tools 732A, 732B, 734 is coupled to or mounted to a track a respective track or loop (not shown) having a working reach and a return reach. The article engaging tools 732A, 732B, 734 may comprise a magnet (not shown) for holding the article engaging tools 732A, 732B, 734 to the track. The track comprises a drive mechanism for driving the article engaging tools 732A, 732B, 734 about the track. The drive mechanism may take the form of a linear motor. A stator comprising coils is mounted to the track and generates propulsive force by acting upon the magnet to drive the article engaging tools 732A, 732B, 734 about the track. Each of the article engaging tools 732A, 732B, 734 can be independently or individually controlled, in this way the pitch between article engaging tools 732A, 732B, 734 can be varied and the article engaging tools 732A, 732B, 734 can be individually accelerated or decelerated.

Each article engaging tools 732A, 732B, 734 in the first plurality of article engaging tools 732A, 732B, 734 is driven in synchronicity with a respective one of the article engaging tools in the second plurality of article engaging tools, at least through a working reach of the packaging apparatus.

The packaging apparatus may merge a first stream of articles B with a second stream of articles B, the first plurality of article engaging tools 732A, 732B, 734 engaging articles from the first stream and the second plurality of article engaging tools engaging articles from the second stream.

Each article engaging tool 732A, 732B, 734 comprises a carriage having at least one wheel or follower 746, in some embodiments two, three, four or more wheels or followers 746 may be provided on each carriage and engage with the track.

Each carriage comprises a head detachably mounted thereto by a securing mechanism. In some embodiments, the lock mechanism may take the form of a bayonet style fitting or mount. In this way the head is readily separated from the carriage and may be interchanged, swapped or replaced. This allows the head to be changed for a different head to accommodate a different carton blank or article B or to enable replacement of a damaged or broken head.

Each of the heads comprises a gripper or scoop providing at least one engaging surface for engaging an article B. The gripper comprises a pair of fingers or limbs defining a recess or channel arranged to accommodate a portion of the article B.

Each of the heads may comprise a reference pin or post 740 extending upwardly therefrom. The reference pin 740 is mounted to the head at a first proximal end and extends upwardly to a distal free end. The distal free end is disposed at an elevation above the upper end of the articles B. In this way the reference pin 740 is configured to engage with the pair of connected blanks 401 when placed upon the upper ends of the articles B in the groups of articles B. The heads forming leading and trailing article engaging tools 732A, 732B may comprise a first reference pin or post 740. The heads forming intermediate article engaging tools 734 may comprise an optional second reference pin or post. The second reference pin or post may be offset, in a direction transverse to the article flow direction F, with respect to the first reference pins 740 provided by the leading and trailing article engaging tools 732A, 732B.

The reference pin 740 is arranged to be located between a leading portion of the head and a trailing portion of the head. The reference pin 740 is located upstream of a downstream end, edge or wall of the article B engaged by the head to which it is mounted and the reference pin 740 is located downstream of an upstream end, edge or wall of the article B engaged by said head.

The reference pin 740 may be disposed within the footprint of the carriage and/or head. In this way two adjacent carriages or head can be brought into close proximity without interference by the reference pin 740 or its mounting. This enables two or more article engaging tools 732A, 732B, 734 to bring two or more articles B into close proximity or to engage two or more articles B which are disposed in close proximity.

In order to form metered groups of articles B pairs of article engaging tools 732A, 732B, 734 bring together pairs of articles B, one from each of the first and second columns or streams of articles B.

Two or more pairs of article engaging tools 732A, 732B, 734 may be employed to form a at least two groups of articles B, in the illustrated embodiment, four pairs of article engaging tools 732A, 732B, 734 form two groups of four articles B each in a 2×2 matrix or array.

In order to form the groups, the leading pair of article engaging tools 732B may be retarded to allow the intermediate pairs of article engaging tools 734, and the trailing pair of article engaging tools 732A to catch up with the pair of article engaging tools 732A, 732B, 734 disposed downstream thereof. In some embodiments, at least a first pair of intermediate article engaging tools 734 catches up with the leading pair of article engaging tools 732B, at least a second pair of intermediate article engaging tools 734 follows a predefined distance behind the at least first pair of intermediate article engaging tools 734, the trailing pair of article engaging tools 732A catches up with the at least second pair of intermediate article engaging tools 734. Once each upstream pair of article engaging tools 732A, 732B, 734 catch the adjacent downstream pair of article engaging tools 732A, 732B, 734, they too may be retarded to match the speed of said downstream pair. In alternative embodiments, it will be appreciated that speed of an upstream pair of article engaging tools 732A, 732B, 734 may be increased or accelerated to catch an adjacent downstream pair of article engaging tools 732A, 732B, 734.

As the article engaging tools 732A, 732B, 734 form the groups of articles B the connected blanks 401 are lowered onto the upper ends of the articles B forming the groups.

The overhead wheel arrangement brings the applicator 720 into contact with the connected blanks 401 substantially similarly to the applicator AP of FIGS. 14 to 17 to applying the blanks 410A, 410B to the articles B.

Figure 22:
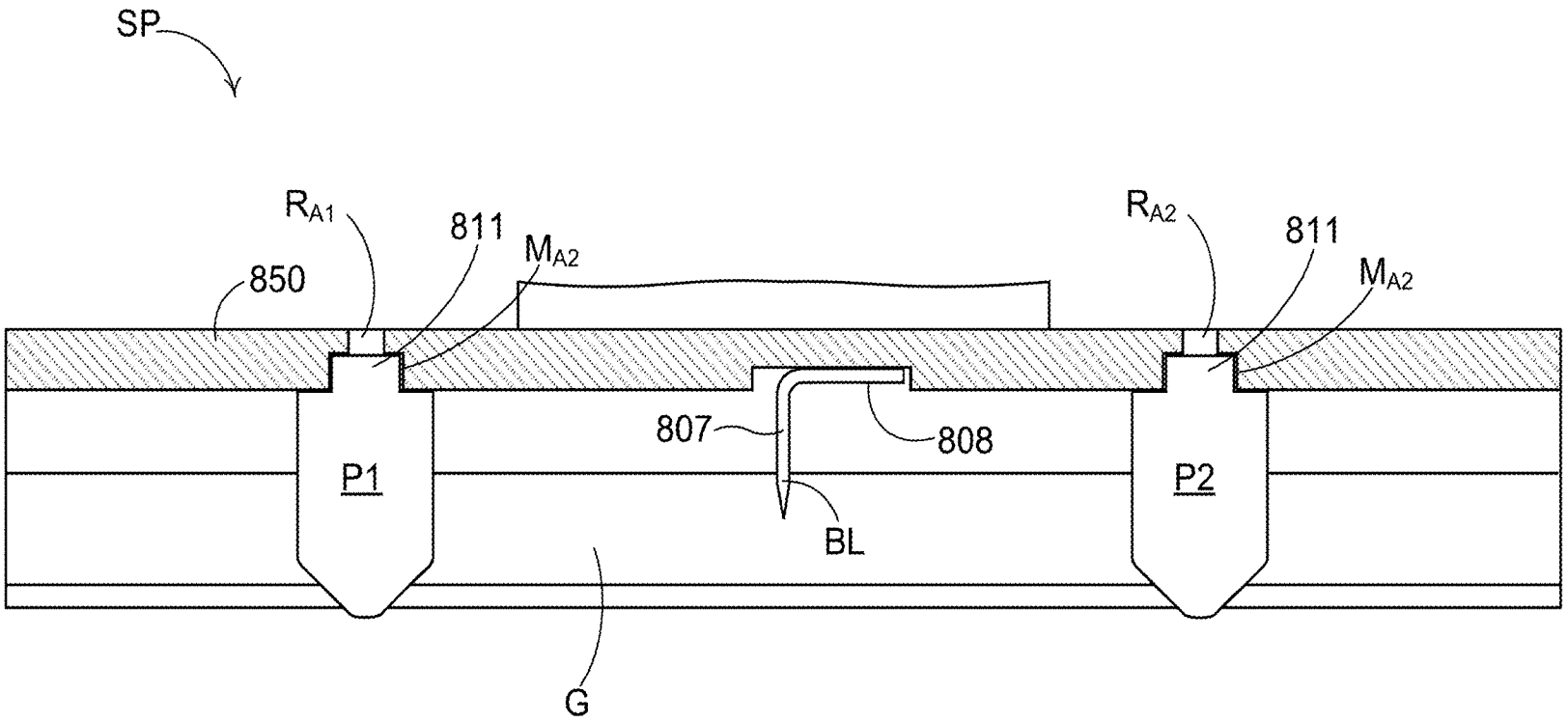
FIG. 22 is a sectional view of the separation device of FIG. 20.
Figure 23:
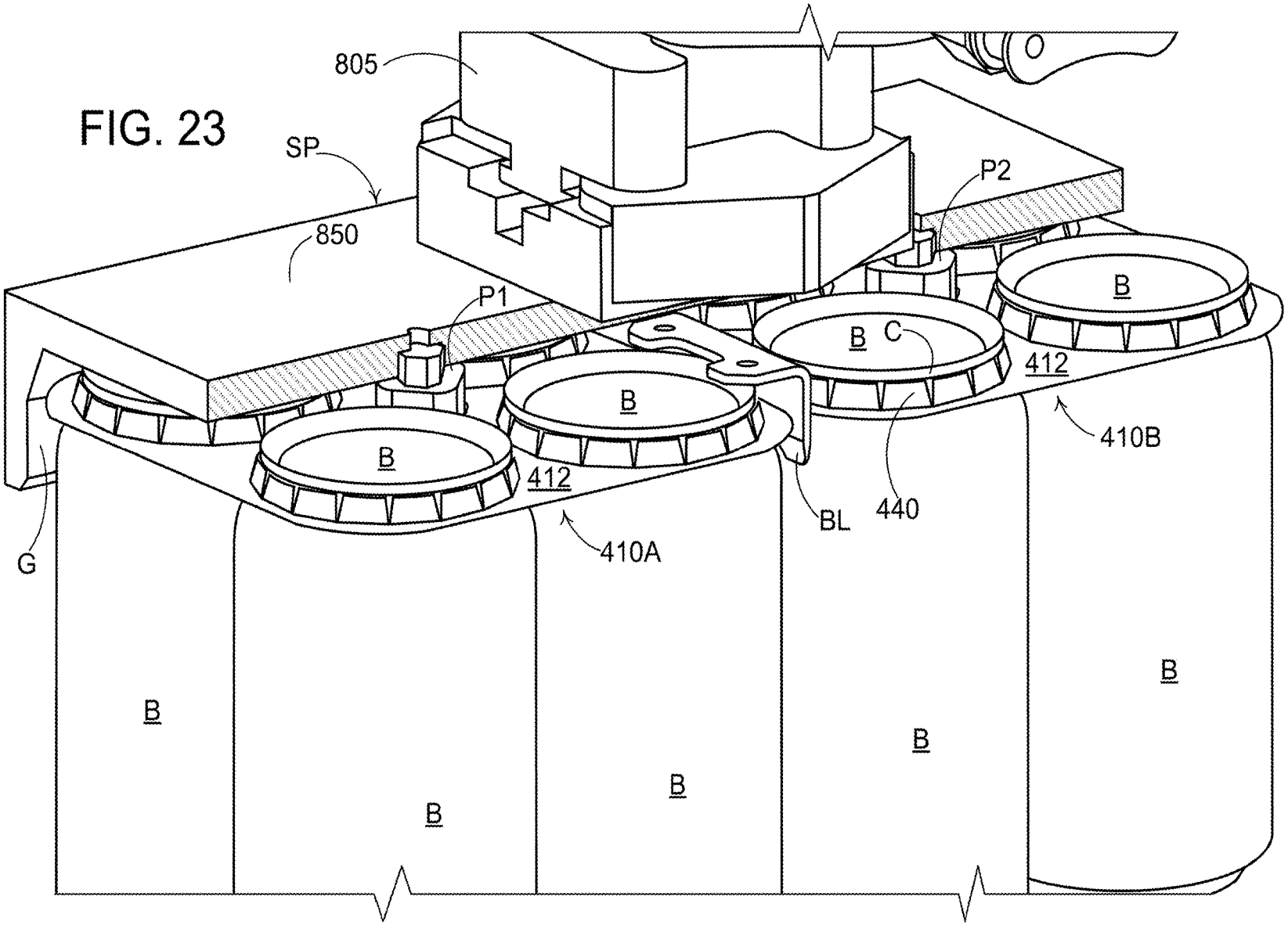
FIG. 23 is a cutaway view of the separation device of FIG. 20 in operational engagement with a plurality of packaged groups of articles.
Figure 24:
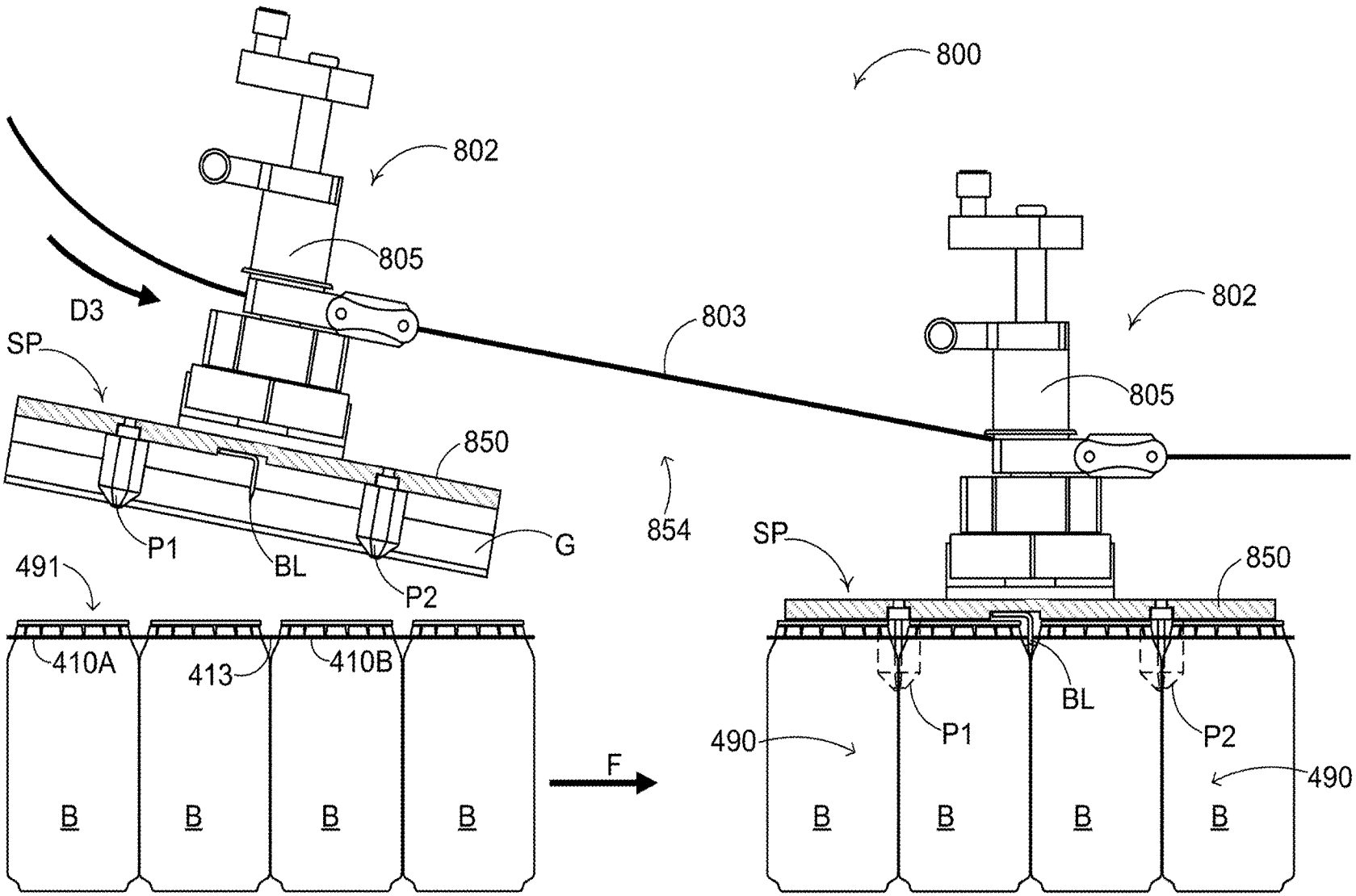
FIG. 24 is a side view of a packaging apparatus showing various stages of operation of separation devices according to the embodiment of FIG. 20.

Referring now to FIGS. 20 to 24 there is shown a packaging apparatus 800, best shown in FIG. 24, configured to automate separation of a pair of connected article carriers 491. A pair of connected blanks 401 such as those illustrated in FIG. 13 and described above have been applied to a plurality of groups of articles B to from the connected article carriers 491 at a previous station (not shown) of a packaging machine; the previous station may be similar in configuration to the apparatus of FIG. 12 and described above albeit with omission of the second stabilising peg or pin 654, the folding dies or brakes may be omitted or replaced with alignment guides. The packaging apparatus 800 comprises at least one tool head 802 mounted to an overhead conveyor arrangement 854 disposed over an article conveyor (not shown). The tool heads 802 are arranged to move in synchronicity with the article conveyor over a working reach of the overhead conveyor arrangement 854. The connected article carriers 491 are transferred downstream, indicated by direction arrow F, upon the article conveyor. The illustrated embodiment comprises a plurality of tool head 802 mounted to a track 803 and driven thereabout by a drive mechanism. In some embodiments, the drive mechanism may take the form of a chain or belt arranged as an endless loop. In other embodiments, each tool head 802 may be independently driven about the track 803, each tool head 802 may comprise a drive motor or the drive mechanism may take the form of a linear motor similar to that described above in relation to the article engaging tools 432A, 432B, 434 of FIG. 7.

Each tool head 802 comprises a chassis or carriage coupling a separator SP to the track 803. The separator SP comprises a plate or frame 850 from which a pair of guides G depends. The pair of guides G are spaced apart from each other and arranged in opposition to each other. The guides G engage with opposing side of the connected article carriers 491. The guides G prevent or inhibit movement of the connected article carriers 491 in a direction transverse to the flow direction F. In FIGS. 22 to 24 portions of the separator SP have been cutaway or removed for illustrative purposes and only one guide G is shown.

The separator SP comprises at least one at least one stabilisation peg P1, P2 depending from the plate 850. The illustrated embodiment comprises a pair of stabilisation pegs P1, P2 depending from the plate 850. Each of the pair of stabilisation pegs P1, P2 engages with a respective one of the connected article carriers 491.

Each stabilisation peg P1, P2 is received in a handle or finger opening provided in the main panel 412 of each connected article carriers 491. The stabilisation pegs P1, P2 prevent or prevent or inhibit movement of the connected article carriers 491 whilst the separator SP divides the connected article carriers 491 into individual, discrete, disconnected, article carriers 491. Each stabilisation pegs P1, P2 comprises a fixture 811 mounting the stabilisation peg P1, P2 to the plate 850. The fixture 811 is received in a mounting orifice $M_{A1}$, $M_{A2}$ provided in a lower or inner surface of the plate 850. The mounting orifice $M_{A1}$, $M_{A2}$ and the fixture 811 may be shaped as to be coded or keyed to a specific mounting location or orientation. That is to say first post P1 is shaped to be mounted in first mounting orifice $M_{A1}$ and second post P1 is shaped to be mounted in second mounting orifice $M_{A2}$; or each post P1, P2 is mounted in a predefined orientation with respect to the plate 850.

The stabilisation peg P1, P2 may be detachably or removably mounted to the applicator AP; 720. An aperture $R_{A1}$, $R_{A2}$ may be provided in an upper or outer surface of the plate 850, the aperture $R_{A1}$, $R_{A2}$ is in vertical registry with a respective one of the mounting orifices $M_{A1}$, $M_{A2}$. The aperture $R_{A1}$, $R_{A2}$ may be provided to secure the stabilisation peg P1, P2 to the plate 850 enabling a fastener, such as, but not limited to a screw or bolt to pass through the plate 850 and in to the stabilisation peg P1, P2. In some embodiments, the aperture $R_{A1}$, $R_{A2}$ may be provided to facilitate removal or replacement of the stabilisation peg P1, P2 enabling a tool to be inserted through the plate 850 and providing access to the fixture 811 to press or push the fixture 811 of the stabilisation peg P1, P2 out of the mounting orifice $M_{A1}$, $M_{A2}$, this may be advantageous when the fixture 811 is keyed and cannot be rotated within the mounting orifice $M_{A1}$, $M_{A2}$.

The separator SP comprises at least one disconnecting or separating device BL. The at least one disconnecting or separating device BL may comprise one or more blades BL1, BL2, BL3, BL4 arranged to avoid collision with the articles being packaged. The illustrated embodiment comprises a pair of disconnecting or separating devices BL each comprising a pair of blades BL1/BL2, BL3/BL4 best shown in FIG. 21. A recess BLR separates a first blade BL1, BL3 from a second blade BL2, BL4 in each of the pairs of blades BL1/BL2, BL3/BL4. The recess is configured and arranged to avoid collision of the separating devices BL with the articles B in the article carriers 490. Each blade BL1, BL2, BL3, BL4 is mounted to or integral with a bracket mounted to the plate 850. The bracket comprises a base or mounting foot 808 and a leg 807 extending therefrom, the leg may be arranged to substantially perpendicular to the base 80 and to the plate 850. The base 808 may be mounted within a recess or channel in a lower surface of the plate 850. In other embodiments the blades BL1, BL2, BL3, BL4 and support bracket may be integral with the plate 850.

FIG. 24 illustrates the separator SP being lowered with respect to the connected article carriers 491 and brought into contact or engagement with the connected article carriers 491, the stabilisation peg P1, P2 being received in the handle openings and the separator device BL breaking the connection 413 between the article carrier 490. The separator SP is subsequently raised (not shown) with respect to the article carriers 490, the tool heads 802 are return to the start of the working reach of the apparatus 800 to separate a subsequent group of connected article carriers 491.

The present disclosure provides a carrier 90; 190; 390; 490 of the top engaging type having article retention structures RT1, RT2 for engaging articles B and a blank 10; 110; 310; 410A-B for forming the article carrier 90; 190; 390; 490.

The carrier 90; 190; 390; 490 comprises a main panel 12; 112; 312; 412 having one or more article retention structures RT1, RT2 for receiving and securing the main panel 12; 112; 312; 412 to a respective article B. The carrier 90; 190; 390 may comprise a pair of opposing side panels 18, 20; 118, 120; 314, 316 hingedly connected to the main panel 12; 112; 312 by a hinged connection.

The carrier 90; 190; 390 may comprise a pair of opposing end panels 14, 16; 114A, 114B, 116A, 116B; 324, 334 hingedly connected to the main or engaging panel 12; 112; 312 by a hinged connection.

The blank 10; 110; 310; 410A-B comprises a peripheral edge a portion of which may provide at least one registration edge shaped to inhibit movement in two orthogonal directions when engaged by a reference device or pin 440; 540; 640; 740.

The carrier 90; 190; 390 may comprise a panel 18, 20; 118, 120; 318, 320 hinged to the main panel 12; 112; 312, the panel 18, 20; 118, 120; 318, 320 comprising a registration edge shaped to inhibit movement in two orthogonal directions.

The carrier 90; 190; 390 may comprise a pair of panels 18, 20; 118, 120; 318, 320 hinged to the main panel 12; 112; 312 on opposing sides thereof, the pair of panels 18, 20; 118, 120; 318, 320 each comprise a registration edge shaped to inhibit movement in two orthogonal directions.

A linear notional line N1, N2 passing through the registration edge in each of pair of panels 18, 20; 118, 120; 318, 320 passes through an opening in the main panel 12; 112; 312 defined by article retention structures RT1, RT2 provided therein.

The main or engaging panel 12; 112; 312; 412 may comprise at least one stabilisation device M providing an opening in the main panel 12; 112; 312; 412 and arranged to inhibit movement in two orthogonal directions.

The present disclosure provides an apparatus 400; 500; 600; 700 for packaging one or more articles in an article carrier 90; 190; 390; 490. The apparatus 400; 500; 600; 700 comprises an article engaging tool 432A, 432B, 434; 532A, 532B, 534; 632A, 632B, 634; 732A, 732B, 734 for engaging an article B and conveying the article B in a downstream direction. The article engaging tool 432A, 432B, 434; 532A, 532B, 534; 632A, 632B, 634; 732A, 732B, 734 comprises a reference device, in the form of an abutment pin or peg 440; 540; 640; 740 for aligning a blank 10; 110; 310; 410A-B with respect to the articles B.

The article engaging tool 432A, 432B, 434; 532A, 532B, 534; 632A, 632B, 634; 732A, 732B, 734 may comprise a removable head 442; 542 to which the reference device is mounted. The head 442; 542 may comprise part of a tool-less attachment or mounting system, such as, but not limited to, a bayonet fitting.

The apparatus 400; 500; 600; 700 may comprise a plurality of article engaging tools 432A, 432B, 434; 532A, 532B, 534; 632A, 632B, 634; 732A, 732B, 734 each for engaging a respective article B, metering and grouping the articles B and conveying said articles B in a downstream direction as a metered group. Each of the plurality of article engaging tools 432A, 432B, 434; 532A, 532B, 534; 632A, 632B, 634; 732A, 732B, 734 is driven independently about an endless track having a working reach and a return reach.

The plurality of article engaging tools 432A, 432B, 434; 532A, 532B, 534; 632A, 632B, 634; 732A, 732B, 734 may be configured to form a metered group of articles B and align a blank 10; 110; 310; 410A-B therewith. The articles B may be formed into the metered group and simultaneously aligned with a blank 10; 110; 310; 410A-B as it is fed onto the upper ends of the articles B. The blank 10; 110; 310; 410A-B may be brought into contact or alignment with an abutment pin 440; 540; 640; 740 mounted to a leading or downstream one of the plurality of article engaging tools 432A, 432B, 434; 532A, 532B, 534; 632A, 632B, 634; 732A, 732B, 734 forming the article group.

The blank 10; 110; 310; 410A-B may be brought into contact or alignment with an abutment pin 440; 540; 640; 740 mounted to each of a pair of leading or downstream one of the plurality of article engaging tools 432A, 432B, 434; 532A, 532B, 534; 632A, 632B, 634; 732A, 732B, 734 forming the article group.

At least one abutment pin 440; 540; 640; 740 mounted to a trailing or upstream one of the plurality of article engaging tools 432A, 432B, 434; 532A, 532B, 534; 632A, 632B, 634; 732A, 732B, 734 forming the article group may be brought into contact with the blank 10; 110; 310; 410A-B as the formation of the article group is completed.

The abutment pin 440; 540; 640; 740 may be shaped to provide at least two points of contact with the registration edge to inhibit movement of the blank 10; 110; 310; 410A-B parallel with the direction of flow of the blank 10; 110; 310; 410A-B through the apparatus 400; 500; 600; 700 and perpendicularly or laterally with respect to the direction of flow of the blank 10; 110; 310; 410A-B through the apparatus 400; 500; 600; 700.

The apparatus 400; 500; 600; 700 may comprise an applicator 420; 520; 620; 720; AP for pressing the blank 10; 110; 310; 410A-B onto the group of articles B. The applicator 420; 520; 620; 720; AP may comprise a plurality of article receiving orifices each for receiving a respective article B of the group.

The applicator 420; 520; 620; 720; AP comprises at least one stabilisation peg 450; 650, 654; P1, P2 receivable in an opening of a stabilisation device M provided in the main panel 12; 112; 312; 412. The at least one stabilisation peg 450; 650, 654; P1, P2 constrains movement of the blank 10; 110; 310; 410A-B with respect to the applicator 420; 520; 620; 720; AP.

The at least one stabilisation peg 450; 650, 654; P1, P2 prevents or inhibits movement of the blank 10; 110; 310; 410A-B with respect to the articles B in a direction parallel with the direction of flow of the blank 10; 110; 310; 410A-B through the apparatus 400; 500; 600; 700 and in a lateral direction perpendicular with respect to the direction of flow of the blank 10; 110; 310; 410A-B through the apparatus 400; 500; 600; 700.

The applicator 420; 520; 620; 720; AP is mounted to an overhead conveyor, in the form of a wheel, which applies or engages the blank 10; 110; 310; 410A-B with the group of articles B as it is conveyed downstream by the plurality of article engaging tools 432A, 432B, 434; 532A, 532B, 534; 632A, 632B, 634; 732A, 732B, 734.

The applicator 420; 520; 620; 720; AP may comprise one or more folding dies or brakes each folding a panel hinged to the main panel 12; 112; 312; 412 at least partially about the group of articles B, said panel may comprise the registration edge.

In some embodiments, one or more panels of the blank 10; 110; 310; 410A-B may be brought into contact with a static folding guide while the applicator 420; 520; 620; 720; AP is in engagement or contact with the blank 10; 110; 310; 410A-B.

The present disclosure provides a method of packaging a plurality of articles B. The method comprises conveying a stream of articles B in a downstream direction through a packaging apparatus, engaging each article B with an article engaging tool 432A, 432B, 434; 532A, 532B, 534; 632A, 632B, 634; 732A, 732B, 734, grouping a plurality of articles B, and simultaneously applying a blank to upper ends of the articles B. The method comprises engaging at least one leading registration edge of the blank 10; 110; 310; 410A-B with a reference pin 440; 540; 640; 740 mounted to a leading article engaging tool 432A, 432B, 434; 532A, 532B, 534; 632A, 632B, 634; 732A, 732B, 734. The method comprises metering the group of articles B and engaging a reference pin 440; 540; 640; 740 mounted to a trailing article engaging tool 432A, 432B, 434; 532A, 532B, 534; 632A, 632B, 634; 732A, 732B, 734 with at least one trailing registration edge of the blank 10; 110; 310; 410A-B.

The method further comprises applying the blank 10; 110; 310; 410A-B to the group of articles B to engage each article B in a respective article retention device RT1, RT2 provided in a main panel 12; 112; 312; 412 of the blank 10; 110; 310; 410A-B. Applying the blank 10; 110; 310; 410A-B to the group of articles B comprises inserting a stabilising peg 450; 650, 654; P1, P2 in an opening of a stabilisation device M provided in the main panel 12; 112; 312; 412 prior to pressing the main panel onto the group of articles B.

Applying the blank 10; 110; 310; 410A-B to the group of articles B may further comprise at least partially folding one or more panels comprising the leading and/or trailing registration edges and coupled to the main panel 12; 112; 312; 412. Said one or more panels may be folded prior to, simultaneously with, or after the main panel 12; 112; 312; 412 engages the group of articles B.

The present disclosure provides a carrier 490 of the top engaging type having article retention structures RT, RT1, RT2 for engaging articles B and a blank 410A-B for forming the article carrier 490. The present disclosure provides a plurality of connected blanks 401 which can be simultaneously applied to a plurality of groups of articles B. Each of the blanks 410A-B in a plurality of connected blanks 401 is frangibly connected to at least one other blank 410A-B.

The present disclosure provides an apparatus 700 for packaging one or more articles in an article carrier 490. The apparatus may comprise an article engaging tool 732A, 732B, 734 for engaging an article B and conveying the article B in a downstream direction. The article engaging tool 732A, 732B, 734 comprises a reference device, in the form of an abutment pin or peg 740, for aligning a plurality of connected blanks 401 with respect to the articles B.

The plurality of article engaging tools 732A, 732B, 734 may be configured to form metered groups of articles B and align a plurality of connected blanks 401 therewith. The articles B may be formed into the metered groups and simultaneously aligned with a plurality of connected blanks 401 as it is fed onto the upper ends of the articles B. The plurality of connected blanks 401 may be brought into contact or alignment with an abutment pin 740 mounted to a leading or downstream one of the plurality of article engaging tools 732A, 732B, 734 forming the article groups.

The plurality of connected blanks 401 may be brought into contact or alignment with an abutment pin 740 mounted to each of a pair of leading or downstream one of the plurality of article engaging tools 732A, 732B, 734 forming the article groups.

At least one abutment pin 740 mounted to a trailing or upstream one of the plurality of article engaging tools 732A, 732B, 734 forming the article groups may be brought into contact with the plurality of connected blanks 401 as the formation of the article group is completed.

The abutment pin 740 may be shaped to provide at least two points of contact with the registration edge to inhibit movement of the plurality of connected blanks 401 parallel with the direction of flow of the plurality of connected blanks 401 through the apparatus 700 and perpendicularly or laterally with respect to the direction of flow of the plurality of connected blanks 401 through the apparatus 700.

The present disclosure provides an applicator AP; 720 for pressing the plurality of connected blanks 401 onto the groups of articles B. The applicator AP; 720 may comprise a plurality of article receiving orifices each for receiving a respective article B of the group. The applicator 720 may form part of tool head 702 mounted to an overhead wheel arrangement 754 for applying or engaging the plurality of connected blanks 401 to the groups of articles B as they are conveyed upon a conveyor in a downstream direction. The applicator AP; 720 comprises at least one disconnecting or separating device for breaking the frangible connections 413 between adjacently disposed blanks 410A-B.

The applicator AP; 720 may comprise at least one stabilisation peg P1, P2 receivable in an opening of a stabilisation device provided in the main panel 412 of at least one blank 410A-B forming the plurality of connected blanks 401. The at least one stabilisation peg P1, P2 constrains movement of the plurality of connected blanks 401 with respect to the applicator AP; 720.

The at least one stabilisation peg P1, P2 prevents or inhibits movement of the plurality of connected blanks 401 with respect to the articles B in a direction parallel with the direction of flow of the plurality of connected blanks 1 through the packaging apparatus and in a lateral direction perpendicular with respect to the direction of flow of the plurality of connected blanks 401 through the packaging apparatus.

The stabilisation peg P1, P2 may be detachably or removably mounted to the applicator AP; 720. The stabilisation peg P1, P2 may be coded or keyed to a specific mounting location or orientation.

The disconnecting or separating device may comprise one or more blades CE1, CE2, CE3, CE4, BL; BL1; BL2, BL3; BL4; BL5 arranged to avoid collision with the articles being packaged. The blades may be mounted to a common body in a spaced apart configuration. The blades be arranged to be received in gaps or voids between two or more articles B, the articles B being generally cylindrical in shape. The frangible connections 413 may comprise connecting nicks or bridging portions N1, N2, N3, N4 in vertical registry with the gaps or voids between two or more articles B. The connecting nicks or bridging portions N1, N2, N3, N4 may be arranged in pairs disposed on substantially opposing sides of a region of closest proximity between an article B in a first blank and an article B in a second connected blank.

The blades BL, BL2, BL3 may be detachably or removably mounted to the applicator AP; 720 such that the arrangement of the blades BL, BL2, BL3 is reconfigurable depending upon the arrangement and/or size of the blanks being applied to the articles B.

The present disclosure also provides a disconnecting apparatus for separating a plurality of connected article carriers into discrete carriers. The disconnecting apparatus may comprise a plurality of article receiving orifices each for receiving a respective article B of the group. The disconnecting apparatus may comprise at least one blades BL; BL1; BL2, BL3; BL4; BL5 detachably or removably mounted thereto such that the arrangement of the blades BL; BL1; BL2, BL3; BL4; BL5 is reconfigurable depending upon the arrangement and/or size of the blanks being applied to the articles B.

The blade BL; BL1; BL2, BL3; BL4; BL5 may be supported in a direction transverse by a support or supplementary blade. The blade and the support or supplementary blade may each comprise receiver in the form of recess or slot for receiving a portion of the other.

The present disclosure provides a method of packaging a plurality of articles B. The method comprises conveying a stream of articles B in a downstream direction through a packaging apparatus, engaging each article B with an article engaging tool 732A, 732B, 734, grouping a plurality of articles B, and simultaneously applying a plurality of connected blanks 401 to upper ends of the articles B. The method comprises engaging at least one leading registration edge of the blank plurality of connected blanks 401 with a reference pin 740 mounted to a leading article engaging tool 732A, 732B, 734. The method comprises metering the group of articles B and engaging a reference pin 740 mounted to a trailing article engaging tool 732A, 732B, 734 with at least one trailing registration edge of the plurality of connected blanks 401.

The method further comprises separating the plurality of connected blanks 401 into discrete blanks 410A, 410B and applying the discrete blanks 410A, 410B simultaneously to respective groups of articles B. Separating the plurality of connected blanks 401 comprises inserting a stabilising peg P1, P2 in an opening of a stabilisation device provided in the main panel 412 prior to severing a frangible connection between pairs of blanks 410A, 410B.

The blanks 10; 110; 310; 410A-B include at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). An example of such a substrate is a 27 point (pt.) SBS board (solid bleached sulphate paperboard coated on one side, trade name PrintKote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

The blanks 10; 110; 310; 410A-B may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g., MYLAR®, which is a bi-axially oriented polyester, oriented nylon, cross-laminated polyolefin or high-density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

It can be appreciated that various changes may be made within the scope of the present invention. For example, the size and shape of the panels and apertures may be adjusted to accommodate articles of differing size or shape. The shoulder panels may be omitted. The present invention is not limited to cartons of the top-engaging type, the invention may be employed with other carton styles such as, but not limited to, open top crates, lidded or closed top crates. In various embodiments, the separator device may be readily adapted to apply blanks to groups of articles B, similarly the applicator device may be readily adapted to separate a plurality of connected article carriers.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article engaging carrier for packaging at least one article, the carrier comprising a main panel having at least one article retention structure for engaging an article, each article retention structure comprising an aperture and an engaging edge for engaging the article, the carrier further comprising a peripheral edge, wherein a portion of the peripheral edge of one panel provides a registration edge shaped to inhibit movement in two orthogonal directions when engaged by a reference device of a packaging apparatus.

2. An article carrier according to claim 1, comprising a side panel hingedly connected to the main panel by a hinged connection.

3. An article carrier according to claim 2, wherein the at least one registration edge is provided by a peripheral edge portion of the side panel.

4. An article carrier according to claim 3, wherein the at least one registration edge comprises a leading registration edge and a trailing registration edge.

5. An article carrier according to claim 1, comprising a pair of opposing side panels or a pair of opposing end panels each hingedly connected to the main panel by a hinged connection and comprising at least one registration edge.

6. An article carrier according to claim 1, wherein the panel having a peripheral edge portion providing at least one registration edge is hingedly connected to the main panel by a hinged connection.

7. An article carrier according to claim 1, wherein the main panel comprises at least one stabilisation device providing an opening in the main panel and configured to inhibit movement in two orthogonal directions.

8. An apparatus for packaging one or more articles in an article carrier, the apparatus comprising an article engagement tool for engaging an article and conveying the article in a downstream direction, wherein the article engagement tool comprises a reference device for aligning at least one blank for forming the article carrier with the one or more articles to be packaged, each of the at least one blank comprising a main panel having at least one article retention structure for engaging an article, and at least one panel having a peripheral edge, a portion of which provides at least one registration edge shaped to inhibit movement in two orthogonal directions when engaged by the reference device.

9. An apparatus according to claim 8, wherein the apparatus comprises an overhead conveyor for conveying the blank onto the one or more articles.

10. An apparatus according to claim 8, wherein the reference device comprises an abutment pin extending upwardly from the article engagement tool beyond the upper extremity of the one or more articles.

11. An apparatus according to claim 8, wherein the article engagement tool comprises a removable head to which the reference device is mounted.

12. An apparatus according to claim 8, wherein the apparatus comprises a plurality of article engagement tools each for engaging a respective article, the plurality of article engagement tools being moveable for metering and grouping the articles and conveying said articles in a downstream direction as at least one metered group.

13. An apparatus according to claim 8, wherein the apparatus comprises an applicator for pressing the at least one blank onto the at least one group of articles, the applicator comprises a plurality of article receiving orifices each for receiving a respective article of the at least one group of articles formed by the apparatus.

14. An apparatus according to claim 13, wherein the applicator comprises at least one stabilisation peg receivable in an opening of a stabilisation device provided in a main panel of the at least one blank, the at least one stabilisation peg being configured to constrain movement of the at least one blank with respect to the applicator.

15. An apparatus according to claim 14, wherein at least one stabilisation peg prevents or inhibits movement of the at least one blank with respect to the at least one group of articles in a direction parallel with the direction of flow of the at least one blank through the apparatus and in a lateral direction perpendicular with respect to the direction of flow of the at least one blank through the apparatus.

16. A blank for forming an article carrier, the blank comprising a comprising a main panel having at least one article retention structure for engaging an article, each article retention structure comprising an aperture and an engaging edge for engaging the article, the blank further comprising a peripheral edge, wherein a portion of the peripheral edge of one panel provides a registration edge shaped to inhibit movement in two orthogonal directions when engaged by a reference device of a packaging apparatus.

17. A plurality of the blank of claim 16, each blank being frangibly connected to at least one adjacent blank by a frangible connection, each blank of the plurality of connected blanks comprising a main panel having at least one article retention structure for engaging an article, the plurality of connected blanks comprising at least one panel having a peripheral edge, wherein a portion of the peripheral edge provides at least one registration edge shaped to inhibit movement in two orthogonal directions when engaged by a reference device of a packaging apparatus.

18. A blank according to claim 16, wherein the main panel comprises at least one stabilization device providing an opening in the main panel to inhibit movement of the blank in two orthogonal directions when the opening receives a stabilizing peg of the packaging apparatus for attaching the main panel onto the at least one article.

19. A blank according to claim 18, wherein the opening is defined by at least one tab struck from the main panel and hingedly connected thereto.

20. A blank according to claim 18 wherein the opening is non-circular in shape to inhibit rotational movement of the blank when the opening receives a stabilizing peg of an applicator having a non-circular cross section.

* * * * *